US011427901B2

(12) United States Patent
Imanami et al.

(10) Patent No.: US 11,427,901 B2
(45) Date of Patent: Aug. 30, 2022

(54) WIRE ROD FOR CUTTING WORK

(71) Applicant: JFE STEEL CORPORATION, Tokyo (JP)

(72) Inventors: Yuta Imanami, Tokyo (JP); Kazuaki Fukuoka, Tokyo (JP); Kimihiro Nishimura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 293 days.

(21) Appl. No.: 16/488,687

(22) PCT Filed: Feb. 27, 2018

(86) PCT No.: PCT/JP2018/007283

§ 371 (c)(1),
(2) Date: Aug. 26, 2019

(87) PCT Pub. No.: WO2018/159617

PCT Pub. Date: Sep. 7, 2018

(65) Prior Publication Data

US 2020/0248291 A1 Aug. 6, 2020

(30) Foreign Application Priority Data

Feb. 28, 2017 (JP) ..... JP2017-037695
Feb. 28, 2017 (JP) ..... JP2017-037705

(51) Int. Cl.
*C22C 38/60* (2006.01)
*C22C 38/00* (2006.01)
(Continued)

(52) U.S. Cl.
CPC ..... *C22C 38/60* (2013.01); *C22C 38/001* (2013.01); *C22C 38/002* (2013.01);
(Continued)

(58) Field of Classification Search
None
See application file for complete search history.

(56) References Cited

U.S. PATENT DOCUMENTS 5,961,747 A 10/1999 Deardo et al.
6,162,389 A 12/2000 Hase et al.
(Continued)

FOREIGN PATENT DOCUMENTS

CN 1209846 A 3/1999
CN 1696326 A 11/2005
(Continued)

OTHER PUBLICATIONS

Machine translation from Espacenet of JP 4876638 B2 (translated Jun. 29, 2021) (Year: 2012).*
(Continued)

*Primary Examiner* — Elizabeth Collister
(74) *Attorney, Agent, or Firm* — Kenja IP Law PC

(57) ABSTRACT

Provided is a wire rod that has superior machinability by cutting regardless of the type of tool material and the type of lubricant and even in the case where no lubricant is used. A wire rod for cutting work comprises: a specific chemical composition; and Vickers hardness that satisfies the following expressions (1) and (2) in the case where an average aspect ratio of ferrite grains at a position of ¼ of a diameter from a surface of the wire rod for cutting work is more than 2.8, and satisfies the following expressions (3) and (4) in the case where the average aspect ratio is 2.8 or less, $$H_{ave} \leq 350 \quad (1)$$

$$H_{\sigma} \leq 30 \quad (2)$$

$$H_{ave} \leq 250 \quad (3)$$

$$H_{\sigma} \leq 20 \quad (4).$$

9 Claims, 2 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |

(52) U.S. Cl.

CPC ..... *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01)

(56) References Cited

U.S. PATENT DOCUMENTS

| | | | | |
|---|---|---|---|---|
| 6,635,129 | B1 | 10/2003 | Nagahama et al. | |
| 2005/0252580 | A1 | 11/2005 | Shimizu et al. | |
| 2011/0239835 | A1 | 10/2011 | Aiso et al. | |
| 2013/0146181 | A1 | 6/2013 | Kubota | |
| 2015/0017471 | A1 * | 1/2015 | Shuto ..... | B32B 15/01 428/659 |

FOREIGN PATENT DOCUMENTS

| | | | | | |
|---|---|---|---|---|---|
| CN | 101400814 | A | | 4/2009 | |
| CN | 102209798 | A | | 10/2011 | |
| CN | 103966531 | A | | 8/2014 | |
| EP | 1335035 | A1 | | 8/2003 | |
| EP | 3309272 | A1 | | 4/2018 | |
| JP | S60121220 | A | | 6/1985 | |
| JP | 2001011570 | A | | 1/2001 | |
| JP | 2001011576 | A | | 1/2001 | |
| JP | 2001207240 | A | | 7/2001 | |
| JP | 2001523766 | A | | 11/2001 | |
| JP | 2003253390 | A | | 9/2003 | |
| JP | 2004027333 | A | | 1/2004 | |
| JP | 2007239015 | A | | 9/2007 | |
| JP | 2007262435 | A | | 10/2007 | |
| JP | 4876638 | B2 | * | 2/2012 | ..... C21D 8/021 |
| JP | 5954483 | B2 | | 7/2016 | |
| JP | 5954484 | B2 | | 7/2016 | |
| KR | 1020080094941 | A | | 10/2008 | |
| WO | 2016199843 | A1 | | 12/2016 | |

OTHER PUBLICATIONS

Jun. 26, 2020, Communication pursuant to Article 94(3) EPC issued by the European Patent Office in the corresponding European Patent Application No. 18761552.1.

K. Brunelli et al., Microstructural Evolution of a Continuously Cooled Air Hardening Steel, Metallography, Microstructure, and Analysis, 2013, pp. 56-66, vol. 2, No. 2.

Oct. 29, 2019, the Extended European Search Report issued by the European Patent Office in the corresponding European Patent Application No. 18761552.1.

Sep. 27, 2020, Office Action issued by the China National Intellectual Property Administration in the corresponding Chinese Patent Application No. 201880013876.6 with English language search report.

May 15, 2018, International Search Report issued in the International Patent Application No. PCT/JP2018/007283.

Nov. 2, 2020, Office Action issued by the Korean Intellectual Property Office in the corresponding Korean Patent Application No. 10-2019-7028368 with English language concise statement of relevance.

* cited by examiner

WIRE ROD FOR CUTTING WORK

TECHNICAL FIELD

The present disclosure relates to a wire rod for cutting work, and particularly relates to a wire rod for cutting work that has superior machinability by cutting regardless of conditions.

BACKGROUND

In production of machine structural parts used in OA equipment such as printers, typically a steel material such as a wire rod is shaped into a part shape by cutting work. The most important point in cutting work is to obtain predetermined dimensions and surface roughness. In addition, for higher productivity, it is desirable to increase tool life, increase cutting speed, and improve chip treatability.

In view of such circumstances, steel types with improved machinability by cutting are normally used as steel for cutting work. For example, low-carbon sulfur free-cutting steel (SUM23, etc. in JIS) in which a large amount of Mn sulfide is dispersed and low-carbon sulfur composite free-cutting steel (SUM24L, etc. in JIS) in which not only a large amount of Mn sulfide is dispersed but also lead as a free-cutting element is contained are often used.

JP 2003-253390 A (PTL 1) proposes steel having superior finished surface roughness and little dimensional change by defining the average width of sulfide inclusions and the yield ratio of a wiredrawn wire.

JP 5954483 B2 (PTL 2) and JP 5954484 B2 (PTL 3) propose steel having superior machinability by cutting by defining the dispersion states of MnS inclusions, Pb inclusions, and Pb-MnS inclusions.

JP 2007-239015 A (PTL 4) proposes free-cutting steel having a steel composition that contains Nb and having surface hardness in a limited range, and a production method.

CITATION LIST

Patent Literatures

PTL 1: JP 2003-253390 A
PTL 2: JP 5954483 B2
PTL 3: JP 5954484 B2
PTL 4: JP 2007-239015 A

SUMMARY

Technical Problem

In PTL 1, the average width of sulfide inclusions and the yield ratio are adjusted to improve machinability by cutting. This machinability by cutting is evaluated by a test using a high speed steel tool (SKH4). There are, however, various types of tool materials used for cutting work besides a high-speed steel, such as coating material of CVD or PVD, cermet, and ceramic. Therefore, in the case where the type of tool material changes, the adjustment of the average width of sulfide inclusions and the yield ratio described in PTL 1 may not necessarily contribute to improved machinability by cutting.

A lubricant is usually used in cutting work. As such a lubricant, various lubricants having various physical properties are used. PTL 1, however, makes no reference to a lubricant used in the test of machinability by cutting. Hence, in the case where the type of lubricant changes, the average width of sulfide inclusions and the yield ratio proposed in PTL 1 may not contribute to improved machinability by cutting.

In PTL 2 and PTL 3, the dispersion states of MnS inclusions, Pb inclusions, and Pb-MnS inclusions are adjusted to improve machinability by cutting. A high speed steel tool (SKH4) is used in a test of machinability by cutting in PTL 2 and PTL 3. However, since there are various types of tool materials as mentioned above, in the case where the type of tool material changes, the methods proposed in PTL 2 and PTL 3 may not contribute to improved machinability by cutting. Likewise, in the case where the type of lubricant changes, the methods proposed in PTL 2 and PTL 3 may not contribute to improved machinability by cutting.

In PTL 4, too, machinability by cutting is evaluated only under specific cutting conditions, and sufficient machinability by cutting may not be obtained under different cutting conditions.

It could therefore be helpful to provide a wire rod that has superior machinability by cutting regardless of the type of tool material and the type of lubricant and even in the case where no lubricant is used.

Solution to Problem

As a result of conducting extensive studies on the relationship between the chemical composition and the machinability by cutting of a wire rod, we discovered a chemical composition and mechanical properties suitable for achieving superior machinability by cutting regardless of the type of tool material and the type of lubricant and even in the case where no lubricant is used. The present disclosure is based on these discoveries.

We thus provide the following.

1. A wire rod for cutting work, comprising:

a chemical composition containing (consisting of)

C: 0.001 mass % to 0.150 mass %,
Si: 0.010 mass % or less,
Mn: 0.20 mass % to 2.00 mass %,
P: 0.02 mass % to 0.15 mass %,
S: 0.20 mass % to 0.50 mass %,
N: 0.0300 mass % or less, and
O: 0.0050 mass % to 0.0300 mass %, with the balance consisting of Fe and inevitable impurities; and Vickers hardness that satisfies the following expressions (1) and (2) in the case where an average aspect ratio of ferrite grains at a position of ¼ of a diameter from a surface of the wire rod for cutting work is more than 2.8, and satisfies the following expressions (3) and (4) in the case where the average aspect ratio is 2.8 or less, $$H_{ave} \leq 350 \quad (1)$$

$$H_{\sigma} \leq 30 \quad (2)$$

$$H_{ave} \leq 250 \quad (3)$$

$$H_{94} \leq 20 \quad (4)$$

where $H_{ave}$ is an average value in a circumferential direction of Vickers hardness at the position of ¼ of the diameter from the surface, and $H_{\sigma}$ is a standard deviation of Vickers hardness for 100 points at the position of ¼ of the diameter from the surface.

2. The wire rod for cutting work according to 1., wherein the chemical composition further contains one or more selected from the group consisting of Pb: 0.01 mass % to 0.50 mass %,
Bi: 0.01 mass % to 0.50 mass %,
Ca: 0.01 mass % or less,
Se: 0.1 mass % or less, and
Te: 0.1 mass % or less.

3. The wire rod for cutting work according to 1. or 2., wherein the chemical composition further contains one or more selected from the group consisting of Cr: 3.0 mass % or less,
Al: 0.010 mass % or less,
Sb: 0.010 mass % or less,
Sn: 0.010 mass % or less,
Cu: 1.0 mass % or less,
Ni: 1.0 mass % or less, and
Mo: 1.0 mass % or less.

4. The wire rod for cutting work according to any one of 1. to 3., wherein the chemical composition further contains one or more selected from the group consisting of Nb: 0.050 mass % or less,
Ti: 0.050 mass % or less,
V: 0.050 mass % or less,
Zr: 0.050 mass % or less,
W: 0.050 mass % or less,
Ta: 0.050 mass % or less,
Y: 0.050 mass % or less,
Hf: 0.050 mass % or less, and
B: 0.050 mass % or less.

Advantageous Effect

It is thus possible to provide a wire rod that has superior machinability by cutting regardless of the type of tool material and the type of lubricant and even in the case where no lubricant is used.

DETAILED DESCRIPTION

[Chemical Composition]

Figure 1A:
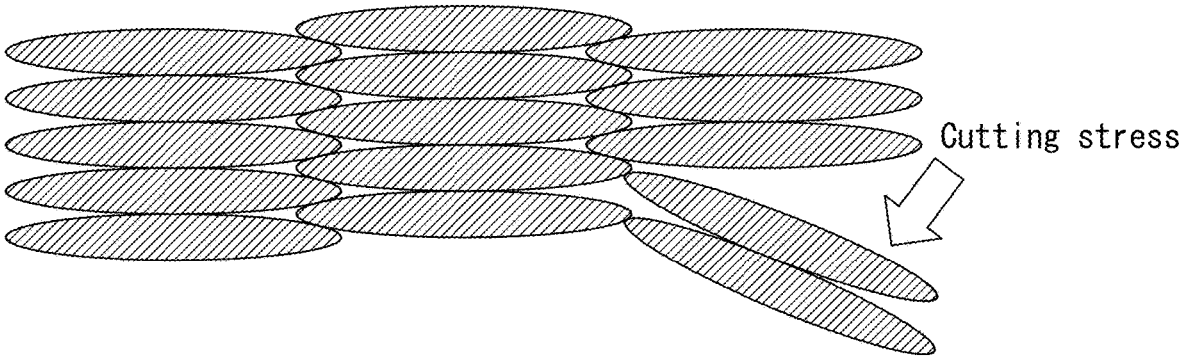
FIG. 1A is a schematic diagram illustrating the relationship between the aspect ratio of ferrite grains and the machinability by cutting.

The reasons for limiting the chemical composition of the wire rod for cutting work (hereafter also simply referred to as "wire rod") to the foregoing range in the present disclosure will be described in detail below.

C: 0.001 mass % to 0.150 mass %

C is an element that improves the strength of the steel. To achieve sufficient strength as structural steel, the C content needs to be 0.001 mass % or more. The C content is therefore 0.001 mass % or more, and preferably 0.01 mass % or more. If the C content is more than 0.150 mass %, hardness increases excessively, and the tool life in cutting work decreases. The C content is therefore 0.150 mass % or less, preferably 0.13 mass % or less, and more preferably 0.10 mass % or less.

Si: 0.010 mass % or less

Si in the steel combines with oxygen to form $SiO_2$. $SiO_2$ acts as hard particles in the steel and facilitates abrasive wear of the tool in cutting, thus causing a decrease in tool life. The Si content is therefore 0.010 mass % or less, and preferably 0.003 mass % or less. No lower limit is placed on the Si content, and the Si content may be 0, although in industrial terms the Si content is more than 0 mass %. Si has an effect of improving descalability in shot blasting and pickling performed before cold wiredrawing. To achieve this effect, the Si content is preferably 0.0005 mass % or more.

Mn: 0.20 mass % to 2.00 mass %

Mn is an element that has an effect of improving machinability by cutting by combining with S to form sulfide. To achieve this effect, the Mn content needs to be 0.20 mass % or more. The Mn content is therefore 0.20 mass % or more, preferably 0.60 mass % or more, and more preferably 0.80 mass % or more. Excessively adding Mn increases hardness by solid solution strengthening, and causes a decrease in tool life in cutting work. The Mn content is therefore 2.00 mass % or less, preferably 1.80 mass % or less, and more preferably 1.60 mass % or less.

P: 0.02 mass % to 0.15 mass %

P is an element that has an effect of improving machinability by cutting. To achieve this effect, the P content needs to be 0.02 mass % or more. The P content is therefore 0.02 mass % or more, and preferably 0.03 mass % or more. If the P content is more than 0.15 mass %, the effect of improving machinability by cutting is saturated. The P content is therefore 0.15 mass % or less, preferably 0.14 mass % or less, and more preferably 0.13 mass % or less.

S: 0.20 mass % to 0.50 mass %

S is an element that exists as sulfide inclusions and is effective in improving machinability by cutting. To achieve this effect, the S content needs to be 0.20 mass % or more. The S content is therefore 0.20 mass % or more, preferably 0.25 mass % or more, and more preferably 0.30 mass % or more. If the S content is more than 0.50 mass %, the hot workability of the steel decreases. The S content is therefore 0.50 mass % or less, preferably 0.45 mass % or less, and more preferably 0.43 mass % or less.

N: 0.0300 mass % or less

N is an element that has an effect of improving surface roughness after cutting. Excessively adding N, however, increases the hardness of the steel material, and causes a decrease in tool life in cutting. The N content is therefore 0.0300 mass % or less, preferably 0.0200 mass % or less, and more preferably 0.0180 mass % or less. No lower limit is placed on the N content, and the N content may be 0, although in industrial terms the N content is more than 0 mass %. The N content is preferably 0.002 mass % or more, and more preferably 0.004 mass % or more.

O: 0.0050 mass % to 0.0300 mass %

O is an element that has an effect of improving machinability by cutting through its effect of coarsening sulfide inclusions. To achieve this effect, the O content needs to be 0.0050 mass % or more. The O content is therefore 0.0050 mass % or more, and preferably 0.0100 mass % or more. Excessively adding O decreases the toughness of the steel material, and causes a premature fracture of the structural member. The O content is therefore 0.0300 mass % or less, preferably 0.0250 mass % or less, and more preferably 0.0200 mass % or less.

The wire rod for cutting work according to one of the disclosed embodiments has the chemical composition containing the above-described elements with the balance consisting of Fe and inevitable impurities.

In another one of the disclosed embodiments, the chemical composition may optionally further contain one or more selected from the group consisting of Pb: 0.01 mass % to 0.50 mass %,
Bi: 0.01 mass % to 0.50 mass %,
Ca: 0.01 mass % or less,
Se: 0.1 mass % or less, and
Te: 0.1 mass % or less.

Pb: 0.01 mass % to 0.50 mass %

Pb is an element that has an effect of refining chips in cutting. By adding Pb, the chip treatability can be further improved. To achieve this effect, in the case of adding Pb, the Pb content is 0.01 mass % or more. If the Pb content is excessively high, the chip treatability improving effect is saturated. Accordingly, to reduce an increase of alloy cost, the Pb content is 0.50 mass % or less, preferably 0.30 mass % or less, and more preferably 0.10 mass % or less.

Bi: 0.01 mass % to 0.50 mass %

Bi is an element that has an effect of refining chips in cutting, like Pb. By adding Bi, the chip treatability can be further improved. To achieve this effect, in the case of adding Bi, the Bi content is 0.01 mass % or more. If the Bi content is excessively high, the chip treatability improving effect is saturated. Accordingly, to reduce an increase of alloy cost, the Bi content is 0.50 mass % or less, preferably 0.30 mass % or less, and more preferably 0.10 mass % or less.

Ca: 0.01 mass % or less

Ca is an element that has an effect of refining chips in cutting, like Pb. By adding Ca, the chip treatability can be further improved. However, if the Ca content is excessively high, the chip treatability improving effect is saturated. Accordingly, to reduce an increase of alloy cost, the Ca content is 0.01 mass % or less, preferably 0.008 mass % or less, and more preferably 0.007 mass % or less. No lower limit is placed on the Ca content, but the Ca content is preferably 0.0010 mass % or more, more preferably 0.003 mass % or more, and further preferably 0.005 mass % or more.

Se: 0.1 mass % or less

Se is an element that has an effect of refining chips in cutting, like Pb. By adding Se, the chip treatability can be further improved. However, if the Se content is excessively high, the chip treatability improving effect is saturated. Accordingly, to reduce an increase of alloy cost, the Se content is 0.1 mass % or less, preferably 0.008 mass % or less, and more preferably 0.007 mass % or less. No lower limit is placed on the Se content, but the Se content is preferably 0.0010 mass % or more, more preferably 0.003 mass % or more, and further preferably 0.005 mass % or more.

Te: 0.1 mass % or less

Te is an element that has an effect of refining chips in cutting, like Pb. By adding Te, the chip treatability can be further improved. However, if the Te content is excessively high, the chip treatability improving effect is saturated. Accordingly, to reduce an increase of alloy cost, the Te content is 0.1 mass % or less, preferably 0.008 mass % or less, and more preferably 0.007 mass % or less. No lower limit is placed on the Te content, but the Te content is preferably 0.0010 mass % or more, more preferably 0.003 mass % or more, and further preferably 0.005 mass % or more.

In another one of the disclosed embodiments, the chemical composition may optionally further contain one or more selected from the group consisting of Cr: 3.0 mass % or less,
Al: 0.010 mass % or less,
Sb: 0.010 mass % or less,
Sn: 0.010 mass % or less,
Cu: 1.0 mass % or less,
Ni: 1.0 mass % or less, and
Mo: 1.0 mass % or less.

Cr, Al, Sb, Sn, Cu, Ni, and Mo are each an element that influences scale property or corrosion resistance after rolling, and may be optionally added.

Sb and Sn each have an effect of improving descalability in shot blasting and pickling performed before cold wire-drawing, and may be optionally added. If the Sb content and the Sn content are each more than 0.010 mass %, the descalability improving effect is saturated. The Sb content and the Sn content are therefore each 0.010 mass % or less, and preferably 0.009 mass % or less. In the case of adding any of Sb and Sn, the Sb content and the Sn content are each preferably 0.003 mass % or more, and more preferably 0.005 mass % or more.

Cr, Al, Cu, Ni, and Mo are each an element that has an effect of improving corrosion resistance, and may be optionally added. Excessively adding any of Cr, Al, Cu, Ni, and Mo, however, causes the solid solution strengthening of the steel, and the resultant increase in hardness causes a decrease in tool life in cutting. Accordingly, the upper limit of the Cr content is 3.0 mass %, the upper limit of the Al content is 0.010 mass %, and the upper limit of the content of each of Cu, Ni, and Mo is 1.0 mass %. The content of each of Cr, Al, Cu, Ni, and Mo is preferably 0.001 mass % or more.

In another one of the disclosed embodiments, the chemical composition may optionally further contain one or more selected from the group consisting of Nb: 0.050 mass % or less,
Ti: 0.050 mass % or less,
V: 0.050 mass % or less,
Zr: 0.050 mass % or less,
W: 0.050 mass % or less,
Ta: 0.050 mass % or less,
Y: 0.050 mass % or less,
Hf: 0.050 mass % or less, and
B: 0.050 mass % or less.

Nb, Ti, V, Zr, W, Ta, Y, and Hf each have an effect of improving the strength of the wire rod by forming fine precipitates. B has an action of segregating to grain boundaries to strengthen the grain boundaries, and has an effect of improving the strength of the wire rod. Particularly for a member with high load stress, adding one or more selected from the group consisting of Nb, Ti, V, Zr, W, Ta, Y, Hf, and B can improve the fatigue strength. The content of each of Nb, Ti, V, Zr, W, Ta, Y, Hf, and B is preferably 0.0001 mass % or more. Excessively adding any of these components over 0.050 mass % decreases the hot workability of the steel, and accordingly the upper limit is 0.050 mass %.

The chemical composition of the wire rod according to one of the disclosed embodiments contains the above-described elements with the balance consisting of Fe and inevitable impurities. The chemical composition of the wire rod according to one of the disclosed embodiments preferably consists of the above-described elements with the balance consisting of Fe and inevitable impurities.

[Vickers Hardness]

The wire rod for cutting work according to the present disclosure needs to have Vickers hardness that satisfies the following expressions (1) and (2) in the case where the average aspect ratio of ferrite grains at a position of ¼ of the diameter from the surface of the wire rod for cutting work is more than 2.8 and satisfies the following expressions (3) and (4) in the case where the average aspect ratio is 2.8 or less:

$$H_{ave} \leq 350 \quad (1)$$

$$H_{\sigma} \leq 30 \quad (2)$$

$$H_{ave} \leq 250 \quad (3)$$

$$H_{94} \leq 20 \quad (4)$$

The average aspect ratio, $H_{ave}$, and $H_{\sigma}$ can be determined according to the following procedures.

Average Aspect Ratio

A section including the central axis of the wire rod and parallel to the longitudinal direction of the wire rod is mirror polished and then etched with nital. Following this, ferrite grains at a position in depth of ¼ of the diameter of the wire rod from the surface of the wire rod are observed using an optical microscope, and the maximum Feret diameter and the minimum Feret diameter are measured for each of 100 ferrite grains by image analysis. The aspect ratio of each of the 100 ferrite grains, defined by "maximum Feret diameter/minimum Feret diameter", is calculated, and the average value of the calculated aspect ratios is taken to be the average aspect ratio.

$H_{ave}$

The Vickers hardness at a position in depth of ¼ of the diameter of the wire rod from the surface of the wire rod is measured at 100 points under a load of 0.1 kgf, and the average value of the measured Vickers hardness values is taken to be $H_{ave}$. Regarding indentations formed in the measurement of the Vickers hardness, the distance between adjacent indentations is set to 0.3 mm or more. To perform the Vickers hardness measurement evenly in the circumferential direction of the wire rod, on a circle that is in a section orthogonal to the longitudinal direction of the wire rod and whose radius is ¼ of the diameter and whose center coincides with the center of the section of the wire rod, Vickers hardness is measured per an angle of 3.6° with respect to the center. Hereafter, $H_{ave}$ is also referred to as "average hardness".

$H_{\sigma}$ $H_{\sigma}$ is the standard deviation of the Vickers hardness values of 100 points measured by the same method as for $H_{ave}$. Hereafter, $H_{\sigma}$ is also referred to as "hardness standard deviation".

The most important factor on the work material side (wire rod) influencing the tool life when cutting the wire rod is the hardness of the wire rod. In detail, it is very important to limit the hardness of the wire rod to low level and also suppress variation in hardness and in particular variation in hardness in the circumferential direction, in order to improve the machinability by cutting of the wire rod, i.e. to achieve superior machinability by cutting regardless of the type of tool material and the type of lubricant.

Figure 1B:
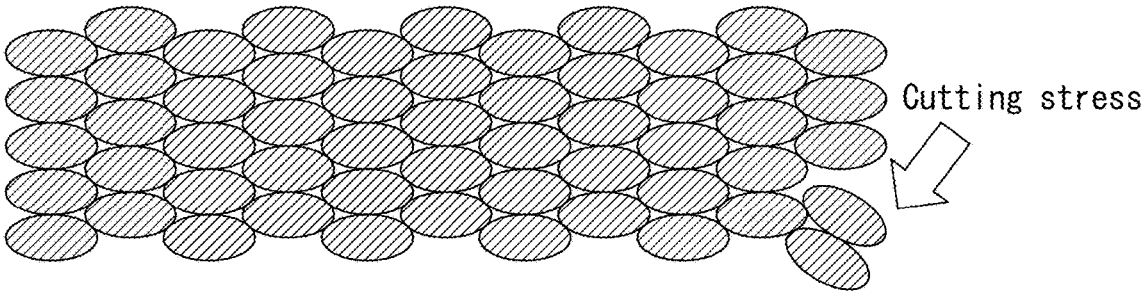
FIG. 1B is a schematic diagram illustrating the relationship between the aspect ratio of ferrite grains and the machinability by cutting.

The machinability by cutting of the wire rod is influenced not only by the Vickers hardness but also by the aspect ratio of ferrite grains. A main microstructure of low-carbon free-cutting steel is ferrite. During cutting, very large stress acts on the contact portion of the steel and the tool, and the steel is forced to deform greatly, and as a result fractured and cut. As illustrated in FIGS. 1A and 1B, the aspect ratio of ferrite grains influences the resistance to the load stress, and thus influences the machinability by cutting. In detail, when the aspect ratio of ferrite grains is higher, the microstructure is fractured more easily, and thus the machinability by cutting is improved.

Our studies revealed that the ranges of $H_{ave}$ and $H_{\sigma}$ for achieving equal machinability by cutting differ between in the case where the average aspect ratio of ferrite grains (hereafter also simply referred to as "average aspect ratio") is more than 2.8 and in the case where the average aspect ratio is 2.8 or less. The required ranges of $H_{ave}$ and $H_{\sigma}$ in each of the cases will be described below. Typically, a wire rod obtained by hot forming has an average aspect ratio of ferrite grains of 1.3 or more.

In the Case where the Average Aspect Ratio is More than 2.8

In the case where the average aspect ratio of ferrite grains is more than 2.8, the upper limit of the average hardness $H_{ave}$ of the wire rod is set to 350 (HV). The upper limit is more preferably 300 (HV). The average Vickers hardness influences the average cutting resistance, and, in the case where $H_{ave}$ is more than the upper limit, the tool life decreases.

Further, the upper limit of the standard deviation $H_{\sigma}$ is set to 30 (HV). Even when the average hardness satisfies the foregoing condition, if the hardness varies in the circumferential direction, cutting alternates between a soft portion and a hard portion. Such alternate soft-hard cutting is a significant factor that decreases the tool life. That is, due to alternate soft-hard cutting, the cutting tool is intermittently subjected to a load, which accelerates the wear of the tool. Hence, the upper limit of the hardness standard deviation $H_{\sigma}$ as an index of hardness variation is limited to 30 (HV). The upper limit is more preferably 20 (HV). If $H_{\sigma}$ for 100 points is 30 (HV) or less, the intermittent load on the cutting tool due to alternate soft-hard cutting is reduced.

In the Case where the Average Aspect Ratio is 2.8 or Less

In the case where the average aspect ratio of ferrite grains is 2.8 or less, the microstructure is less susceptible to fracture during cutting as illustrated in FIG. 1B, than in the case where the average aspect ratio of ferrite grains is more than 2.8 (FIG. 1A). Accordingly, in the case where the average aspect ratio of ferrite grains is 2.8 or less, $H_{ave}$ and $H_{\sigma}$ need to be lower than in the case where the average aspect ratio of ferrite grains is more than 2.8, in order to ensure machinability by cutting. Hence, in the case where the average aspect ratio of ferrite grains is 2.8 or less, the upper limit of the average hardness $H_{ave}$ of the wire rod is set to 250 (HV). The upper limit is more preferably 200 (HV). The average hardness influences the average cutting resistance, and, in the case where $H_{ave}$ is more than the upper limit, the tool life decreases.

Further, the upper limit of the hardness standard deviation $H_{\sigma}$ is set to 25 (HV). The upper limit is more preferably 15 (HV). If $H_{\sigma}$ is 25 (HV) or less, the intermittent load on the cutting tool due to alternate soft-hard cutting is reduced.

The average hardness and the hardness variation of the wire rod as work material influence the tool life in cutting, regardless of the type of cutting tool and the type of lubricant. In other words, by appropriately limiting the average hardness and the standard deviation of the wire rod, superior machinability by cutting can be achieved regardless of the type of cutting tool and the type of lubricant. Thus, if the average hardness and the hardness variation of the wire rod satisfy the foregoing conditions, superior machinability by cutting is achieved regardless of the type of cutting tool and the type of lubricant.

[Diameter]

The diameter of the wire rod for cutting work according to the present disclosure is not limited, and may be any value. The diameter is preferably 20 mm or less, and more preferably 16 mm or less.

[Shape]

The shape of the wire rod for cutting work according to the present disclosure is not limited, and may be any shape.

For example, the cross-sectional shape perpendicular to the longitudinal direction may be circular or rectangular.

[Microstructure]

The microstructure of the wire rod according to the present disclosure is not limited, and may be any microstructure. Typically, the wire rod preferably has microstructure containing ferrite, and more preferably has microstructure containing ferrite and pearlite.

[Production method]

The wire rod for cutting work according to the present disclosure can be produced by any method. The wire rod may be a wire rod (non-wiredrawn wire) as hot-rolled without wiredrawing, or a wiredrawn wire obtained by subjecting a hot-rolled wire rod (round bar) to cold wiredrawing. The wiredrawn wire tends to have a higher average aspect ratio of ferrite grains than the non-wiredrawn wire. Suitable production conditions for each of the non-wiredrawn wire and the wiredrawn wire as examples will be described below.

Non-Wiredrawn Wire

The non-wiredrawn wire, i.e. the wire rod as hot-rolled, can be produced as follows: Steel having the foregoing predetermined chemical composition is prepared by steelmaking as raw material, and the raw material is subjected to hot rolling to form a wire rod. Here, an effective way of imparting Vickers hardness satisfying the foregoing conditions to the non-wiredrawn wire is to control the cooling rate after the hot rolling.

Cooling Rate

The average cooling rate in a temperature range of 500° C. to 300° C. in the cooling after the hot rolling is set to 0.7° C./s or less. By setting the average cooling rate to 0.7° C./s or less, spheroidizing of cementite in the cooling is facilitated, and pearlite which is originally a hard portion softens and its difference in hardness from matrix phase ferrite decreases. As a result, the average hardness of the wire rod decreases, and the hardness variation decreases, too. The average cooling rate is preferably 0.5° C./s or less, and more preferably 0.4° C./s or less. No lower limit is placed on the average cooling rate, but the average cooling rate is preferably 0.1° C./s or more in terms of productivity. The cooling conditions in a temperature range of less than 300° C. are not limited. For example, the wire rod may be allowed to naturally cool.

Wiredrawn Wire

The wiredrawn wire can be produced as follows: Steel having the foregoing predetermined chemical composition is prepared by steelmaking as raw material, and the raw material is subjected to hot rolling to form a round bar or a wire rod. The round bar or wire rod obtained as a result of the hot rolling is then wiredrawn, thus producing a wiredrawn wire. Here, an effective way of imparting Vickers hardness satisfying the foregoing conditions to the wiredrawn wire is to control both the cooling rate after the hot rolling and the area reduction rate in the wiredrawing.

Cooling Rate

In the production of the wiredrawn wire, the average cooling rate in a temperature range of 500° C. to 300° C. in the cooling after the hot rolling is set to 0.7° C./s or less, as in the production of the non-wiredrawn wire. By setting the average cooling rate to 0.7° C./s or less, spheroidizing of cementite in the cooling is facilitated, and pearlite which is originally a hard portion softens and its difference in hardness from matrix phase ferrite decreases. As a result, the average hardness of the wire rod decreases, and the hardness variation decreases, too. The average cooling rate is preferably 0.5° C./s or less, and more preferably 0.4° C./s or less. No lower limit is placed on the average cooling rate, but the average cooling rate is preferably 0.1° C./s or more in terms of productivity.

Area Reduction Rate

Further, the area reduction rate in the wiredrawing is set to 60% or less. Thus, an excessive increase in hardness is suppressed, with it being possible to limit the average hardness of the wiredrawn wire to the predetermined range. The area reduction rate is preferably 50% or less, and more preferably 40% or less.

EXAMPLES

The structure and effects of the present disclosure will be described in more detail below, by way of examples. The present disclosure is, however, not limited to the following examples.

Example 1

Steels having the chemical compositions listed in Tables 1 and 2 were each prepared by steelmaking, and subjected to hot rolling to form a wire rod. The cross-sectional shape of the wire rod was a circle with a diameter of 12 mm. The average cooling rate in a temperature range of 500° C. to 300° C. after the hot rolling in this production process is listed in Tables 3 and 4. In this example, wiredrawing was not performed. The area reduction rate in wiredrawing is therefore 0.

For each of the obtained wire rods (non-wiredrawn wires), the average hardness $H_{ave}$ and the hardness standard deviation $H_o$ were evaluated by the foregoing measurement methods. The results are listed in Tables 3 and 4.

TABLE 1

| Steel | Chemical composition (mass %)* | | | | | | | | |
|---|---|---|---|---|---|---|---|---|---|
| sample No. | C | Si | Mn | P | S | N | O | Others | Remarks |
| 1 | 0.02 | 0.001 | 0.70 | 0.08 | 0.45 | 0.0198 | 0.0064 | — | Ex. |
| 2 | 0.05 | 0.001 | 0.87 | 0.08 | 0.27 | 0.0110 | 0.0240 | — | Ex. |
| 3 | 0.08 | 0.001 | 1.01 | 0.07 | 0.34 | 0.0076 | 0.0146 | — | Ex. |
| 4 | 0.03 | 0.002 | 1.06 | 0.08 | 0.26 | 0.0106 | 0.0157 | — | Ex. |
| 5 | 0.08 | 0.001 | 0.91 | 0.08 | 0.27 | 0.0160 | 0.0240 | — | Ex. |
| 6 | 0.04 | 0.001 | 1.69 | 0.09 | 0.37 | 0.0056 | 0.0246 | — | Ex. |
| 7 | 0.11 | 0.001 | 1.21 | 0.09 | 0.30 | 0.0158 | 0.0150 | — | Ex. |
| 8 | 0.08 | 0.001 | 1.19 | 0.08 | 0.43 | 0.0135 | 0.0063 | — | Ex. |
| 9 | 0.07 | 0.001 | 0.91 | 0.08 | 0.36 | 0.0160 | 0.0096 | — | Ex. |
| 10 | 0.02 | 0.002 | 1.50 | 0.08 | 0.39 | 0.0075 | 0.0214 | — | Ex. |

TABLE 1-continued

| Steel sample No. | Chemical composition (mass %)* C | Si | Mn | P | S | N | O | Others | Remarks |
|---|---|---|---|---|---|---|---|---|---|
| 11 | 0.08 | 0.001 | 1.27 | 0.08 | 0.25 | 0.0075 | 0.0087 | — | Ex. |
| 12 | 0.04 | 0.001 | 1.19 | 0.07 | 0.42 | 0.0179 | 0.0244 | — | Ex. |
| 13 | 0.12 | 0.001 | 1.32 | 0.08 | 0.33 | 0.0071 | 0.0170 | — | Ex. |
| 14 | 0.05 | 0.001 | 1.73 | 0.08 | 0.29 | 0.0091 | 0.0106 | — | Ex. |
| 15 | 0.07 | 0.001 | 1.12 | 0.07 | 0.29 | 0.0192 | 0.0175 | — | Ex. |
| 16 | 0.08 | 0.001 | 1.76 | 0.08 | 0.40 | 0.0148 | 0.0136 | Pb: 0.01 | Ex. |
| 17 | 0.03 | 0.001 | 1.45 | 0.07 | 0.27 | 0.0183 | 0.0179 | Pb: 0.05 | Ex. |
| 18 | 0.13 | 0.001 | 1.64 | 0.09 | 0.42 | 0.0171 | 0.0168 | Pb: 0.07 | Ex. |
| 19 | 0.02 | 0.001 | 0.76 | 0.08 | 0.32 | 0.0187 | 0.0208 | Pb: 0.09 | Ex. |
| 20 | 0.06 | 0.001 | 1.29 | 0.09 | 0.26 | 0.0170 | 0.0184 | Pb: 0.15 | Ex. |
| 21 | 0.12 | 0.002 | 1.22 | 0.07 | 0.25 | 0.0077 | 0.0150 | Pb: 0.29 | Ex. |
| 22 | 0.05 | 0.001 | 1.02 | 0.07 | 0.35 | 0.0097 | 0.0199 | Pb: 0.48 | Ex. |
| 23 | 0.04 | 0.001 | 1.24 | 0.09 | 0.44 | 0.0051 | 0.0143 | Bi: 0.09 | Ex. |
| 24 | 0.09 | 0.001 | 1.28 | 0.08 | 0.41 | 0.0110 | 0.0093 | Bi: 0.27 | Ex. |
| 25 | 0.02 | 0.001 | 0.94 | 0.08 | 0.34 | 0.0051 | 0.0185 | Bi: 0.50 | Ex. |
| 26 | 0.07 | 0.001 | 1.19 | 0.07 | 0.40 | 0.0072 | 0.0085 | Ca: 0.009 | Ex. |
| 27 | 0.11 | 0.001 | 1.19 | 0.08 | 0.39 | 0.0156 | 0.0159 | Se: 0.1 | Ex. |
| 28 | 0.04 | 0.001 | 1.77 | 0.07 | 0.43 | 0.0043 | 0.0217 | Te: 0.08 | Ex. |
| 29 | 0.05 | 0.008 | 1.80 | 0.08 | 0.34 | 0.0043 | 0.0125 | — | Ex. |
| 30 | 0.09 | 0.001 | 1.33 | 0.08 | 0.26 | 0.0168 | 0.0085 | Cr: 1.0 | Ex. |

*Balance consisting of Fe and inevitable impurities

TABLE 2

| Steel sample No. | Chemical composition (mass %)* C | Si | Mn | P | S | N | O | Others | Remarks |
|---|---|---|---|---|---|---|---|---|---|
| 31 | 0.07 | 0.001 | 0.60 | 0.08 | 0.41 | 0.0117 | 0.0129 | Cr: 2.7 | Ex. |
| 32 | 0.06 | 0.001 | 1.27 | 0.08 | 0.42 | 0.0054 | 0.0179 | Al: 0.01 | Ex. |
| 33 | 0.07 | 0.001 | 1.21 | 0.08 | 0.38 | 0.0194 | 0.0225 | Sb: 0.008 | Ex. |
| 34 | 0.05 | 0.001 | 0.91 | 0.09 | 0.33 | 0.0143 | 0.0223 | Sn: 0.009 | Ex. |
| 35 | 0.12 | 0.002 | 1.51 | 0.09 | 0.36 | 0.0199 | 0.0122 | Cu: 0.8 | Ex. |
| 36 | 0.05 | 0.001 | 1.12 | 0.09 | 0.44 | 0.0138 | 0.0059 | Ni: 0.7 | Ex. |
| 37 | 0.03 | 0.001 | 1.14 | 0.07 | 0.28 | 0.0097 | 0.0150 | Mo: 0.9 | Ex. |
| 38 | 0.07 | 0.001 | 0.76 | 0.07 | 0.34 | 0.0065 | 0.0114 | Nb: 0.045 | Ex. |
| 39 | 0.05 | 0.001 | 1.61 | 0.08 | 0.27 | 0.0146 | 0.0223 | Ti: 0.047 | Ex. |
| 40 | 0.04 | 0.001 | 1.31 | 0.08 | 0.39 | 0.0050 | 0.0054 | V: 0.044 | Ex. |
| 41 | 0.05 | 0.001 | 0.72 | 0.07 | 0.37 | 0.0117 | 0.0082 | Zr: 0.044 | Ex. |
| 42 | 0.12 | 0.001 | 1.19 | 0.07 | 0.28 | 0.0152 | 0.0157 | W: 0.05 | Ex. |
| 43 | 0.07 | 0.001 | 1.15 | 0.07 | 0.35 | 0.0168 | 0.0232 | Ta: 0.047 | Ex. |
| 44 | 0.10 | 0.002 | 1.75 | 0.09 | 0.40 | 0.0054 | 0.0059 | Y: 0.044 | Ex. |
| 45 | 0.12 | 0.001 | 1.63 | 0.07 | 0.42 | 0.0022 | 0.0054 | Hf: 0.049 | Ex. |
| 46 | 0.05 | 0.001 | 1.34 | 0.09 | 0.40 | 0.0081 | 0.0151 | B: 0.05 | Ex. |
| 47 | 0.17 | 0.001 | 1.77 | 0.07 | 0.35 | 0.0198 | 0.0166 | — | Comp. Ex. |
| 48 | 0.10 | 0.001 | 2.24 | 0.07 | 0.26 | 0.0138 | 0.0088 | — | Comp. Ex. |
| 49 | 0.07 | 0.001 | 0.85 | 0.010 | 0.28 | 0.0034 | 0.0101 | — | Comp. Ex. |
| 50 | 0.09 | 0.001 | 1.41 | 0.07 | 0.15 | 0.0146 | 0.0181 | — | Comp. Ex. |
| 51 | 0.08 | 0.001 | 0.87 | 0.08 | 0.42 | 0.0312 | 0.0136 | — | Comp. Ex. |
| 52 | 0.03 | 0.001 | 0.86 | 0.09 | 0.44 | 0.0127 | 0.0041 | — | Comp. Ex. |
| 53 | 0.04 | 0.004 | 0.91 | 0.07 | 0.33 | 0.0089 | 0.0154 | — | Ex. |
| 54 | 0.03 | 0.007 | 0.95 | 0.07 | 0.34 | 0.0072 | 0.0156 | — | Ex. |
| 55 | 0.06 | 0.008 | 0.89 | 0.07 | 0.32 | 0.0145 | 0.0148 | — | Ex. |
| 56 | 0.04 | 0.002 | 0.98 | 0.08 | 0.31 | 0.0121 | 0.0153 | — | Ex. |
| 57 | 0.07 | 0.003 | 1.21 | 0.07 | 0.35 | 0.0098 | 0.0142 | Pb: 0.01 | Ex. |
| 58 | 0.06 | 0.002 | 1.11 | 0.07 | 0.37 | 0.0095 | 0.0159 | Pb: 0.03 | Ex. |
| 59 | 0.08 | 0.008 | 1.15 | 0.08 | 0.43 | 0.0096 | 0.0161 | Pb: 0.07 | Ex. |
| 60 | 0.04 | 0.003 | 1.21 | 0.09 | 0.44 | 0.0134 | 0.0146 | Pb: 0.09 | Ex. |
| 61 | 0.08 | 0.006 | 0.89 | 0.07 | 0.45 | 0.0087 | 0.0135 | Pb: 0.15 | Ex. |
| 62 | 0.05 | 0.011 | 0.97 | 0.07 | 0.36 | 0.0089 | 0.0094 | — | Comp. Ex. |
| 63 | 0.11 | 0.011 | 1.70 | 0.07 | 0.41 | 0.009 | 0.0115 | Pb: 0.15 | Comp. Ex. |

*Balance consisting of Fe and inevitable impurities

TABLE 3

| Test sample No. | Steel sample No. | Production conditions: Average cooling rate (° C./s) | Production conditions: Area reduction rate (%) | Measurement results: Average hardness $H_{ave}$ | Measurement results: Hardness standard deviation $H_{\sigma}$ | Measurement results: Aspect ratio | Remarks |
|---|---|---|---|---|---|---|---|
| 1 | 1 | 0.34 | 0 | 179 | 11 | 1.6 | Ex. |
| 2 | 2 | 0.48 | 0 | 154 | 10 | 2.4 | Ex. |
| 3 | 3 | 0.31 | 0 | 118 | 11 | 1.5 | Ex. |
| 4 | 4 | 0.43 | 0 | 148 | 5 | 2.3 | Ex. |
| 5 | 5 | 0.38 | 0 | 178 | 13 | 2.5 | Ex. |
| 6 | 6 | 0.54 | 0 | 122 | 5 | 2.1 | Ex. |
| 7 | 7 | 0.44 | 0 | 149 | 10 | 2.3 | Ex. |
| 8 | 8 | 0.49 | 0 | 159 | 7 | 2.5 | Ex. |
| 9 | 9 | 0.40 | 0 | 105 | 3 | 2.7 | Ex. |
| 10 | 10 | 0.60 | 0 | 114 | 6 | 1.8 | Ex. |
| 11 | 11 | 0.36 | 0 | 140 | 8 | 1.4 | Ex. |
| 12 | 12 | 0.46 | 0 | 146 | 13 | 2.0 | Ex. |
| 13 | 13 | 0.48 | 0 | 132 | 9 | 1.5 | Ex. |
| 14 | 14 | 0.37 | 0 | 125 | 6 | 2.3 | Ex. |
| 15 | 15 | 0.57 | 0 | 156 | 4 | 2.4 | Ex. |
| 16 | 16 | 0.50 | 0 | 180 | 11 | 1.6 | Ex. |
| 17 | 17 | 0.40 | 0 | 177 | 4 | 2.2 | Ex. |
| 18 | 18 | 0.38 | 0 | 129 | 7 | 2.7 | Ex. |
| 19 | 19 | 0.36 | 0 | 104 | 14 | 1.4 | Ex. |
| 20 | 20 | 0.59 | 0 | 165 | 8 | 2.3 | Ex. |
| 21 | 21 | 0.43 | 0 | 142 | 6 | 2.0 | Ex. |
| 22 | 22 | 0.54 | 0 | 102 | 8 | 2.3 | Ex. |
| 23 | 23 | 0.33 | 0 | 152 | 7 | 2.2 | Ex. |
| 24 | 24 | 0.46 | 0 | 123 | 12 | 1.4 | Ex. |
| 25 | 25 | 0.45 | 0 | 113 | 14 | 1.6 | Ex. |
| 26 | 26 | 0.53 | 0 | 103 | 6 | 2.1 | Ex. |
| 27 | 27 | 0.47 | 0 | 121 | 13 | 1.5 | Ex. |
| 28 | 28 | 0.54 | 0 | 116 | 9 | 2.1 | Ex. |
| 29 | 29 | 0.56 | 0 | 157 | 3 | 2.5 | Ex. |
| 30 | 30 | 0.56 | 0 | 109 | 6 | 1.8 | Ex. |
| 31 | 31 | 0.31 | 0 | 134 | 5 | 2.8 | Ex. |
| 32 | 32 | 0.57 | 0 | 152 | 12 | 1.3 | Ex. |
| 33 | 33 | 0.54 | 0 | 176 | 4 | 2.2 | Ex. |
| 34 | 34 | 0.57 | 0 | 117 | 6 | 2.3 | Ex. |
| 35 | 35 | 0.37 | 0 | 130 | 8 | 1.9 | Ex. |
| 36 | 36 | 0.37 | 0 | 125 | 6 | 2.7 | Ex. |
| 37 | 37 | 0.40 | 0 | 166 | 13 | 1.8 | Ex. |

TABLE 4

| Test sample No. | Steel sample No. | Production conditions: Average cooling rate (° C./s) | Production conditions: Area reduction rate (%) | Measurement results: Average hardness $H_{ave}$ | Measurement results: Hardness standard deviation $H_{\sigma}$ | Measurement results: Aspect ratio | Remarks |
|---|---|---|---|---|---|---|---|
| 38 | 38 | 0.40 | 0 | 172 | 5 | 1.6 | Ex. |
| 39 | 39 | 0.36 | 0 | 118 | 13 | 1.4 | Ex. |
| 40 | 40 | 0.57 | 0 | 161 | 9 | 1.5 | Ex. |
| 41 | 41 | 0.47 | 0 | 116 | 9 | 1.4 | Ex. |
| 42 | 42 | 0.44 | 0 | 129 | 7 | 2.6 | Ex. |
| 43 | 43 | 0.56 | 0 | 129 | 9 | 2.4 | Ex. |
| 44 | 44 | 0.51 | 0 | 134 | 13 | 2.0 | Ex. |
| 45 | 45 | 0.48 | 0 | 162 | 7 | 1.3 | Ex. |
| 46 | 46 | 0.43 | 0 | 126 | 5 | 2.0 | Ex. |
| 47 | 47 | 0.42 | 0 | 261 | 29 | 1.8 | Comp. Ex. |
| 48 | 48 | 0.34 | 0 | 215 | 26 | 1.7 | Comp. Ex. |
| 49 | 49 | 0.38 | 0 | 171 | 12 | 2.1 | Comp. Ex. |
| 50 | 50 | 0.54 | 0 | 167 | 13 | 1.6 | Comp. Ex. |
| 51 | 51 | 0.38 | 0 | 284 | 34 | 1.4 | Comp. Ex. |
| 52 | 52 | 0.31 | 0 | 167 | 7 | 2.6 | Comp. Ex. |
| 53 | 1 | 1.15 | 0 | 215 | 31 | 2.0 | Comp. Ex. |
| 54 | 2 | 1.35 | 0 | 253 | 24 | 1.3 | Comp. Ex. |
| 55 | 3 | 0.84 | 0 | 161 | 27 | 2.5 | Comp. Ex. |

TABLE 4-continued

| | | Production conditions | | Measurement results | | | |
|---|---|---|---|---|---|---|---|
| Test sample No. | Steel sample No. | Average cooling rate (° C./s) | Area reduction rate (%) | Average hardness $H_{ave}$ | Hardness standard deviation $H_{\sigma}$ | Aspect ratio | Remarks |
| 56 | 4 | 0.81 | 0 | 165 | 28 | 2.7 | Comp. Ex. |
| 57 | 5 | 0.88 | 0 | 165 | 27 | 2.0 | Comp. Ex. |
| 58 | 16 | 0.93 | 0 | 177 | 26 | 1.7 | Comp. Ex. |
| 59 | 17 | 0.79 | 0 | 160 | 30 | 1.8 | Comp. Ex. |
| 60 | 18 | 0.88 | 0 | 164 | 28 | 2.1 | Comp. Ex. |
| 61 | 19 | 0.86 | 0 | 167 | 28 | 2.6 | Comp. Ex. |
| 62 | 20 | 0.89 | 0 | 155 | 28 | 2.0 | Comp. Ex. |
| 63 | 21 | 0.82 | 0 | 164 | 30 | 1.5 | Comp. Ex. |
| 64 | 22 | 0.76 | 0 | 176 | 26 | 1.7 | Comp. Ex. |
| 65 | 53 | 0.48 | 0 | 160 | 6 | 2.5 | Ex. |
| 66 | 54 | 0.41 | 0 | 104 | 8 | 2.4 | Ex. |
| 67 | 55 | 0.59 | 0 | 116 | 5 | 2.4 | Ex. |
| 68 | 56 | 0.36 | 0 | 126 | 4 | 2.6 | Ex. |
| 69 | 57 | 0.44 | 0 | 122 | 11 | 2.5 | Ex. |
| 70 | 58 | 0.44 | 0 | 133 | 8 | 2.7 | Ex. |
| 71 | 59 | 0.37 | 0 | 127 | 4 | 1.9 | Ex. |
| 72 | 60 | 0.59 | 0 | 123 | 7 | 1.7 | Ex. |
| 73 | 61 | 0.51 | 0 | 171 | 11 | 1.7 | Ex. |
| 74 | 62 | 0.49 | 0 | 154 | 7 | 1.6 | Comp. Ex. |
| 75 | 63 | 0.54 | 0 | 187 | 31 | 2.2 | Comp. Ex. |

Next, for each of the obtained wire rods, a test of machinability by cutting was performed by outer periphery turning under various conditions, to evaluate the tool life, the surface roughness after cutting, and the chip treatability. In the test of machinability by cutting, the following five conditions were changed as parameters. In Tables 5 to 10, the number assigned to each condition is shown.

Insert Material

1: CVD-coated cemented carbide

2: PVD-coated cemented carbide

3: cermet (TiN)

4: ceramic ($Al_2O_3$)

Cutting Speed

1:50 m/min

2:200 m/min

Feed Rate

1:0.05 mm/rev

2:0.2 mm/rev

Cutting Depth

1:0.2 mm

2:1 mm

Lubricant

1: Water-insoluble cutting oil

2: Water-soluble cutting oil (emulsion, 10% dilution)

The tool life, the surface roughness after cutting, and the chip treatability were evaluated by the following methods.

(Tool life)

Figure 2:
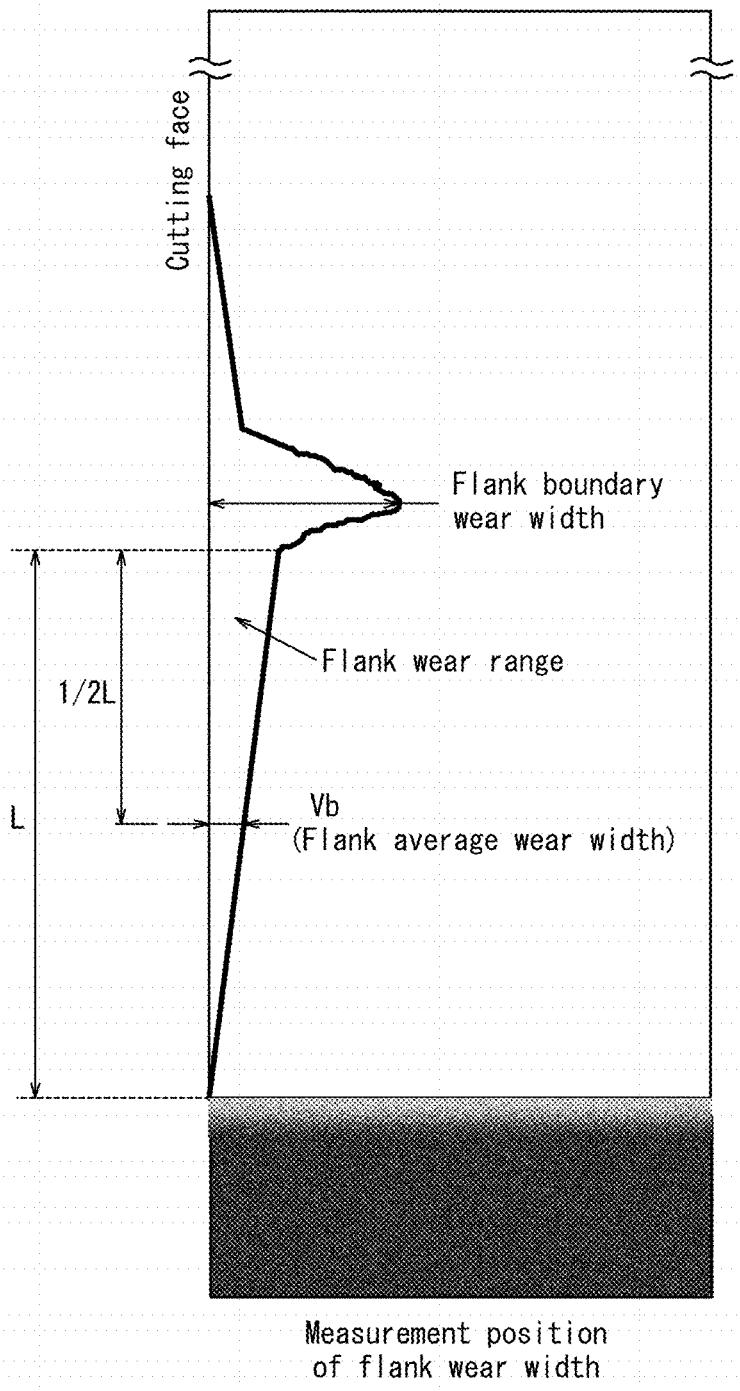
FIG. 2 is a schematic diagram illustrating a measurement position of the flank wear width of a tool.

The tool life was evaluated based on the flank average wear width Vb in the tool after cutting the length of 10 m of the wire rod. The flank average wear width mentioned here is not the wear width (flank boundary wear width) in a boundary wear portion as illustrated in FIG. 2, but the wear width in an average wear portion. The evaluation results are listed in Tables 5 and 6. The tool life is favorable if the flank average wear width Vb is 250 μm or less. In Table 5, "G" (good) indicates that the flank average wear width Vb was 250 μm or less, and "P" (poor) indicates that the flank average wear width Vb was more than 250 μm.

(Surface Roughness After Cutting)

The surface roughness after cutting was evaluated as follows: The wire rod was cut over a length of 1 m, and then the ten point average roughness Rz (JIS B 0601) was measured for a range of 10 mm in length immediately before the cutting end using a stylus-type roughness meter. The surface roughness after cutting was evaluated based on the measurement result. The reference length in the measurement was 4 mm. The evaluation results are listed in Tables 7 and 8. Production of parts with favorable quality is possible if the ten point average roughness Rz is 25 μm or less. In Tables 7 and 8, "G" (good) indicates that the ten point average roughness Rz was 25 μm or less, and "P" (poor) indicates that the ten point average roughness Rz was more than 25 μm.

(Chip Treatability)

The chip treatability was evaluated based on the chip form in a cutting zone from 0.9 m to 1 m when cutting the wire rod over a length of 1 m. The evaluation results are listed in Tables 9 and 10. The chip treatability is favorable if chips are divided finely. In Tables 9 and 10, "E" (excellent) indicates that the chip length was 1.5 mm or less, "G" (good) indicates that no chips of 1 roll or more were formed, and "P" (poor) indicates that chips of 1 roll or more were formed.

As can be understood from the results in Tables 5 to 10, Examples (Ex.) satisfying the conditions according to the present disclosure had superior machinability by cutting regardless of conditions such as the type of cutting tool and the type of lubricant used.

TABLE 5

| Tool life | | | | | | | | | | | | | | | | | | | | | | | | | |
|---|---|---|---|---|---|---|---|---|---|---|---|---|---|---|---|---|---|---|---|---|---|---|---|---|---|
| | Insert material | | | | | | | | | | | | | | | | | | | | | | | | |
| | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 |
| | Cutting speed | | | | | | | | | | | | | | | | | | | | | | | | |
| | 1 | 1 | 1 | 1 | 1 | 1 | 1 | 1 | 2 | 2 | 2 | 2 | 2 | 2 | 2 | 2 | 1 | 1 | 1 | 1 | 1 | 1 | 1 | 1 | 2 |
| | Feed rate | | | | | | | | | | | | | | | | | | | | | | | | |
| | 1 | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 1 |
| | Cutting depth | | | | | | | | | | | | | | | | | | | | | | | | |
| | 1 | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | 1 |
| | Lubricant | | | | | | | | | | | | | | | | | | | | | | | | |
| | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 |
| Test sample No. 1 | G | G | G | G | G | G | G | G | G | G | G | G | G | G | G | G | G | G | G | G | G | G | G | G | G |
| 2 | G | G | G | G | G | G | G | G | G | G | G | G | G | G | G | G | G | G | G | G | G | G | G | G | G |
| 3 | G | G | G | G | G | G | G | G | G | G | G | G | G | G | G | G | G | G | G | G | G | G | G | G | G |
| 4 | G | G | G | G | G | G | G | G | G | G | G | G | G | G | G | G | G | G | G | G | G | G | G | G | G |
| 5 | G | G | G | G | G | G | G | G | G | G | G | G | G | G | G | G | G | G | G | G | G | G | G | G | G |
| 6 | G | G | G | G | G | G | G | G | G | G | G | G | G | G | G | G | G | G | G | G | G | G | G | G | G |
| 7 | G | G | G | G | G | G | G | G | G | G | G | G | G | G | G | G | G | G | G | G | G | G | G | G | G |
| 8 | G | G | G | G | G | G | G | G | G | G | G | G | G | G | G | G | G | G | G | G | G | G | G | G | G |
| 9 | G | G | G | G | G | G | G | G | G | G | G | G | G | G | G | G | G | G | G | G | G | G | G | G | G |
| 10 | G | G | G | G | G | G | G | G | G | G | G | G | G | G | G | G | G | G | G | G | G | G | G | G | G |
| 11 | G | G | G | G | G | G | G | G | G | G | G | G | G | G | G | G | G | G | G | G | G | G | G | G | G |
| 12 | G | G | G | G | G | G | G | G | G | G | G | G | G | G | G | G | G | G | G | G | G | G | G | G | G |
| 13 | G | G | G | G | G | G | G | G | G | G | G | G | G | G | G | G | G | G | G | G | G | G | G | G | G |
| 14 | G | G | G | G | G | G | G | G | G | G | G | G | G | G | G | G | G | G | G | G | G | G | G | G | G |
| 15 | G | G | G | G | G | G | G | G | G | G | G | G | G | G | G | G | G | G | G | G | G | G | G | G | G |
| 16 | G | G | G | G | G | G | G | G | G | G | G | G | G | G | G | G | G | G | G | G | G | G | G | G | G |
| 17 | G | G | G | G | G | G | G | G | G | G | G | G | G | G | G | G | G | G | G | G | G | G | G | G | G |
| 18 | G | G | G | G | G | G | G | G | G | G | G | G | G | G | G | G | G | G | G | G | G | G | G | G | G |
| 19 | G | G | G | G | G | G | G | G | G | G | G | G | G | G | G | G | G | G | G | G | G | G | G | G | G |
| 20 | G | G | G | G | G | G | G | G | G | G | G | G | G | G | G | G | G | G | G | G | G | G | G | G | G |
| 21 | G | G | G | G | G | G | G | G | G | G | G | G | G | G | G | G | G | G | G | G | G | G | G | G | G |
| 22 | G | G | G | G | G | G | G | G | G | G | G | G | G | G | G | G | G | G | G | G | G | G | G | G | G |
| 23 | G | G | G | G | G | G | G | G | G | G | G | G | G | G | G | G | G | G | G | G | G | G | G | G | G |
| 24 | G | G | G | G | G | G | G | G | G | G | G | G | G | G | G | G | G | G | G | G | G | G | G | G | G |
| 25 | G | G | G | G | G | G | G | G | G | G | G | G | G | G | G | G | G | G | G | G | G | G | G | G | G |
| 26 | G | G | G | G | G | G | G | G | G | G | G | G | G | G | G | G | G | G | G | G | G | G | G | G | G |
| 27 | G | G | G | G | G | G | G | G | G | G | G | G | G | G | G | G | G | G | G | G | G | G | G | G | G |
| 28 | G | G | G | G | G | G | G | G | G | G | G | G | G | G | G | G | G | G | G | G | G | G | G | G | G |
| 29 | G | G | G | G | G | G | G | G | G | G | G | G | G | G | G | G | G | G | G | G | G | G | G | G | G |
| 30 | G | G | G | G | G | G | G | G | G | G | G | G | G | G | G | G | G | G | G | G | G | G | G | G | G |
| 31 | G | G | G | G | G | G | G | G | G | G | G | G | G | G | G | G | G | G | G | G | G | G | G | G | G |
| 32 | G | G | G | G | G | G | G | G | G | G | G | G | G | G | G | G | G | G | G | G | G | G | G | G | G |
| 33 | G | G | G | G | G | G | G | G | G | G | G | G | G | G | G | G | G | G | G | G | G | G | G | G | G |
| 34 | G | G | G | G | G | G | G | G | G | G | G | G | G | G | G | G | G | G | G | G | G | G | G | G | G |
| 35 | G | G | G | G | G | G | G | G | G | G | G | G | G | G | G | G | G | G | G | G | G | G | G | G | G |
| 36 | G | G | G | G | G | G | G | G | G | G | G | G | G | G | G | G | G | G | G | G | G | G | G | G | G |
| 37 | G | G | G | G | G | G | G | G | G | G | G | G | G | G | G | G | G | G | G | G | G | G | G | G | G |

| | | | | | | | | | | | | | | | | | | | | | | | | |
|---|---|---|---|---|---|---|---|---|---|---|---|---|---|---|---|---|---|---|---|---|---|---|---|---|---|
| | Insert material | | | | | | | | | | | | | | | | | | | | | | | | |
| | 2 | 2 | 2 | 2 | 2 | 2 | 2 | 3 | 3 | 3 | 3 | 3 | 3 | 3 | 3 | 3 | 3 | 3 | 3 | 3 | 3 | 3 | 3 | 3 | 3 |
| | Cutting speed | | | | | | | | | | | | | | | | | | | | | | | | |
| | 2 | 2 | 2 | 2 | 2 | 2 | 2 | 1 | 1 | 1 | 1 | 1 | 1 | 1 | 1 | 1 | 2 | 2 | 2 | 2 | 2 | 2 | 2 | 2 | 2 |
| | Feed rate | | | | | | | | | | | | | | | | | | | | | | | | |
| | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 2 | 2 |
| | Cutting depth | | | | | | | | | | | | | | | | | | | | | | | | |
| | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | 2 | 2 |
| | Lubricant | | | | | | | | | | | | | | | | | | | | | | | | |
| | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| Test sample No. 1 | G | G | G | G | G | G | G | G | G | G | G | G | G | G | G | G | G | G | G | G | G | G | G | G | G |
| 2 | G | G | G | G | G | G | G | G | G | G | G | G | G | G | G | G | G | G | G | G | G | G | G | G | G |
| 3 | G | G | G | G | G | G | G | G | G | G | G | G | G | G | G | G | G | G | G | G | G | G | G | G | G |
| 4 | G | G | G | G | G | G | G | G | G | G | G | G | G | G | G | G | G | G | G | G | G | G | G | G | G |
| 5 | G | G | G | G | G | G | G | G | G | G | G | G | G | G | G | G | G | G | G | G | G | G | G | G | G |
| 6 | G | G | G | G | G | G | G | G | G | G | G | G | G | G | G | G | G | G | G | G | G | G | G | G | G |
| 7 | G | G | G | G | G | G | G | G | G | G | G | G | G | G | G | G | G | G | G | G | G | G | G | G | G |
| 8 | G | G | G | G | G | G | G | G | G | G | G | G | G | G | G | G | G | G | G | G | G | G | G | G | G |

TABLE 5-continued

| | Tool life | | | | | | | | | | | | | | | | | | | | | |
|---|---|---|---|---|---|---|---|---|---|---|---|---|---|---|---|---|---|---|---|---|---|---|
| 9 | G | G | G | G | G | G | G | G | G | G | G | G | G | G | G | G | G | G | G | G | G | G |
| 10 | G | G | G | G | G | G | G | G | G | G | G | G | G | G | G | G | G | G | G | G | G | G |
| 11 | G | G | G | G | G | G | G | G | G | G | G | G | G | G | G | G | G | G | G | G | G | G |
| 12 | G | G | G | G | G | G | G | G | G | G | G | G | G | G | G | G | G | G | G | G | G | G |
| 13 | G | G | G | G | G | G | G | G | G | G | G | G | G | G | G | G | G | G | G | G | G | G |
| 14 | G | G | G | G | G | G | G | G | G | G | G | G | G | G | G | G | G | G | G | G | G | G |
| 15 | G | G | G | G | G | G | G | G | G | G | G | G | G | G | G | G | G | G | G | G | G | G |
| 16 | G | G | G | G | G | G | G | G | G | G | G | G | G | G | G | G | G | G | G | G | G | G |
| 17 | G | G | G | G | G | G | G | G | G | G | G | G | G | G | G | G | G | G | G | G | G | G |
| 18 | G | G | G | G | G | G | G | G | G | G | G | G | G | G | G | G | G | G | G | G | G | G |
| 19 | G | G | G | G | G | G | G | G | G | G | G | G | G | G | G | G | G | G | G | G | G | G |
| 20 | G | G | G | G | G | G | G | G | G | G | G | G | G | G | G | G | G | G | G | G | G | G |
| 21 | G | G | G | G | G | G | G | G | G | G | G | G | G | G | G | G | G | G | G | G | G | G |
| 22 | G | G | G | G | G | G | G | G | G | G | G | G | G | G | G | G | G | G | G | G | G | G |
| 23 | G | G | G | G | G | G | G | G | G | G | G | G | G | G | G | G | G | G | G | G | G | G |
| 24 | G | G | G | G | G | G | G | G | G | G | G | G | G | G | G | G | G | G | G | G | G | G |
| 25 | G | G | G | G | G | G | G | G | G | G | G | G | G | G | G | G | G | G | G | G | G | G |
| 26 | G | G | G | G | G | G | G | G | G | G | G | G | G | G | G | G | G | G | G | G | G | G |
| 27 | G | G | G | G | G | G | G | G | G | G | G | G | G | G | G | G | G | G | G | G | G | G |
| 28 | G | G | G | G | G | G | G | G | G | G | G | G | G | G | G | G | G | G | G | G | G | G |
| 29 | G | G | G | G | G | G | G | G | G | G | G | G | G | G | G | G | G | G | G | G | G | G |
| 30 | G | G | G | G | G | G | G | G | G | G | G | G | G | G | G | G | G | G | G | G | G | G |
| 31 | G | G | G | G | G | G | G | G | G | G | G | G | G | G | G | G | G | G | G | G | G | G |
| 32 | G | G | G | G | G | G | G | G | G | G | G | G | G | G | G | G | G | G | G | G | G | G |
| 33 | G | G | G | G | G | G | G | G | G | G | G | G | G | G | G | G | G | G | G | G | G | G |
| 34 | G | G | G | G | G | G | G | G | G | G | G | G | G | G | G | G | G | G | G | G | G | G |
| 35 | G | G | G | G | G | G | G | G | G | G | G | G | G | G | G | G | G | G | G | G | G | G |
| 36 | G | G | G | G | G | G | G | G | G | G | G | G | G | G | G | G | G | G | G | G | G | G |
| 37 | G | G | G | G | G | G | G | G | G | G | G | G | G | G | G | G | G | G | G | G | G | G |

| | | Insert material | | | | | | | | | | | | | | | | |
|---|---|---|---|---|---|---|---|---|---|---|---|---|---|---|---|---|---|---|
| | | 4 | 4 | 4 | 4 | 4 | 4 | 4 | 4 | 4 | 4 | 4 | 4 | 4 | 4 | 4 | 4 | |
| | | Cutting speed | | | | | | | | | | | | | | | | |
| | | 1 | 1 | 1 | 1 | 1 | 1 | 1 | 1 | 2 | 2 | 2 | 2 | 2 | 2 | 2 | 2 | |
| | | Feed rate | | | | | | | | | | | | | | | | |
| | | 1 | 1 | 1 | 1 | 2 | 2 | 2 | 2 | 1 | 1 | 1 | 1 | 2 | 2 | 2 | 2 | |
| | | Cutting depth | | | | | | | | | | | | | | | | |
| | | 1 | 1 | 2 | 2 | 1 | 1 | 2 | 2 | 1 | 1 | 2 | 2 | 1 | 1 | 2 | 2 | |
| | | Lubricant | | | | | | | | | | | | | | | | |
| | | 1 | 2 | 1 | 2 | 1 | 2 | 1 | 2 | 1 | 2 | 1 | 2 | 1 | 2 | 1 | 2 | Remarks |
| Test sample No. | 1 | G | G | G | G | G | G | G | G | G | G | G | G | G | G | G | G | Ex. |
| | 2 | G | G | G | G | G | G | G | G | G | G | G | G | G | G | G | G | Ex. |
| | 3 | G | G | G | G | G | G | G | G | G | G | G | G | G | G | G | G | Ex. |
| | 4 | G | G | G | G | G | G | G | G | G | G | G | G | G | G | G | G | Ex. |
| | 5 | G | G | G | G | G | G | G | G | G | G | G | G | G | G | G | G | Ex. |
| | 6 | G | G | G | G | G | G | G | G | G | G | G | G | G | G | G | G | Ex. |
| | 7 | G | G | G | G | G | G | G | G | G | G | G | G | G | G | G | G | Ex. |
| | 8 | G | G | G | G | G | G | G | G | G | G | G | G | G | G | G | G | Ex. |
| | 9 | G | G | G | G | G | G | G | G | G | G | G | G | G | G | G | G | Ex. |
| | 10 | G | G | G | G | G | G | G | G | G | G | G | G | G | G | G | G | Ex. |
| | 11 | G | G | G | G | G | G | G | G | G | G | G | G | G | G | G | G | Ex. |
| | 12 | G | G | G | G | G | G | G | G | G | G | G | G | G | G | G | G | Ex. |
| | 13 | G | G | G | G | G | G | G | G | G | G | G | G | G | G | G | G | Ex. |
| | 14 | G | G | G | G | G | G | G | G | G | G | G | G | G | G | G | G | Ex. |
| | 15 | G | G | G | G | G | G | G | G | G | G | G | G | G | G | G | G | Ex. |
| | 16 | G | G | G | G | G | G | G | G | G | G | G | G | G | G | G | G | Ex. |
| | 17 | G | G | G | G | G | G | G | G | G | G | G | G | G | G | G | G | Ex. |
| | 18 | G | G | G | G | G | G | G | G | G | G | G | G | G | G | G | G | Ex. |
| | 19 | G | G | G | G | G | G | G | G | G | G | G | G | G | G | G | G | Ex. |
| | 20 | G | G | G | G | G | G | G | G | G | G | G | G | G | G | G | G | Ex. |
| | 21 | G | G | G | G | G | G | G | G | G | G | G | G | G | G | G | G | Ex. |
| | 22 | G | G | G | G | G | G | G | G | G | G | G | G | G | G | G | G | Ex. |
| | 23 | G | G | G | G | G | G | G | G | G | G | G | G | G | G | G | G | Ex. |
| | 24 | G | G | G | G | G | G | G | G | G | G | G | G | G | G | G | G | Ex. |
| | 25 | G | G | G | G | G | G | G | G | G | G | G | G | G | G | G | G | Ex. |
| | 26 | G | G | G | G | G | G | G | G | G | G | G | G | G | G | G | G | Ex. |
| | 27 | G | G | G | G | G | G | G | G | G | G | G | G | G | G | G | G | Ex. |
| | 28 | G | G | G | G | G | G | G | G | G | G | G | G | G | G | G | G | Ex. |
| | 29 | G | G | G | G | G | G | G | G | G | G | G | G | G | G | G | G | Ex. |
| | 30 | G | G | G | G | G | G | G | G | G | G | G | G | G | G | G | G | Ex. |
| | 31 | G | G | G | G | G | G | G | G | G | G | G | G | G | G | G | G | Ex. |
| | 32 | G | G | G | G | G | G | G | G | G | G | G | G | G | G | G | G | Ex. |

TABLE 5-continued

| | Tool life | | | | | | | | | | | | | | | | |
|---|---|---|---|---|---|---|---|---|---|---|---|---|---|---|---|---|---|
| 33 | G | G | G | G | G | G | G | G | G | G | G | G | G | G | G | G | Ex. |
| 34 | G | G | G | G | G | G | G | G | G | G | G | G | G | G | G | G | Ex. |
| 35 | G | G | G | G | G | G | G | G | G | G | G | G | G | G | G | G | Ex. |
| 36 | G | G | G | G | G | G | G | G | G | G | G | G | G | G | G | G | Ex. |
| 37 | G | G | G | G | G | G | G | G | G | G | G | G | G | G | G | G | Ex. |

* G: Good, P: Poor

TABLE 6

| | | Tool life | | | | | | | | | | | | | | | | | | | | | | | | |
|---|---|---|---|---|---|---|---|---|---|---|---|---|---|---|---|---|---|---|---|---|---|---|---|---|---|---|
| | | Insert material | | | | | | | | | | | | | | | | | | | | | | | | |
| | | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 |
| | | Cutting speed | | | | | | | | | | | | | | | | | | | | | | | | |
| | | 1 | 1 | 1 | 1 | 1 | 1 | 1 | 1 | 2 | 2 | 2 | 2 | 2 | 2 | 2 | 2 | 1 | 1 | 1 | 1 | 1 | 1 | 1 | 1 | 2 |
| | | Feed rate | | | | | | | | | | | | | | | | | | | | | | | | |
| | | 1 | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 1 |
| | | Cutting depth | | | | | | | | | | | | | | | | | | | | | | | | |
| | | 1 | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | 1 |
| | | Lubricant | | | | | | | | | | | | | | | | | | | | | | | | |
| | | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 |
| Test sample No. | 38 | G | G | G | G | G | G | G | G | G | G | G | G | G | G | G | G | G | G | G | G | G | G | G | G | G |
| | 39 | G | G | G | G | G | G | G | G | G | G | G | G | G | G | G | G | G | G | G | G | G | G | G | G | G |
| | 40 | G | G | G | G | G | G | G | G | G | G | G | G | G | G | G | G | G | G | G | G | G | G | G | G | G |
| | 41 | G | G | G | G | G | G | G | G | G | G | G | G | G | G | G | G | G | G | G | G | G | G | G | G | G |
| | 42 | G | G | G | G | G | G | G | G | G | G | G | G | G | G | G | G | G | G | G | G | G | G | G | G | G |
| | 43 | G | G | G | G | G | G | G | G | G | G | G | G | G | G | G | G | G | G | G | G | G | G | G | G | G |
| | 44 | G | G | G | G | G | G | G | G | G | G | G | G | G | G | G | G | G | G | G | G | G | G | G | G | G |
| | 45 | G | G | G | G | G | G | G | G | G | G | G | G | G | G | G | G | G | G | G | G | G | G | G | G | G |
| | 46 | G | G | G | G | G | G | G | G | G | G | G | G | G | G | G | G | G | G | G | G | G | G | G | G | G |
| | 47 | G | G | P | P | G | G | P | P | G | G | P | G | G | G | P | G | G | G | P | P | G | G | P | G | G |
| | 48 | P | G | G | P | G | G | P | G | G | G | G | P | G | G | P | G | G | G | P | G | P | G | P | P | G |
| | 49 | G | G | G | P | G | G | P | P | G | G | G | P | G | G | P | P | G | G | P | G | G | G | G | P | G |
| | 50 | P | P | P | P | P | P | P | P | P | P | G | P | P | P | P | P | P | P | P | P | P | P | P | G | P |
| | 51 | P | G | G | G | P | G | G | G | G | P | G | P | G | G | G | G | G | G | P | G | P | G | P | P | G |
| | 52 | P | P | G | P | P | G | P | P | G | P | G | P | P | P | P | P | P | P | G | P | G | P | P | G | P |
| | 53 | G | G | G | G | P | G | G | G | G | G | G | G | G | P | G | G | G | G | G | G | G | G | G | G | G |
| | 54 | G | G | G | G | G | G | G | G | G | G | P | G | G | G | G | G | G | G | G | G | G | G | G | G | G |
| | 55 | G | G | G | G | G | G | G | G | G | G | G | G | G | G | G | G | G | G | G | G | G | G | G | P | G |
| | 56 | G | G | G | G | G | G | P | G | G | G | G | G | G | G | G | G | G | G | G | G | G | G | G | G | G |
| | 57 | G | G | G | G | G | G | G | G | G | G | G | G | G | G | G | G | G | G | G | G | G | G | G | G | G |
| | 58 | P | G | G | G | G | G | G | G | G | G | G | G | G | G | G | G | G | G | G | G | G | G | G | G | G |
| | 59 | G | G | G | G | G | G | G | G | G | G | G | G | P | G | G | G | G | G | G | G | G | G | G | G | G |
| | 60 | G | G | G | G | G | G | G | G | G | G | G | G | G | G | G | G | G | G | G | G | G | G | G | G | G |
| | 61 | G | G | G | G | P | G | G | G | G | G | G | G | G | G | G | G | G | G | G | G | G | G | G | G | G |
| | 62 | G | G | G | G | G | G | G | G | G | G | G | G | G | P | G | G | G | G | G | G | G | G | G | G | G |
| | 63 | G | G | G | G | G | G | G | G | G | G | G | G | G | G | G | G | G | P | G | G | G | G | P | G | G |
| | 64 | G | G | G | G | G | G | G | G | G | G | P | G | G | G | G | G | G | G | G | G | G | G | G | G | G |
| | 65 | G | G | G | G | G | G | G | G | G | G | G | G | G | G | G | G | G | G | G | G | G | G | G | G | G |
| | 66 | G | G | G | G | G | G | G | G | G | G | G | G | G | G | G | G | G | G | G | G | G | G | G | G | G |
| | 67 | G | G | G | G | G | G | G | G | G | G | G | G | G | G | G | G | G | G | G | G | G | G | G | G | G |
| | 68 | G | G | G | G | G | G | G | G | G | G | G | G | G | G | G | G | G | G | G | G | G | G | G | G | G |
| | 69 | G | G | G | G | G | G | G | G | G | G | G | G | G | G | G | G | G | G | G | G | G | G | G | G | G |
| | 70 | G | G | G | G | G | G | G | G | G | G | G | G | G | G | G | G | G | G | G | G | G | G | G | G | G |
| | 71 | G | G | G | G | G | G | G | G | G | G | G | G | G | G | G | G | G | G | G | G | G | G | G | G | G |
| | 72 | G | G | G | G | G | G | G | G | G | G | G | G | G | G | G | G | G | G | G | G | G | G | G | G | G |
| | 73 | G | G | G | G | G | G | G | G | G | G | G | G | G | G | G | G | G | G | G | G | G | G | G | G | G |
| | 74 | G | G | G | G | G | P | G | G | G | G | G | G | G | G | G | G | G | P | G | G | G | G | G | G | P |
| | 75 | G | G | G | G | G | G | G | G | G | G | G | G | G | P | G | G | G | G | G | G | G | G | G | G | G |

TABLE 6-continued

| | | Tool life | | | | | | | | | | | | | | | | | | | | | | |
|---|---|---|---|---|---|---|---|---|---|---|---|---|---|---|---|---|---|---|---|---|---|---|---|---|
| | | Insert material | | | | | | | | | | | | | | | | | | | | | | |
| | | 2 | 2 | 2 | 2 | 2 | 2 | 2 | 3 | 3 | 3 | 3 | 3 | 3 | 3 | 3 | 3 | 3 | 3 | 3 | 3 | 3 | 3 | 3 |
| | | Cutting speed | | | | | | | | | | | | | | | | | | | | | | |
| | | 2 | 2 | 2 | 2 | 2 | 2 | 2 | 1 | 1 | 1 | 1 | 1 | 1 | 1 | 1 | 2 | 2 | 2 | 2 | 2 | 2 | 2 | 2 |
| | | Feed rate | | | | | | | | | | | | | | | | | | | | | | |
| | | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 |
| | | Cutting depth | | | | | | | | | | | | | | | | | | | | | | |
| | | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 |
| | | Lubricant | | | | | | | | | | | | | | | | | | | | | | |
| | | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| Test sample No. | 38 | G | G | G | G | G | G | G | G | G | G | G | G | G | G | G | G | G | G | G | G | G | G | G |
| | 39 | G | G | G | G | G | G | G | G | G | G | G | G | G | G | G | G | G | G | G | G | G | G | G |
| | 40 | G | G | G | G | G | G | G | G | G | G | G | G | G | G | G | G | G | G | G | G | G | G | G |
| | 41 | G | G | G | G | G | G | G | G | G | G | G | G | G | G | G | G | G | G | G | G | G | G | G |
| | 42 | G | G | G | G | G | G | G | G | G | G | G | G | G | G | G | G | G | G | G | G | G | G | G |
| | 43 | G | G | G | G | G | G | G | G | G | G | G | G | G | G | G | G | G | G | G | G | G | G | G |
| | 44 | G | G | G | G | G | G | G | G | G | G | G | G | G | G | G | G | G | G | G | G | G | G | G |
| | 45 | G | G | G | G | G | G | G | G | G | G | G | G | G | G | G | G | G | G | G | G | G | G | G |
| | 46 | G | G | G | G | G | G | G | G | G | G | G | G | G | G | G | G | G | G | G | G | G | G | G |
| | 47 | G | P | G | P | G | P | G | G | G | G | G | G | P | G | G | G | G | G | G | G | G | P | P |
| | 48 | G | P | G | G | G | G | G | G | G | P | G | G | G | G | G | G | G | G | G | G | G | P | P |
| | 49 | G | P | G | G | G | G | G | G | G | P | G | G | G | G | G | G | G | G | G | G | G | P | G |
| | 50 | P | P | P | P | P | P | P | P | P | P | P | G | P | P | P | G | P | P | P | P | P | P | P |
| | 51 | G | P | G | G | G | G | G | G | G | P | G | G | G | G | G | G | P | G | G | G | G | P | G |
| | 52 | P | P | P | G | P | P | P | P | G | P | P | G | P | P | P | G | P | P | G | P | P | P | P |
| | 53 | G | G | G | G | P | G | G | G | G | G | G | G | G | G | G | G | G | G | G | G | G | G | P |
| | 54 | G | G | G | G | P | G | G | G | G | G | G | G | G | G | G | G | G | G | G | G | G | G | G |
| | 55 | G | G | G | G | G | G | G | G | G | G | G | G | G | G | G | G | G | P | G | G | G | G | G |
| | 56 | G | G | G | G | G | G | G | G | G | G | G | G | G | G | G | G | G | P | G | G | G | G | G |
| | 57 | G | P | G | G | G | G | G | G | G | G | G | G | G | G | G | G | G | G | G | G | G | G | P |
| | 58 | G | G | G | G | G | G | G | G | G | G | G | G | G | G | P | G | G | G | G | G | G | G | G |
| | 59 | G | P | G | G | G | G | G | G | G | G | G | G | G | G | G | G | G | G | G | G | G | G | G |
| | 60 | G | G | G | G | G | G | P | G | G | G | G | G | G | G | G | G | G | G | G | P | G | G | G |
| | 61 | G | G | G | G | G | G | G | G | G | G | G | G | G | G | G | G | G | G | G | G | G | G | G |
| | 62 | G | G | G | G | G | G | P | G | G | G | G | G | G | G | G | G | G | G | G | G | G | G | G |
| | 63 | G | G | G | G | G | G | G | G | G | G | G | G | G | G | G | G | G | G | G | G | G | G | G |
| | 64 | G | G | P | G | G | G | G | G | G | G | G | G | G | G | G | G | G | G | G | G | P | G | G |
| | 65 | G | G | G | G | G | G | G | G | G | G | G | G | G | G | G | G | G | G | G | G | G | G | G |
| | 66 | G | G | G | G | G | G | G | G | G | G | G | G | G | G | G | G | G | G | G | G | G | G | G |
| | 67 | G | G | G | G | G | G | G | G | G | G | G | G | G | G | G | G | G | G | G | G | G | G | G |
| | 68 | G | G | G | G | G | G | G | G | G | G | G | G | G | G | G | G | G | G | G | G | G | G | G |
| | 69 | G | G | G | G | G | G | G | G | G | G | G | G | G | G | G | G | G | G | G | G | G | G | G |
| | 70 | G | G | G | G | G | G | G | G | G | G | G | G | G | G | G | G | G | G | G | G | G | G | G |
| | 71 | G | G | G | G | G | G | G | G | G | G | G | G | G | G | G | G | G | G | G | G | G | G | G |
| | 72 | G | G | G | G | G | G | G | G | G | G | G | G | G | G | G | G | G | G | G | G | G | G | G |
| | 73 | G | G | G | G | G | G | G | G | G | G | G | G | G | G | G | G | G | G | G | G | G | G | G |
| | 74 | G | G | G | G | G | G | G | G | G | P | G | G | G | G | G | G | G | G | G | G | P | G | G |
| | 75 | G | G | G | G | G | G | G | G | G | G | G | G | G | G | G | G | G | G | G | P | G | G | G |

| | | Insert material | | | | | | | | | | | | | | | | |
|---|---|---|---|---|---|---|---|---|---|---|---|---|---|---|---|---|---|---|
| | | 4 | 4 | 4 | 4 | 4 | 4 | 4 | 4 | 4 | 4 | 4 | 4 | 4 | 4 | 4 | 4 | |
| | | Cutting speed | | | | | | | | | | | | | | | | |
| | | 1 | 1 | 1 | 1 | 1 | 1 | 1 | 1 | 2 | 2 | 2 | 2 | 2 | 2 | 2 | 2 | |
| | | Feed rate | | | | | | | | | | | | | | | | |
| | | 1 | 1 | 1 | 1 | 2 | 2 | 2 | 2 | 1 | 1 | 1 | 1 | 2 | 2 | 2 | 2 | |
| | | Cutting depth | | | | | | | | | | | | | | | | |
| | | 1 | 1 | 2 | 2 | 1 | 1 | 2 | 2 | 1 | 1 | 2 | 2 | 1 | 1 | 2 | 2 | |
| | | Lubricant | | | | | | | | | | | | | | | | |
| | | 1 | 2 | 1 | 2 | 1 | 2 | 1 | 2 | 1 | 2 | 1 | 2 | 1 | 2 | 1 | 2 | Remarks |
| Test sample No. | 38 | | | | | | | | | | | | | | | | | Ex. |
| | 39 | G | G | G | G | G | G | G | G | G | G | G | G | G | G | G | G | Ex. |
| | 40 | G | G | G | G | G | G | G | G | G | G | G | G | G | G | G | G | Ex. |
| | 41 | G | G | G | G | G | G | G | G | G | G | G | G | G | G | G | G | Ex. |
| | 42 | G | G | G | G | G | G | G | G | G | G | G | G | G | G | G | G | Ex. |
| | 43 | G | G | G | G | G | G | G | G | G | G | G | G | G | G | G | G | Ex. |
| | 44 | G | G | G | G | G | G | G | G | G | G | G | G | G | G | G | G | Ex. |

TABLE 6-continued

| | Tool life | | | | | | | | | | | | | | | | |
|---|---|---|---|---|---|---|---|---|---|---|---|---|---|---|---|---|---|
| 45 | G | G | G | G | G | G | G | G | G | G | G | G | G | G | G | G | Ex. |
| 46 | G | G | G | G | G | G | G | G | G | G | G | G | G | G | G | G | Ex. |
| 47 | G | P | G | G | P | G | G | G | G | G | P | G | G | G | P | G | Comp. Ex. |
| 48 | G | G | G | P | G | G | P | P | G | G | G | G | G | G | P | G | Comp. Ex. |
| 49 | G | G | G | P | G | G | G | P | G | G | G | G | G | G | P | G | Comp. Ex. |
| 50 | G | P | P | P | P | P | P | P | P | P | P | P | P | P | P | P | Comp. Ex. |
| 51 | G | G | G | P | G | G | P | G | G | G | G | G | P | G | G | G | Comp. Ex. |
| 52 | G | P | G | G | P | P | P | P | P | P | P | P | P | P | P | P | Comp. Ex. |
| 53 | G | G | G | G | G | G | G | P | G | G | G | G | G | G | G | G | Comp. Ex. |
| 54 | G | G | G | G | P | G | G | G | G | G | G | G | G | G | G | G | Comp. Ex. |
| 55 | G | P | G | G | G | G | G | G | G | G | G | G | G | G | G | G | Comp. Ex. |
| 56 | G | G | G | G | G | G | G | G | G | G | G | G | G | G | G | P | Comp. Ex. |
| 57 | G | G | G | G | G | G | G | G | G | G | G | G | G | G | G | G | Comp. Ex. |
| 58 | G | G | G | G | G | G | G | G | G | G | G | G | G | G | G | G | Comp. Ex. |
| 59 | G | G | G | G | G | G | G | P | G | G | G | G | G | G | G | G | Comp. Ex. |
| 60 | G | G | G | G | G | G | G | G | G | G | G | G | G | G | G | G | Comp. Ex. |
| 61 | G | G | G | G | G | G | G | G | G | P | G | G | G | G | G | G | Comp. Ex. |
| 62 | G | G | G | P | G | G | G | G | G | G | G | G | G | G | G | G | Comp. Ex. |
| 63 | G | G | G | G | G | G | G | G | G | G | G | G | G | G | G | P | Comp. Ex. |
| 64 | G | G | G | G | G | G | G | G | G | G | G | G | G | G | G | G | Comp. Ex. |
| 65 | G | G | G | G | G | G | G | G | G | G | G | G | G | G | G | G | Ex. |
| 66 | G | G | G | G | G | G | G | G | G | G | G | G | G | G | G | G | Ex. |
| 67 | G | G | G | G | G | G | G | G | G | G | G | G | G | G | G | G | Ex. |
| 68 | G | G | G | G | G | G | G | G | G | G | G | G | G | G | G | G | Ex. |
| 69 | G | G | G | G | G | G | G | G | G | G | G | G | G | G | G | G | Ex. |
| 70 | G | G | G | G | G | G | G | G | G | G | G | G | G | G | G | G | Ex. |
| 71 | G | G | G | G | G | G | G | G | G | G | G | G | G | G | G | G | Ex. |
| 72 | G | G | G | G | G | G | G | G | G | G | G | G | G | G | G | G | Ex. |
| 73 | G | G | G | G | G | G | G | G | G | G | G | G | G | G | G | G | Ex. |
| 74 | G | G | G | G | G | G | G | G | G | G | G | P | G | G | G | G | Comp. Ex. |
| 75 | G | G | G | G | G | G | G | G | G | G | G | G | G | G | G | G | Comp. Ex. |

* G: Good, P: Poor

TABLE 7

| | Surface roughness after cutting | | | | | | | | | | | | | | | | | | | | | | | | |
|---|---|---|---|---|---|---|---|---|---|---|---|---|---|---|---|---|---|---|---|---|---|---|---|---|---|
| | Insert material | | | | | | | | | | | | | | | | | | | | | | | | |
| | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 |
| | Cutting speed | | | | | | | | | | | | | | | | | | | | | | | | |
| | 1 | 1 | 1 | 1 | 1 | 1 | 1 | 1 | 2 | 2 | 2 | 2 | 2 | 2 | 2 | 2 | 1 | 1 | 1 | 1 | 1 | 1 | 1 | 1 | 2 |
| | Feed rate | | | | | | | | | | | | | | | | | | | | | | | | |
| | 1 | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 1 |
| | Cutting depth | | | | | | | | | | | | | | | | | | | | | | | | |
| | 1 | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | 1 |
| | Lubricant | | | | | | | | | | | | | | | | | | | | | | | | |
| | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 |
| Test. sample No. 1 | G | G | G | G | G | G | G | G | G | G | G | G | G | G | G | G | G | G | G | G | G | G | G | G | G |
| 2 | G | G | G | G | G | G | G | G | G | G | G | G | G | G | G | G | G | G | G | G | G | G | G | G | G |
| 3 | G | G | G | G | G | G | G | G | G | G | G | G | G | G | G | G | G | G | G | G | G | G | G | G | G |
| 4 | G | G | G | G | G | G | G | G | G | G | G | G | G | G | G | G | G | G | G | G | G | G | G | G | G |
| 5 | G | G | G | G | G | G | G | G | G | G | G | G | G | G | G | G | G | G | G | G | G | G | G | G | G |
| 6 | G | G | G | G | G | G | G | G | G | G | G | G | G | G | G | G | G | G | G | G | G | G | G | G | G |
| 7 | G | G | G | G | G | G | G | G | G | G | G | G | G | G | G | G | G | G | G | G | G | G | G | G | G |
| 8 | G | G | G | G | G | G | G | G | G | G | G | G | G | G | G | G | G | G | G | G | G | G | G | G | G |
| 9 | G | G | G | G | G | G | G | G | G | G | G | G | G | G | G | G | G | G | G | G | G | G | G | G | G |
| 10 | G | G | G | G | G | G | G | G | G | G | G | G | G | G | G | G | G | G | G | G | G | G | G | G | G |
| 11 | G | G | G | G | G | G | G | G | G | G | G | G | G | G | G | G | G | G | G | G | G | G | G | G | G |
| 12 | G | G | G | G | G | G | G | G | G | G | G | G | G | G | G | G | G | G | G | G | G | G | G | G | G |
| 13 | G | G | G | G | G | G | G | G | G | G | G | G | G | G | G | G | G | G | G | G | G | G | G | G | G |
| 14 | G | G | G | G | G | G | G | G | G | G | G | G | G | G | G | G | G | G | G | G | G | G | G | G | G |
| 15 | G | G | G | G | G | G | G | G | G | G | G | G | G | G | G | G | G | G | G | G | G | G | G | G | G |
| 16 | G | G | G | G | G | G | G | G | G | G | G | G | G | G | G | G | G | G | G | G | G | G | G | G | G |
| 17 | G | G | G | G | G | G | G | G | G | G | G | G | G | G | G | G | G | G | G | G | G | G | G | G | G |
| 18 | G | G | G | G | G | G | G | G | G | G | G | G | G | G | G | G | G | G | G | G | G | G | G | G | G |
| 19 | G | G | G | G | G | G | G | G | G | G | G | G | G | G | G | G | G | G | G | G | G | G | G | G | G |

TABLE 7-continued

| | Surface roughness after cutting | | | | | | | | | | | | | | | | | | | | | | | |
|---|---|---|---|---|---|---|---|---|---|---|---|---|---|---|---|---|---|---|---|---|---|---|---|---|
| 20 | G | G | G | G | G | G | G | G | G | G | G | G | G | G | G | G | G | G | G | G | G | G | G | G |
| 21 | G | G | G | G | G | G | G | G | G | G | G | G | G | G | G | G | G | G | G | G | G | G | G | G |
| 22 | G | G | G | G | G | G | G | G | G | G | G | G | G | G | G | G | G | G | G | G | G | G | G | G |
| 23 | G | G | G | G | G | G | G | G | G | G | G | G | G | G | G | G | G | G | G | G | G | G | G | G |
| 24 | G | G | G | G | G | G | G | G | G | G | G | G | G | G | G | G | G | G | G | G | G | G | G | G |
| 25 | G | G | G | G | G | G | G | G | G | G | G | G | G | G | G | G | G | G | G | G | G | G | G | G |
| 26 | G | G | G | G | G | G | G | G | G | G | G | G | G | G | G | G | G | G | G | G | G | G | G | G |
| 27 | G | G | G | G | G | G | G | G | G | G | G | G | G | G | G | G | G | G | G | G | G | G | G | G |
| 28 | G | G | G | G | G | G | G | G | G | G | G | G | G | G | G | G | G | G | G | G | G | G | G | G |
| 29 | G | G | G | G | G | G | G | G | G | G | G | G | G | G | G | G | G | G | G | G | G | G | G | G |
| 30 | G | G | G | G | G | G | G | G | G | G | G | G | G | G | G | G | G | G | G | G | G | G | G | G |
| 31 | G | G | G | G | G | G | G | G | G | G | G | G | G | G | G | G | G | G | G | G | G | G | G | G |
| 32 | G | G | G | G | G | G | G | G | G | G | G | G | G | G | G | G | G | G | G | G | G | G | G | G |
| 33 | G | G | G | G | G | G | G | G | G | G | G | G | G | G | G | G | G | G | G | G | G | G | G | G |
| 34 | G | G | G | G | G | G | G | G | G | G | G | G | G | G | G | G | G | G | G | G | G | G | G | G |
| 35 | G | G | G | G | G | G | G | G | G | G | G | G | G | G | G | G | G | G | G | G | G | G | G | G |
| 36 | G | G | G | G | G | G | G | G | G | G | G | G | G | G | G | G | G | G | G | G | G | G | G | G |
| 37 | G | G | G | G | G | G | G | G | G | G | G | G | G | G | G | G | G | G | G | G | G | G | G | G |

| | | | | | | | | | | | | | | | | | | | | |
|---|---|---|---|---|---|---|---|---|---|---|---|---|---|---|---|---|---|---|---|---|
| Insert material | 2 | 2 | 2 | 2 | 2 | 2 | 2 | 3 | 3 | 3 | 3 | 3 | 3 | 3 | 3 | 3 | 3 | 3 | 3 | 3 |
| Cutting speed | 2 | 2 | 2 | 2 | 2 | 2 | 2 | 1 | 1 | 1 | 1 | 1 | 1 | 1 | 1 | 2 | 2 | 2 | 2 | 2 |
| Feed rate | 1 | 1 | 1 | 2 | 2 | 2 | 2 | 1 | 1 | 1 | 1 | 2 | 2 | 2 | 2 | 1 | 1 | 1 | 1 | 2 |
| Cutting depth | 1 | 2 | 2 | 1 | 1 | 2 | 2 | 1 | 1 | 2 | 2 | 1 | 1 | 2 | 2 | 1 | 1 | 2 | 2 | 1 |
| Lubricant | 2 | 1 | 2 | 1 | 2 | 1 | 2 | 1 | 2 | 1 | 2 | 1 | 2 | 1 | 2 | 1 | 2 | 1 | 2 | 1 |

| Test sample No. | | | | | | | | | | | | | | | | | | | | |
|---|---|---|---|---|---|---|---|---|---|---|---|---|---|---|---|---|---|---|---|---|
| 1 | G | G | G | G | G | G | G | G | G | G | G | G | G | G | G | G | G | G | G | G |
| 2 | G | G | G | G | G | G | G | G | G | G | G | G | G | G | G | G | G | G | G | G |
| 3 | G | G | G | G | G | G | G | G | G | G | G | G | G | G | G | G | G | G | G | G |
| 4 | G | G | G | G | G | G | G | G | G | G | G | G | G | G | G | G | G | G | G | G |
| 5 | G | G | G | G | G | G | G | G | G | G | G | G | G | G | G | G | G | G | G | G |
| 6 | G | G | G | G | G | G | G | G | G | G | G | G | G | G | G | G | G | G | G | G |
| 7 | G | G | G | G | G | G | G | G | G | G | G | G | G | G | G | G | G | G | G | G |
| 8 | G | G | G | G | G | G | G | G | G | G | G | G | G | G | G | G | G | G | G | G |
| 9 | G | G | G | G | G | G | G | G | G | G | G | G | G | G | G | G | G | G | G | G |
| 10 | G | G | G | G | G | G | G | G | G | G | G | G | G | G | G | G | G | G | G | G |
| 11 | G | G | G | G | G | G | G | G | G | G | G | G | G | G | G | G | G | G | G | G |
| 12 | G | G | G | G | G | G | G | G | G | G | G | G | G | G | G | G | G | G | G | G |
| 13 | G | G | G | G | G | G | G | G | G | G | G | G | G | G | G | G | G | G | G | G |
| 14 | G | G | G | G | G | G | G | G | G | G | G | G | G | G | G | G | G | G | G | G |
| 15 | G | G | G | G | G | G | G | G | G | G | G | G | G | G | G | G | G | G | G | G |
| 16 | G | G | G | G | G | G | G | G | G | G | G | G | G | G | G | G | G | G | G | G |
| 17 | G | G | G | G | G | G | G | G | G | G | G | G | G | G | G | G | G | G | G | G |
| 18 | G | G | G | G | G | G | G | G | G | G | G | G | G | G | G | G | G | G | G | G |
| 19 | G | G | G | G | G | G | G | G | G | G | G | G | G | G | G | G | G | G | G | G |
| 20 | G | G | G | G | G | G | G | G | G | G | G | G | G | G | G | G | G | G | G | G |
| 21 | G | G | G | G | G | G | G | G | G | G | G | G | G | G | G | G | G | G | G | G |
| 22 | G | G | G | G | G | G | G | G | G | G | G | G | G | G | G | G | G | G | G | G |
| 23 | G | G | G | G | G | G | G | G | G | G | G | G | G | G | G | G | G | G | G | G |
| 24 | G | G | G | G | G | G | G | G | G | G | G | G | G | G | G | G | G | G | G | G |
| 25 | G | G | G | G | G | G | G | G | G | G | G | G | G | G | G | G | G | G | G | G |
| 26 | G | G | G | G | G | G | G | G | G | G | G | G | G | G | G | G | G | G | G | G |
| 27 | G | G | G | G | G | G | G | G | G | G | G | G | G | G | G | G | G | G | G | G |
| 28 | G | G | G | G | G | G | G | G | G | G | G | G | G | G | G | G | G | G | G | G |
| 29 | G | G | G | G | G | G | G | G | G | G | G | G | G | G | G | G | G | G | G | G |
| 30 | G | G | G | G | G | G | G | G | G | G | G | G | G | G | G | G | G | G | G | G |
| 31 | G | G | G | G | G | G | G | G | G | G | G | G | G | G | G | G | G | G | G | G |

TABLE 7-continued

| | | | | | | | | | | | | | | | | | | | | |
|---|---|---|---|---|---|---|---|---|---|---|---|---|---|---|---|---|---|---|---|---|
| Surface roughness after cutting | | | | | | | | | | | | | | | | | | | | |
| | 32 | G | G | G | G | G | G | G | G | G | G | G | G | G | G | G | G | G | G | G |
| | 33 | G | G | G | G | G | G | G | G | G | G | G | G | G | G | G | G | G | G | G |
| | 34 | G | G | G | G | G | G | G | G | G | G | G | G | G | G | G | G | G | G | G |
| | 35 | G | G | G | G | G | G | G | G | G | G | G | G | G | G | G | G | G | G | G |
| | 36 | G | G | G | G | G | G | G | G | G | G | G | G | G | G | G | G | G | G | G |
| | 37 | G | G | G | G | G | G | G | G | G | G | G | G | G | G | G | G | G | G | G |
| Insert material | | 3 | 3 | 3 | 4 | 4 | 4 | 4 | 4 | 4 | 4 | 4 | 4 | 4 | 4 | 4 | 4 | 4 | 4 | 4 |
| Cutting speed | | 2 | 2 | 2 | 1 | 1 | 1 | 1 | 1 | 1 | 1 | 1 | 2 | 2 | 2 | 2 | 2 | 2 | 2 | 2 |
| Feed rate | | 2 | 2 | 2 | 1 | 1 | 1 | 1 | 2 | 2 | 2 | 2 | 1 | 1 | 1 | 1 | 2 | 2 | 2 | 2 |
| Cutting depth | | 1 | 2 | 2 | 1 | 1 | 2 | 2 | 1 | 1 | 2 | 2 | 1 | 1 | 2 | 2 | 1 | 1 | 2 | 2 |
| Lubricant | | 2 | 1 | 2 | 1 | 2 | 1 | 2 | 1 | 2 | 1 | 2 | 1 | 2 | 1 | 2 | 1 | 2 | 1 | 2 |
| Test sample No. | 1 | G | G | G | G | G | G | G | G | G | G | G | G | G | G | G | G | G | G | G |
| | 2 | G | G | G | G | G | G | G | G | G | G | G | G | G | G | G | G | G | G | G |
| | 3 | G | G | G | G | G | G | G | G | G | G | G | G | G | G | G | G | G | G | G |
| | 4 | G | G | G | G | G | G | G | G | G | G | G | G | G | G | G | G | G | G | G |
| | 5 | G | G | G | G | G | G | G | G | G | G | G | G | G | G | G | G | G | G | G |
| | 6 | G | G | G | G | G | G | G | G | G | G | G | G | G | G | G | G | G | G | G |
| | 7 | G | G | G | G | G | G | G | G | G | G | G | G | G | G | G | G | G | G | G |
| | 8 | G | G | G | G | G | G | G | G | G | G | G | G | G | G | G | G | G | G | G |
| | 9 | G | G | G | G | G | G | G | G | G | G | G | G | G | G | G | G | G | G | G |
| | 10 | G | G | G | G | G | G | G | G | G | G | G | G | G | G | G | G | G | G | G |
| | 11 | G | G | G | G | G | G | G | G | G | G | G | G | G | G | G | G | G | G | G |
| | 12 | G | G | G | G | G | G | G | G | G | G | G | G | G | G | G | G | G | G | G |
| | 13 | G | G | G | G | G | G | G | G | G | G | G | G | G | G | G | G | G | G | G |
| | 14 | G | G | G | G | G | G | G | G | G | G | G | G | G | G | G | G | G | G | G |
| | 15 | G | G | G | G | G | G | G | G | G | G | G | G | G | G | G | G | G | G | G |
| | 16 | G | G | G | G | G | G | G | G | G | G | G | G | G | G | G | G | G | G | G |
| | 17 | G | G | G | G | G | G | G | G | G | G | G | G | G | G | G | G | G | G | G |
| | 18 | G | G | G | G | G | G | G | G | G | G | G | G | G | G | G | G | G | G | G |
| | 19 | G | G | G | G | G | G | G | G | G | G | G | G | G | G | G | G | G | G | G |
| | 20 | G | G | G | G | G | G | G | G | G | G | G | G | G | G | G | G | G | G | G |
| | 21 | G | G | G | G | G | G | G | G | G | G | G | G | G | G | G | G | G | G | G |
| | 22 | G | G | G | G | G | G | G | G | G | G | G | G | G | G | G | G | G | G | G |
| | 23 | G | G | G | G | G | G | G | G | G | G | G | G | G | G | G | G | G | G | G |
| | 24 | G | G | G | G | G | G | G | G | G | G | G | G | G | G | G | G | G | G | G |
| | 25 | G | G | G | G | G | G | G | G | G | G | G | G | G | G | G | G | G | G | G |
| | 26 | G | G | G | G | G | G | G | G | G | G | G | G | G | G | G | G | G | G | G |
| | 27 | G | G | G | G | G | G | G | G | G | G | G | G | G | G | G | G | G | G | G |
| | 28 | G | G | G | G | G | G | G | G | G | G | G | G | G | G | G | G | G | G | G |
| | 29 | G | G | G | G | G | G | G | G | G | G | G | G | G | G | G | G | G | G | G |
| | 30 | G | G | G | G | G | G | G | G | G | G | G | G | G | G | G | G | G | G | G |
| | 31 | G | G | G | G | G | G | G | G | G | G | G | G | G | G | G | G | G | G | G |
| | 32 | G | G | G | G | G | G | G | G | G | G | G | G | G | G | G | G | G | G | G |
| | 33 | G | G | G | G | G | G | G | G | G | G | G | G | G | G | G | G | G | G | G |
| | 34 | G | G | G | G | G | G | G | G | G | G | G | G | G | G | G | G | G | G | G |
| | 35 | G | G | G | G | G | G | G | G | G | G | G | G | G | G | G | G | G | G | G |
| | 36 | G | G | G | G | G | G | G | G | G | G | G | G | G | G | G | G | G | G | G |
| | 37 | G | G | G | G | G | G | G | G | G | G | G | G | G | G | G | G | G | G | G |

* G: Good, P: Poor

TABLE 8

| Surface roughness after cutting | | | | | | | | | | | | | | | | | | | | | | | | | |
|---|---|---|---|---|---|---|---|---|---|---|---|---|---|---|---|---|---|---|---|---|---|---|---|---|---|
| | Insert material | | | | | | | | | | | | | | | | | | | | | | | | |
| | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 |
| | Cutting speed | | | | | | | | | | | | | | | | | | | | | | | | |
| | 1 | 1 | 1 | 1 | 1 | 1 | 1 | 1 | 2 | 2 | 2 | 2 | 2 | 2 | 2 | 2 | 1 | 1 | 1 | 1 | 1 | 1 | 1 | 1 | 2 |
| | Feed rate | | | | | | | | | | | | | | | | | | | | | | | | |
| | 1 | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 1 |
| | Cutting depth | | | | | | | | | | | | | | | | | | | | | | | | |
| | 1 | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | 1 |
| | Lubricant | | | | | | | | | | | | | | | | | | | | | | | | |
| | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 |
| Test sample No. 38 | G | G | G | G | G | G | G | G | G | G | G | G | G | G | G | G | G | G | G | G | G | G | G | G | G |
| 39 | G | G | G | G | G | G | G | G | G | G | G | G | G | G | G | G | G | G | G | G | G | G | G | G | G |
| 40 | G | G | G | G | G | G | G | G | G | G | G | G | G | G | G | G | G | G | G | G | G | G | G | G | G |
| 41 | G | G | G | G | G | G | G | G | G | G | G | G | G | G | G | G | G | G | G | G | G | G | G | G | G |
| 42 | G | G | G | G | G | G | G | G | G | G | G | G | G | G | G | G | G | G | G | G | G | G | G | G | G |
| 43 | G | G | G | G | G | G | G | G | G | G | G | G | G | G | G | G | G | G | G | G | G | G | G | G | G |
| 44 | G | G | G | G | G | G | G | G | G | G | G | G | G | G | G | G | G | G | G | G | G | G | G | G | G |
| 45 | G | G | G | G | G | G | G | G | G | G | G | G | G | G | G | G | G | G | G | G | G | G | G | G | G |
| 46 | G | G | G | G | G | G | G | G | G | G | G | G | G | G | G | G | G | G | G | G | G | G | G | G | G |
| 47 | G | G | G | G | G | G | G | G | G | G | G | P | G | G | G | G | G | G | G | G | G | G | G | G | G |
| 48 | G | G | G | G | G | G | G | G | G | G | G | G | G | G | G | G | G | G | G | G | G | G | G | G | G |
| 49 | G | G | G | G | G | G | G | G | G | G | G | G | G | G | G | G | G | G | G | G | G | G | G | G | G |
| 50 | G | G | G | P | G | G | P | G | G | P | G | P | G | G | G | G | P | G | G | P | P | P | P | G | G |
| 51 | G | G | G | G | G | G | G | G | G | G | G | G | G | G | G | G | G | G | G | G | G | G | G | G | G |
| 52 | G | G | G | G | P | G | G | G | G | P | G | G | G | G | G | G | P | P | G | G | G | G | G | G | G |
| 53 | G | G | G | G | G | G | G | G | G | G | G | G | G | G | G | G | G | P | G | G | G | G | G | G | G |
| 54 | G | G | G | G | G | G | G | G | G | G | G | G | G | G | G | G | G | G | G | G | G | G | G | G | G |
| 55 | G | G | G | G | G | G | G | G | G | G | G | G | G | G | G | G | G | G | G | G | G | G | G | G | G |
| 56 | G | G | G | G | G | G | G | G | G | G | G | G | G | G | G | G | G | G | G | G | G | G | G | G | G |
| 57 | G | G | G | G | G | G | G | G | G | G | G | G | G | G | G | G | G | G | G | G | G | G | G | G | G |
| 58 | G | G | G | G | G | G | G | G | G | G | G | P | G | G | G | G | G | G | G | G | G | G | G | G | G |
| 59 | G | G | G | G | G | G | G | G | G | G | G | G | G | G | G | G | G | G | G | G | G | G | G | G | G |
| 60 | G | G | G | G | G | G | G | G | G | G | G | G | G | G | G | G | G | G | G | G | G | G | G | G | G |
| 61 | G | G | G | G | G | G | G | G | G | G | G | G | G | G | G | G | G | G | G | G | G | G | G | G | G |
| 62 | G | G | G | G | G | G | G | G | G | G | G | P | G | G | G | G | G | G | G | G | G | G | G | G | G |
| 63 | G | G | G | G | G | G | G | G | G | G | G | G | G | G | G | G | G | G | G | G | G | G | G | G | G |
| 64 | G | G | G | G | G | G | G | G | G | G | G | G | G | G | G | G | G | G | G | G | G | G | G | G | G |
| 65 | G | G | G | G | G | G | G | G | G | G | G | G | G | G | G | G | G | G | G | G | G | G | G | G | G |
| 66 | G | G | G | G | G | G | G | G | G | G | G | G | G | G | G | G | G | G | G | G | G | G | G | G | G |
| 67 | G | G | G | G | G | G | G | G | G | G | G | G | G | G | G | G | G | G | G | G | G | G | G | G | G |
| 68 | G | G | G | G | G | G | G | G | G | G | G | G | G | G | G | G | G | G | G | G | G | G | G | G | G |
| 69 | G | G | G | G | G | G | G | G | G | G | G | G | G | G | G | G | G | G | G | G | G | G | G | G | G |
| 70 | G | G | G | G | G | G | G | G | G | G | G | G | G | G | G | G | G | G | G | G | G | G | G | G | G |
| 71 | G | G | G | G | G | G | G | G | G | G | G | G | G | G | G | G | G | G | G | G | G | G | G | G | G |
| 72 | G | G | G | G | G | G | G | G | G | G | G | G | G | G | G | G | G | G | G | G | G | G | G | G | G |
| 73 | G | G | G | G | G | G | G | G | G | G | G | G | G | G | G | G | G | G | G | G | G | G | G | G | G |
| 74 | G | G | G | G | G | G | G | G | G | G | G | G | G | G | G | G | G | G | G | G | G | G | P | G | G |
| 75 | G | G | G | G | G | G | G | G | G | G | P | G | G | G | G | G | G | G | G | G | G | G | G | G | G |

| | Insert material | | | | | | | | | | | | | | | | | | | | | | | | |
|---|---|---|---|---|---|---|---|---|---|---|---|---|---|---|---|---|---|---|---|---|---|---|---|---|---|
| | 2 | 2 | 2 | 2 | 2 | 2 | 2 | 3 | 3 | 3 | 3 | 3 | 3 | 3 | 3 | 3 | 3 | 3 | 3 | 3 | 3 | 3 | 3 | 3 | 3 |
| | Cutting speed | | | | | | | | | | | | | | | | | | | | | | | | |
| | 2 | 2 | 2 | 2 | 2 | 2 | 2 | 1 | 1 | 1 | 1 | 1 | 1 | 1 | 1 | 1 | 2 | 2 | 2 | 2 | 2 | 2 | 2 | 2 | 2 |
| | Feed rate | | | | | | | | | | | | | | | | | | | | | | | | |
| | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | | |
| | Cutting depth | | | | | | | | | | | | | | | | | | | | | | | | |
| | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | | |
| | Lubricant | | | | | | | | | | | | | | | | | | | | | | | | |
| | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | | |
| Test sample No. 38 | G | G | G | G | G | G | G | G | G | G | G | G | G | G | G | G | G | G | G | G | G | G | G | | |
| 39 | G | G | G | G | G | G | G | G | G | G | G | G | G | G | G | G | G | G | G | G | G | G | G | | |
| 40 | G | G | G | G | G | G | G | G | G | G | G | G | G | G | G | G | G | G | G | G | G | G | G | | |
| 41 | G | G | G | G | G | G | G | G | G | G | G | G | G | G | G | G | G | G | G | G | G | G | G | | |
| 42 | G | G | G | G | G | G | G | G | G | G | G | G | G | G | G | G | G | G | G | G | G | G | G | | |
| 43 | G | G | G | G | G | G | G | G | G | G | G | G | G | G | G | G | G | G | G | G | G | G | G | | |
| 44 | G | G | G | G | G | G | G | G | G | G | G | G | G | G | G | G | G | G | G | G | G | G | G | | |

TABLE 8-continued

| | | | | | | | | | | | | | | | | | | | | | | |
|---|---|---|---|---|---|---|---|---|---|---|---|---|---|---|---|---|---|---|---|---|---|---|
| Surface roughness after cutting | | | | | | | | | | | | | | | | | | | | | | |
| 45 | G | G | G | G | G | G | G | G | G | G | G | G | G | G | G | G | G | G | G | G | G | G |
| 46 | G | G | G | G | G | G | G | G | G | G | G | G | G | G | G | G | G | G | G | G | G | G |
| 47 | G | G | G | G | G | G | G | G | G | G | G | G | G | G | G | G | G | G | G | G | G | G |
| 48 | G | G | G | G | G | P | G | G | G | G | G | G | G | G | G | G | G | G | G | G | G | G |
| 49 | G | G | G | G | G | G | G | P | G | G | G | G | G | G | G | G | G | G | G | G | G | G |
| 50 | G | G | G | G | G | G | G | G | G | P | G | P | G | G | G | G | G | P | G | P | G | G |
| 51 | G | G | P | G | G | G | G | G | G | G | G | G | G | G | G | G | P | G | G | G | G | G |
| 52 | G | G | G | G | G | G | G | G | G | G | P | P | G | G | G | G | G | G | G | G | G | G |
| 53 | G | G | G | G | G | G | G | G | G | G | G | G | G | G | G | G | G | G | G | G | G | G |
| 54 | G | G | G | G | G | G | G | G | G | G | P | G | G | G | G | G | G | G | G | G | G | G |
| 55 | G | G | G | G | G | G | G | G | G | G | G | G | G | G | G | G | G | G | G | G | G | G |
| 56 | G | G | G | G | G | G | G | G | G | G | G | G | G | G | G | G | G | G | G | G | G | P |
| 57 | G | G | G | G | G | G | G | G | G | G | G | G | G | G | G | G | G | G | G | G | G | G |
| 58 | G | G | G | G | G | G | G | G | G | G | G | G | G | G | G | G | G | G | G | G | G | G |
| 59 | G | G | G | G | G | G | G | G | G | G | G | G | G | G | G | G | G | G | G | G | G | G |
| 60 | G | G | G | G | G | P | G | G | G | G | G | G | G | G | G | G | G | G | G | G | G | G |
| 61 | G | G | G | G | G | G | G | G | G | G | G | G | G | G | G | G | G | G | G | G | G | G |
| 62 | G | G | G | G | G | G | G | G | G | G | G | G | G | G | G | G | G | G | G | G | G | G |
| 63 | G | G | G | G | G | P | G | G | G | G | G | G | G | G | G | G | G | G | G | G | G | G |
| 64 | G | G | G | G | G | G | G | G | G | G | P | G | G | G | G | G | G | G | G | G | G | G |
| 65 | G | G | G | G | G | G | G | G | G | G | G | G | G | G | G | G | G | G | G | G | G | G |
| 66 | G | G | G | G | G | G | G | G | G | G | G | G | G | G | G | G | G | G | G | G | G | G |
| 67 | G | G | G | G | G | G | G | G | G | G | G | G | G | G | G | G | G | G | G | G | G | G |
| 68 | G | G | G | G | G | G | G | G | G | G | G | G | G | G | G | G | G | G | G | G | G | G |
| 69 | G | G | G | G | G | G | G | G | G | G | G | G | G | G | G | G | G | G | G | G | G | G |
| 70 | G | G | G | G | G | G | G | G | G | G | G | G | G | G | G | G | G | G | G | G | G | G |
| 71 | G | G | G | G | G | G | G | G | G | G | G | G | G | G | G | G | G | G | G | G | G | G |
| 72 | G | G | G | G | G | G | G | G | G | G | G | G | G | G | G | G | G | G | G | G | G | G |
| 73 | G | G | G | G | G | G | G | G | G | G | G | G | G | G | G | G | G | G | G | G | G | G |
| 74 | G | G | G | G | G | G | G | G | G | G | G | G | G | G | G | G | G | G | G | G | G | G |
| 75 | G | G | G | G | P | G | G | G | G | G | G | G | G | G | G | G | G | G | G | G | G | G |
| Insert material | | 4 | 4 | 4 | 4 | 4 | 4 | 4 | 4 | 4 | 4 | 4 | 4 | 4 | 4 | 4 | 4 |
| Cutting speed | | 1 | 1 | 1 | 1 | 1 | 1 | 1 | 1 | 2 | 2 | 2 | 2 | 2 | 2 | 2 | 2 |
| Feed rate | | 1 | 1 | 1 | 1 | 2 | 2 | 2 | 2 | 1 | 1 | 1 | 1 | 2 | 2 | 2 | 2 |
| Cutting depth | | 1 | 1 | 2 | 2 | 1 | 1 | 2 | 2 | 1 | 1 | 2 | 2 | 1 | 1 | 2 | 2 |
| Lubricant | | 1 | 2 | 1 | 2 | 1 | 2 | 1 | 2 | 1 | 2 | 1 | 2 | 1 | 2 | 1 | 2 |
| Test sample No. | 38 | G | G | G | G | G | G | G | G | G | G | G | G | G | G | G | G |
| | 39 | G | G | G | G | G | G | G | G | G | G | G | G | G | G | G | G |
| | 40 | G | G | G | G | G | G | G | G | G | G | G | G | G | G | G | G |
| | 41 | G | G | G | G | G | G | G | G | G | G | G | G | G | G | G | G |
| | 42 | G | G | G | G | G | G | G | G | G | G | G | G | G | G | G | G |
| | 43 | G | G | G | G | G | G | G | G | G | G | G | G | G | G | G | G |
| | 44 | G | G | G | G | G | G | G | G | G | G | G | G | G | G | G | G |
| | 45 | G | G | G | G | G | G | G | G | G | G | G | G | G | G | G | G |
| | 46 | G | G | G | G | G | G | G | G | G | G | G | G | G | G | G | G |
| | 47 | G | G | G | G | G | G | G | G | G | G | G | G | G | G | G | G |
| | 48 | G | G | G | G | G | G | G | G | G | G | G | G | G | G | G | G |
| | 49 | G | G | G | G | G | G | G | G | G | G | G | G | G | G | G | G |
| | 50 | G | P | G | P | G | G | P | G | P | P | P | P | G | G | G | G |
| | 51 | G | G | G | G | G | G | G | G | G | G | G | G | G | G | G | G |
| | 52 | G | G | P | G | G | G | G | P | G | G | G | G | G | G | G | G |
| | 53 | G | G | G | G | G | G | G | G | G | G | G | G | G | G | G | G |
| | 54 | G | G | G | G | G | G | G | G | G | G | G | G | G | G | G | G |
| | 55 | G | G | G | G | G | P | G | G | G | G | G | G | G | G | G | G |
| | 56 | G | G | G | G | G | G | G | G | G | G | G | G | G | G | G | G |
| | 57 | G | G | G | G | G | P | G | G | G | G | G | G | G | G | G | G |
| | 58 | G | G | G | G | G | G | G | G | G | G | G | G | G | G | G | G |
| | 59 | G | G | G | G | G | P | G | G | G | G | G | G | G | G | G | G |
| | 60 | G | G | G | G | G | G | G | G | G | G | G | G | G | G | G | G |
| | 61 | G | G | G | G | G | G | P | G | G | G | G | G | G | G | G | G |
| | 62 | G | G | G | G | G | G | G | G | G | G | G | G | G | G | G | G |
| | 63 | G | G | G | G | G | G | G | G | G | G | G | G | G | G | G | G |
| | 64 | G | G | G | G | G | G | G | G | G | G | G | G | G | G | G | G |
| | 65 | G | G | G | G | G | G | G | G | G | G | G | G | G | G | G | G |
| | 66 | G | G | G | G | G | G | G | G | G | G | G | G | G | G | G | G |
| | 67 | G | G | G | G | G | G | G | G | G | G | G | G | G | G | G | G |

TABLE 8-continued

| | Surface roughness after cutting | | | | | | | | | | | | | | | |
|---|---|---|---|---|---|---|---|---|---|---|---|---|---|---|---|---|
| 68 | G | G | G | G | G | G | G | G | G | G | G | G | G | G | G | G |
| 69 | G | G | G | G | G | G | G | G | G | G | G | G | G | G | G | G |
| 70 | G | G | G | G | G | G | G | G | G | G | G | G | G | G | G | G |
| 71 | G | G | G | G | G | G | G | G | G | G | G | G | G | G | G | G |
| 72 | G | G | G | G | G | G | G | G | G | G | G | G | G | G | G | G |
| 73 | G | G | G | G | G | G | G | G | G | G | G | G | G | G | G | G |
| 74 | G | G | G | G | G | G | G | G | G | G | G | G | G | G | G | G |
| 75 | G | G | G | G | P | G | G | G | G | G | G | G | G | G | G | G |

* G: Good, P: Poor

TABLE 9

| | | Chip treatability | | | | | | | | | | | | | | | | | | | | | | | | |
|---|---|---|---|---|---|---|---|---|---|---|---|---|---|---|---|---|---|---|---|---|---|---|---|---|---|---|
| | | Insert material | | | | | | | | | | | | | | | | | | | | | | | | |
| | | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 |
| | | Cutting speed | | | | | | | | | | | | | | | | | | | | | | | | |
| | | 1 | 1 | 1 | 1 | 1 | 1 | 1 | 1 | 2 | 2 | 2 | 2 | 2 | 2 | 2 | 2 | 1 | 1 | 1 | 1 | 1 | 1 | 1 | 1 | 2 |
| | | Feed rate | | | | | | | | | | | | | | | | | | | | | | | | |
| | | 1 | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 1 |
| | | Cutting depth | | | | | | | | | | | | | | | | | | | | | | | | |
| | | 1 | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | 1 |
| | | Lubricant | | | | | | | | | | | | | | | | | | | | | | | | |
| | | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 |
| Test sample No. | 1 | G | G | G | G | G | G | G | G | G | G | G | G | G | G | G | G | G | G | G | G | G | G | G | G | G |
| | 2 | G | G | G | G | G | G | G | G | G | G | G | G | G | G | G | G | G | G | G | G | G | G | G | G | G |
| | 3 | G | G | G | G | G | G | G | G | G | G | G | G | G | G | G | G | G | G | G | G | G | G | G | G | G |
| | 4 | G | G | G | G | G | G | G | G | G | G | G | G | G | G | G | G | G | G | G | G | G | G | G | G | G |
| | 5 | G | G | G | G | G | G | G | G | G | G | G | G | G | G | G | G | G | G | G | G | G | G | G | G | G |
| | 6 | G | G | G | G | G | G | G | G | G | G | G | G | G | G | G | G | G | G | G | G | G | G | G | G | G |
| | 7 | G | G | G | G | G | G | G | G | G | G | G | G | G | G | G | G | G | G | G | G | G | G | G | G | G |
| | 8 | G | G | G | G | G | G | G | G | G | G | G | G | G | G | G | G | G | G | G | G | G | G | G | G | G |
| | 9 | G | G | G | G | G | G | G | G | G | G | G | G | G | G | G | G | G | G | G | G | G | G | G | G | G |
| | 10 | G | G | G | G | G | G | G | G | G | G | G | G | G | G | G | G | G | G | G | G | G | G | G | G | G |
| | 11 | G | G | G | G | G | G | G | G | G | G | G | G | G | G | G | G | G | G | G | G | G | G | G | G | G |
| | 12 | G | G | G | G | G | G | G | G | G | G | G | G | G | G | G | G | G | G | G | G | G | G | G | G | G |
| | 13 | G | G | G | G | G | G | G | G | G | G | G | G | G | G | G | G | G | G | G | G | G | G | G | G | G |
| | 14 | G | G | G | G | G | G | G | G | G | G | G | G | G | G | G | G | G | G | G | G | G | G | G | G | G |
| | 15 | G | G | G | G | G | G | G | G | G | G | G | G | G | G | G | G | G | G | G | G | G | G | G | G | G |
| | 16 | E | E | E | E | E | E | E | E | E | E | E | E | E | E | E | E | E | E | E | E | E | E | E | E | E |
| | 17 | E | E | E | E | E | E | E | E | E | E | E | E | E | E | E | E | E | E | E | E | E | E | E | E | E |
| | 18 | E | E | E | E | E | E | E | E | E | E | E | E | E | E | E | E | E | E | E | E | E | E | E | E | E |
| | 19 | E | E | E | E | E | E | E | E | E | E | E | E | E | E | E | E | E | E | E | E | E | E | E | E | E |
| | 20 | E | G | G | G | G | G | G | G | G | G | G | G | G | G | G | G | G | G | G | G | G | G | G | G | G |
| | 21 | E | G | G | G | G | G | G | G | G | G | G | G | G | G | G | G | G | G | G | G | G | G | G | G | G |
| | 22 | E | G | G | G | G | G | G | G | G | G | G | G | G | G | G | G | G | G | G | G | G | G | G | G | G |
| | 23 | E | G | G | G | G | G | G | G | G | G | G | G | G | G | G | G | G | G | G | G | G | G | G | G | G |
| | 24 | E | G | G | G | G | G | G | G | G | G | G | G | G | G | G | G | G | G | G | G | G | G | G | G | G |
| | 25 | E | G | G | G | G | G | G | G | G | G | G | G | G | G | G | G | G | G | G | G | G | G | G | G | G |
| | 26 | E | G | G | G | G | G | G | G | G | G | G | G | G | G | G | G | G | G | G | G | G | G | G | G | G |
| | 27 | E | G | G | G | G | G | G | G | G | G | G | G | G | G | G | G | G | G | G | G | G | G | G | G | G |
| | 28 | E | G | G | G | G | G | G | G | G | G | G | G | G | G | G | G | G | G | G | G | G | G | G | G | G |
| | 29 | E | G | G | G | G | G | G | G | G | G | G | G | G | G | G | G | G | G | G | G | G | G | G | G | G |
| | 30 | E | G | G | G | G | G | G | G | G | G | G | G | G | G | G | G | G | G | G | G | G | G | G | G | G |
| | 31 | E | G | G | G | G | G | G | G | G | G | G | G | G | G | G | G | G | G | G | G | G | G | G | G | G |
| | 32 | E | G | G | G | G | G | G | G | G | G | G | G | G | G | G | G | G | G | G | G | G | G | G | G | G |
| | 33 | E | G | G | G | G | G | G | G | G | G | G | G | G | G | G | G | G | G | G | G | G | G | G | G | G |
| | 34 | E | G | G | G | G | G | G | G | G | G | G | G | G | G | G | G | G | G | G | G | G | G | G | G | G |
| | 35 | E | G | G | G | G | G | G | G | G | G | G | G | G | G | G | G | G | G | G | G | G | G | G | G | G |
| | 36 | E | G | G | G | G | G | G | G | G | G | G | G | G | G | G | G | G | G | G | G | G | G | G | G | G |
| | 37 | E | G | G | G | G | G | G | G | G | G | G | G | G | G | G | G | G | G | G | G | G | G | G | G | G |

TABLE 9-continued

| | | Chip treatability | | | | | | | | | | | | | | | | | | | | | | |
|---|---|---|---|---|---|---|---|---|---|---|---|---|---|---|---|---|---|---|---|---|---|---|---|---|
| | | Insert material | | | | | | | | | | | | | | | | | | | | | | |
| | | 2 | 2 | 2 | 2 | 2 | 2 | 2 | 3 | 3 | 3 | 3 | 3 | 3 | 3 | 3 | 3 | 3 | 3 | 3 | 3 | 3 | 3 | 3 |
| | | Cutting speed | | | | | | | | | | | | | | | | | | | | | | |
| | | 2 | 2 | 2 | 2 | 2 | 2 | 2 | 1 | 1 | 1 | 1 | 1 | 1 | 1 | 1 | 2 | 2 | 2 | 2 | 2 | 2 | 2 | 2 |
| | | Feed rate | | | | | | | | | | | | | | | | | | | | | | |
| | | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 |
| | | Cutting depth | | | | | | | | | | | | | | | | | | | | | | |
| | | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 |
| | | Lubricant | | | | | | | | | | | | | | | | | | | | | | |
| | | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| Test sample No. | 1 | G | G | G | G | G | G | G | G | G | G | G | G | G | G | G | G | G | G | G | G | G | G | G |
| | 2 | G | G | G | G | G | G | G | G | G | G | G | G | G | G | G | G | G | G | G | G | G | G | G |
| | 3 | G | G | G | G | G | G | G | G | G | G | G | G | G | G | G | G | G | G | G | G | G | G | G |
| | 4 | G | G | G | G | G | G | G | G | G | G | G | G | G | G | G | G | G | G | G | G | G | G | G |
| | 5 | G | G | G | G | G | G | G | G | G | G | G | G | G | G | G | G | G | G | G | G | G | G | G |
| | 6 | G | G | G | G | G | G | G | G | G | G | G | G | G | G | G | G | G | G | G | G | G | G | G |
| | 7 | G | G | G | G | G | G | G | G | G | G | G | G | G | G | G | G | G | G | G | G | G | G | G |
| | 8 | G | G | G | G | G | G | G | G | G | G | G | G | G | G | G | G | G | G | G | G | G | G | G |
| | 9 | G | G | G | G | G | G | G | G | G | G | G | G | G | G | G | G | G | G | G | G | G | G | G |
| | 10 | G | G | G | G | G | G | G | G | G | G | G | G | G | G | G | G | G | G | G | G | G | G | G |
| | 11 | G | G | G | G | G | G | G | G | G | G | G | G | G | G | G | G | G | G | G | G | G | G | G |
| | 12 | G | G | G | G | G | G | G | G | G | G | G | G | G | G | G | G | G | G | G | G | G | G | G |
| | 13 | G | G | G | G | G | G | G | G | G | G | G | G | G | G | G | G | G | G | G | G | G | G | G |
| | 14 | G | G | G | G | G | G | G | G | G | G | G | G | G | G | G | G | G | G | G | G | G | G | G |
| | 15 | G | G | G | G | G | G | G | G | G | G | G | G | G | G | G | G | G | G | G | G | G | G | G |
| | 16 | E | E | E | E | E | E | E | E | E | E | E | E | E | E | E | E | E | E | E | E | E | E | E |
| | 17 | E | E | E | E | E | E | E | E | E | E | E | E | E | E | E | E | E | E | E | E | E | E | E |
| | 18 | E | E | E | E | E | E | E | E | E | E | E | E | E | E | E | E | E | E | E | E | E | E | E |
| | 19 | E | E | E | E | E | E | E | E | E | E | E | E | E | E | E | E | E | E | E | E | E | E | E |
| | 20 | G | G | G | G | G | G | G | G | G | G | G | G | G | G | G | G | G | G | G | G | G | G | G |
| | 21 | G | G | G | G | G | G | G | G | G | G | G | G | G | G | G | G | G | G | G | G | G | G | G |
| | 22 | G | G | G | G | G | G | G | G | G | G | G | G | G | G | G | G | G | G | G | G | G | G | G |
| | 23 | G | G | G | G | G | G | G | G | G | G | G | G | G | G | G | G | G | G | G | G | G | G | G |
| | 24 | G | G | G | G | G | G | G | G | G | G | G | G | G | G | G | G | G | G | G | G | G | G | G |
| | 25 | G | G | G | G | G | G | G | G | G | G | G | G | G | G | G | G | G | G | G | G | G | G | G |
| | 26 | G | G | G | G | G | G | G | G | G | G | G | G | G | G | G | G | G | G | G | G | G | G | G |
| | 27 | G | G | G | G | G | G | G | G | G | G | G | G | G | G | G | G | G | G | G | G | G | G | G |
| | 28 | G | G | G | G | G | G | G | G | G | G | G | G | G | G | G | G | G | G | G | G | G | G | G |
| | 29 | G | G | G | G | G | G | G | G | G | G | G | G | G | G | G | G | G | G | G | G | G | G | G |
| | 30 | G | G | G | G | G | G | G | G | G | G | G | G | G | G | G | G | G | G | G | G | G | G | G |
| | 31 | G | G | G | G | G | G | G | G | G | G | G | G | G | G | G | G | G | G | G | G | G | G | G |
| | 32 | G | G | G | G | G | G | G | G | G | G | G | G | G | G | G | G | G | G | G | G | G | G | G |
| | 33 | G | G | G | G | G | G | G | G | G | G | G | G | G | G | G | G | G | G | G | G | G | G | G |
| | 34 | G | G | G | G | G | G | G | G | G | G | G | G | G | G | G | G | G | G | G | G | G | G | G |
| | 35 | G | G | G | G | G | G | G | G | G | G | G | G | G | G | G | G | G | G | G | G | G | G | G |
| | 36 | G | G | G | G | G | G | G | G | G | G | G | G | G | G | G | G | G | G | G | G | G | G | G |
| | 37 | G | G | G | G | G | G | G | G | G | G | G | G | G | G | G | G | G | G | G | G | G | G | G |

| | | Insert material | | | | | | | | | | | | | | | |
|---|---|---|---|---|---|---|---|---|---|---|---|---|---|---|---|---|---|
| | | 4 | 4 | 4 | 4 | 4 | 4 | 4 | 4 | 4 | 4 | 4 | 4 | 4 | 4 | 4 | 4 |
| | | Cutting speed | | | | | | | | | | | | | | | |
| | | 1 | 1 | 1 | 1 | 1 | 1 | 1 | 1 | 2 | 2 | 2 | 2 | 2 | 2 | 2 | 2 |
| | | Feed rate | | | | | | | | | | | | | | | |
| | | 1 | 1 | 1 | 1 | 2 | 2 | 2 | 2 | 1 | 1 | 1 | 1 | 2 | 2 | 2 | 2 |
| | | Cutting depth | | | | | | | | | | | | | | | |
| | | 1 | 1 | 2 | 2 | 1 | 1 | 2 | 2 | 1 | 1 | 2 | 2 | 1 | 1 | 2 | 2 |
| | | Lubricant | | | | | | | | | | | | | | | |
| | | 1 | 2 | 1 | 2 | 1 | 2 | 1 | 2 | 1 | 2 | 1 | 2 | 1 | 2 | 1 | 2 |
| Test sample No. | 1 | G | G | G | G | G | G | G | G | G | G | G | G | G | G | G | G |
| | 2 | G | G | G | G | G | G | G | G | G | G | G | G | G | G | G | G |
| | 3 | G | G | G | G | G | G | G | G | G | G | G | G | G | G | G | G |
| | 4 | G | G | G | G | G | G | G | G | G | G | G | G | G | G | G | G |
| | 5 | G | G | G | G | G | G | G | G | G | G | G | G | G | G | G | G |
| | 6 | G | G | G | G | G | G | G | G | G | G | G | G | G | G | G | G |
| | 7 | G | G | G | G | G | G | G | G | G | G | G | G | G | G | G | G |
| | 8 | G | G | G | G | G | G | G | G | G | G | G | G | G | G | G | G |

TABLE 9-continued

| | Chip treatability | | | | | | | | | | | | | | | |
|---|---|---|---|---|---|---|---|---|---|---|---|---|---|---|---|---|
| 9 | G | G | G | G | G | G | G | G | G | G | G | G | G | G | G | G |
| 10 | G | G | G | G | G | G | G | G | G | G | G | G | G | G | G | G |
| 11 | G | G | G | G | G | G | G | G | G | G | G | G | G | G | G | G |
| 12 | G | G | G | G | G | G | G | G | G | G | G | G | G | G | G | G |
| 13 | G | G | G | G | G | G | G | G | G | G | G | G | G | G | G | G |
| 14 | G | G | G | G | G | G | G | G | G | G | G | G | G | G | G | G |
| 15 | G | G | G | G | G | G | G | G | G | G | G | G | G | G | G | G |
| 16 | E | E | E | E | E | E | E | E | E | E | E | E | E | E | E | E |
| 17 | E | E | E | E | E | E | E | E | E | E | E | E | E | E | E | E |
| 18 | E | E | E | E | E | E | E | E | E | E | E | E | E | E | E | E |
| 19 | E | E | E | E | E | E | E | E | E | E | E | E | E | E | E | E |
| 20 | G | G | G | G | G | G | G | G | G | G | G | G | G | G | G | G |
| 21 | G | G | G | G | G | G | G | G | G | G | G | G | G | G | G | G |
| 22 | G | G | G | G | G | G | G | G | G | G | G | G | G | G | G | G |
| 23 | G | G | G | G | G | G | G | G | G | G | G | G | G | G | G | G |
| 24 | G | G | G | G | G | G | G | G | G | G | G | G | G | G | G | G |
| 25 | G | G | G | G | G | G | G | G | G | G | G | G | G | G | G | G |
| 26 | G | G | G | G | G | G | G | G | G | G | G | G | G | G | G | G |
| 27 | G | G | G | G | G | G | G | G | G | G | G | G | G | G | G | G |
| 28 | G | G | G | G | G | G | G | G | G | G | G | G | G | G | G | G |
| 29 | G | G | G | G | G | G | G | G | G | G | G | G | G | G | G | G |
| 30 | G | G | G | G | G | G | G | G | G | G | G | G | G | G | G | G |
| 31 | G | G | G | G | G | G | G | G | G | G | G | G | G | G | G | G |
| 32 | G | G | G | G | G | G | G | G | G | G | G | G | G | G | G | G |
| 33 | G | G | G | G | G | G | G | G | G | G | G | G | G | G | G | G |
| 34 | G | G | G | G | G | G | G | G | G | G | G | G | G | G | G | G |
| 35 | G | G | G | G | G | G | G | G | G | G | G | G | G | G | G | G |
| 36 | G | G | G | G | G | G | G | G | G | G | G | G | G | G | G | G |
| 37 | G | G | G | G | G | G | G | G | G | G | G | G | G | G | G | G |

* E: Excellent, G: Good, P: Poor

TABLE 10

| | | Chip treatability | | | | | | | | | | | | | | | | | | | | | | | |
|---|---|---|---|---|---|---|---|---|---|---|---|---|---|---|---|---|---|---|---|---|---|---|---|---|---|
| | | Insert material | | | | | | | | | | | | | | | | | | | | | | | |
| | | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 |
| | | Cutting speed | | | | | | | | | | | | | | | | | | | | | | | |
| | | 1 | 1 | 1 | 1 | 1 | 1 | 1 | 1 | 2 | 2 | 2 | 2 | 2 | 2 | 2 | 2 | 1 | 1 | 1 | 1 | 1 | 1 | 1 | 1 | 2 |
| | | Feed rate | | | | | | | | | | | | | | | | | | | | | | | |
| | | 1 | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 1 |
| | | Cutting depth | | | | | | | | | | | | | | | | | | | | | | | |
| | | 1 | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | 1 |
| | | Lubricant | | | | | | | | | | | | | | | | | | | | | | | |
| | | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 |
| Test sample No. | 38 | G | G | G | G | G | G | G | G | G | G | G | G | G | G | G | G | G | G | G | G | G | G | G | G | G |
| | 39 | G | G | G | G | G | G | G | G | G | G | G | G | G | G | G | G | G | G | G | G | G | G | G | G | G |
| | 40 | G | G | G | G | G | G | G | G | G | G | G | G | G | G | G | G | G | G | G | G | G | G | G | G | G |
| | 41 | G | G | G | G | G | G | G | G | G | G | G | G | G | G | G | G | G | G | G | G | G | G | G | G | G |
| | 42 | G | G | G | G | G | G | G | G | G | G | G | G | G | G | G | G | G | G | G | G | G | G | G | G | G |
| | 43 | G | G | G | G | G | G | G | G | G | G | G | G | G | G | G | G | G | G | G | G | G | G | G | G | G |
| | 44 | G | G | G | G | G | G | G | G | G | G | G | G | G | G | G | G | G | G | G | G | G | G | G | G | G |
| | 45 | G | G | G | G | G | G | G | G | G | G | G | G | G | G | G | G | G | G | G | G | G | G | G | G | G |
| | 46 | G | G | G | G | G | G | G | G | G | G | G | G | G | G | G | G | G | G | G | G | G | G | G | G | G |
| | 47 | G | G | G | G | G | G | G | G | G | G | P | G | G | G | G | G | G | G | G | G | G | G | G | G | G |
| | 48 | G | G | G | G | G | G | G | G | G | G | G | G | G | G | G | G | G | G | G | G | P | G | G | G | G |
| | 49 | G | G | G | G | G | G | G | G | G | G | G | G | G | G | G | G | G | G | G | G | G | G | G | G | G |
| | 50 | G | G | P | P | G | P | G | P | G | G | G | P | G | G | G | G | G | G | G | G | P | P | P | G | G |
| | 51 | G | G | G | G | G | G | G | G | G | G | G | G | G | G | G | G | G | G | G | P | G | G | G | G | G |
| | 52 | G | G | G | G | G | G | G | G | G | G | G | G | G | P | G | G | G | G | G | G | G | G | G | G | G |
| | 53 | G | G | G | G | G | G | G | G | G | P | G | G | G | G | G | G | G | G | G | G | G | G | G | G | G |
| | 54 | G | G | G | P | G | G | G | G | G | G | G | G | G | G | G | G | G | G | G | G | G | G | G | G | G |
| | 55 | G | G | G | G | G | G | G | G | G | G | G | G | G | G | G | G | G | G | G | G | G | G | G | G | G |
| | 56 | G | G | G | G | G | G | G | G | G | G | G | G | G | G | G | G | G | G | G | G | G | G | G | G | G |
| | 57 | G | G | G | G | G | G | G | G | G | G | G | G | G | G | G | G | G | G | G | G | G | G | G | G | G |
| | 58 | G | G | G | G | G | G | G | G | G | G | G | G | G | G | G | G | G | G | G | G | G | G | G | G | G |
| | 59 | G | G | G | G | G | G | G | G | G | G | G | G | G | G | G | G | G | G | G | G | G | G | G | G | G |
| | 60 | G | G | G | G | G | G | G | G | G | P | G | G | G | G | G | G | G | G | G | G | G | G | G | G | G |
| | 61 | G | G | G | G | G | G | G | G | G | G | G | G | G | G | G | G | P | G | G | G | G | G | G | G | G |

TABLE 10-continued

| | | | | | | | | | | | | | | | | | | | | | | | | | |
|---|---|---|---|---|---|---|---|---|---|---|---|---|---|---|---|---|---|---|---|---|---|---|---|---|---|
| Chip treatability | | | | | | | | | | | | | | | | | | | | | | | | | |
| | 62 | G | G | G | G | G | G | G | G | G | G | G | G | G | G | G | G | G | G | G | G | G | G | G | G |
| | 63 | G | G | G | G | G | G | G | G | G | G | G | G | G | G | G | G | G | G | G | G | G | G | G | G |
| | 64 | G | G | G | G | G | G | G | G | G | G | G | G | G | G | G | G | G | G | G | G | G | G | G | G |
| | 65 | G | G | G | G | G | G | G | G | G | G | G | G | G | G | G | G | G | G | G | G | G | G | G | G |
| | 66 | G | G | G | G | G | G | G | G | G | G | G | G | G | G | G | G | G | G | G | G | G | G | G | G |
| | 67 | G | G | G | G | G | G | G | G | G | G | G | G | G | G | G | G | G | G | G | G | G | G | G | G |
| | 68 | G | G | G | G | G | G | G | G | G | G | G | G | G | G | G | G | G | G | G | G | G | G | G | G |
| | 69 | E | E | E | E | E | E | E | E | E | E | E | E | E | E | E | E | E | E | E | E | E | E | E | E |
| | 70 | E | E | E | E | E | E | E | E | E | E | E | E | E | E | E | E | E | E | E | E | E | E | E | E |
| | 71 | E | E | E | E | E | E | E | E | E | E | E | E | E | E | E | E | E | E | E | E | E | E | E | E |
| | 72 | E | E | E | E | E | E | E | E | E | E | E | E | E | E | E | E | E | E | E | E | E | E | E | E |
| | 73 | G | G | G | G | G | G | G | G | G | G | G | G | G | G | G | G | G | G | G | G | G | G | G | G |
| | 74 | G | G | G | G | G | G | G | G | G | G | G | G | G | G | G | G | G | G | G | G | G | G | G | G |
| | 75 | G | G | G | G | P | G | G | G | G | P | G | G | G | G | G | G | P | P | G | G | G | G | G | G |
| Insert material | | 2 | 2 | 2 | 2 | 2 | 2 | 2 | 3 | 3 | 3 | 3 | 3 | 3 | 3 | 3 | 3 | 3 | 3 | 3 | 3 | 3 | 3 | 3 | 3 |
| Cutting speed | | 2 | 2 | 2 | 2 | 2 | 2 | 2 | 1 | 1 | 1 | 1 | 1 | 1 | 1 | 1 | 2 | 2 | 2 | 2 | 2 | 2 | 2 | 2 |
| Feed rate | | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 |
| Cutting depth | | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 |
| Lubricant | | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| Test sample No. | 38 | G | G | G | G | G | G | G | G | G | G | G | G | G | G | G | G | G | G | G | G | G | G | G | G |
| | 39 | G | G | G | G | G | G | G | G | G | G | G | G | G | G | G | G | G | G | G | G | G | G | G | G |
| | 40 | G | G | G | G | G | G | G | G | G | G | G | G | G | G | G | G | G | G | G | G | G | G | G | G |
| | 41 | G | G | G | G | G | G | G | G | G | G | G | G | G | G | G | G | G | G | G | G | G | G | G | G |
| | 42 | G | G | G | G | G | G | G | G | G | G | G | G | G | G | G | G | G | G | G | G | G | G | G | G |
| | 43 | G | G | G | G | G | G | G | G | G | G | G | G | G | G | G | G | G | G | G | G | G | G | G | G |
| | 44 | G | G | G | G | G | G | G | G | G | G | G | G | G | G | G | G | G | G | G | G | G | G | G | G |
| | 45 | G | G | G | G | G | G | G | G | G | G | G | G | G | G | G | G | G | G | G | G | G | G | G | G |
| | 46 | G | G | G | G | G | G | G | G | G | G | G | G | G | G | G | G | G | G | G | G | G | G | G | G |
| | 47 | G | G | G | G | G | G | G | G | G | G | G | G | G | G | G | G | G | P | G | G | G | G | G | G |
| | 48 | G | G | G | G | G | G | G | G | G | G | G | G | G | G | G | G | G | G | G | G | G | G | G | G |
| | 49 | G | G | P | G | G | G | G | G | G | G | G | G | G | G | G | G | G | G | G | G | G | G | G | G |
| | 50 | G | P | P | P | G | G | G | G | P | P | G | G | G | G | P | G | G | G | P | G | G | G | G | G |
| | 51 | G | G | G | G | G | G | G | G | G | G | G | P | G | G | G | G | G | G | G | G | G | G | G | G |
| | 52 | G | G | G | G | G | G | G | G | G | G | G | G | G | G | G | G | G | G | G | P | G | G | G | G |
| | 53 | G | G | G | G | G | G | G | G | G | G | G | G | G | G | G | G | G | G | G | G | G | G | G | G |
| | 54 | G | G | G | G | G | G | G | G | G | G | G | G | G | G | G | G | G | G | G | G | G | G | G | G |
| | 55 | G | G | G | G | G | G | G | G | G | G | G | G | G | G | G | G | P | G | G | G | G | G | G | G |
| | 56 | G | G | G | G | G | G | G | G | G | G | G | G | G | G | G | G | G | G | G | G | G | G | G | G |
| | 57 | G | G | G | G | G | G | G | G | G | G | G | G | G | G | G | G | G | G | G | G | G | G | G | G |
| | 58 | G | G | G | G | G | G | G | G | G | G | G | G | G | G | G | G | G | G | G | G | G | G | G | G |
| | 59 | G | G | G | G | G | G | G | G | G | G | G | G | G | G | G | G | P | G | G | G | G | G | G | G |
| | 60 | G | G | G | G | G | G | G | G | G | G | G | G | G | G | G | G | G | G | G | G | G | G | G | G |
| | 61 | G | G | G | G | G | G | G | G | G | G | G | G | G | G | G | G | G | G | G | G | G | G | G | G |
| | 62 | G | G | G | G | G | G | G | G | G | G | G | G | G | G | G | G | G | G | P | G | G | G | G | G |
| | 63 | G | G | G | G | G | G | G | G | G | G | G | G | G | G | G | G | G | G | G | G | G | G | G | G |
| | 64 | G | G | G | G | G | P | G | G | G | G | G | G | G | G | G | G | G | G | G | G | G | G | G | G |
| | 65 | G | G | G | G | G | G | G | G | G | G | G | G | G | G | G | G | G | G | G | G | G | G | G | G |
| | 66 | G | G | G | G | G | G | G | G | G | G | G | G | G | G | G | G | G | G | G | G | G | G | G | G |
| | 67 | G | G | G | G | G | G | G | G | G | G | G | G | G | G | G | G | G | G | G | G | G | G | G | G |
| | 68 | G | G | G | G | G | G | G | G | G | G | G | G | G | G | G | G | G | G | G | G | G | G | G | G |
| | 69 | E | E | E | E | E | E | E | E | E | E | E | E | E | E | E | E | E | E | E | E | E | E | E | E |
| | 70 | E | E | E | E | E | E | E | E | E | E | E | E | E | E | E | E | E | E | E | E | E | E | E | E |
| | 71 | E | E | E | E | E | E | E | E | E | E | E | E | E | E | E | E | E | E | E | E | E | E | E | E |
| | 72 | E | E | E | E | E | E | E | E | E | E | E | E | E | E | E | E | E | E | E | E | E | E | E | E |
| | 73 | G | G | G | G | G | G | G | G | G | G | G | G | G | G | G | G | G | G | G | G | G | G | G | G |
| | 74 | G | G | G | G | G | P | G | G | G | G | G | G | G | G | G | G | G | G | G | G | G | G | G | G |
| | 75 | G | G | G | G | G | G | G | G | G | G | P | P | G | G | G | G | G | G | G | G | G | G | G | G |

TABLE 10-continued

| | | Chip treatability | | | | | | | | | | | | | | | |
|---|---|---|---|---|---|---|---|---|---|---|---|---|---|---|---|---|---|
| | | Insert material | | | | | | | | | | | | | | | |
| | | 4 | 4 | 4 | 4 | 4 | 4 | 4 | 4 | 4 | 4 | 4 | 4 | 4 | 4 | 4 | 4 |
| | | Cutting speed | | | | | | | | | | | | | | | |
| | | 1 | 1 | 1 | 1 | 1 | 1 | 1 | 1 | 2 | 2 | 2 | 2 | 2 | 2 | 2 | 2 |
| | | Feed rate | | | | | | | | | | | | | | | |
| | | 1 | 1 | 1 | 1 | 2 | 2 | 2 | 2 | 1 | 1 | 1 | 1 | 2 | 2 | 2 | 2 |
| | | Cutting depth | | | | | | | | | | | | | | | |
| | | 1 | 1 | 2 | 2 | 1 | 1 | 2 | 2 | 1 | 1 | 2 | 2 | 1 | 1 | 2 | 2 |
| | | Lubricant | | | | | | | | | | | | | | | |
| | | 1 | 2 | 1 | 2 | 1 | 2 | 1 | 2 | 1 | 2 | 1 | 2 | 1 | 2 | 1 | 2 |
| Test sample No. | 38 | G | G | G | G | G | G | G | G | G | G | G | G | G | G | G | G |
| | 39 | G | G | G | G | G | G | G | G | G | G | G | G | G | G | G | G |
| | 40 | G | G | G | G | G | G | G | G | G | G | G | G | G | G | G | G |
| | 41 | G | G | G | G | G | G | G | G | G | G | G | G | G | G | G | G |
| | 42 | G | G | G | G | G | G | G | G | G | G | G | G | G | G | G | G |
| | 43 | G | G | G | G | G | G | G | G | G | G | G | G | G | G | G | G |
| | 44 | G | G | G | G | G | G | G | G | G | G | G | G | G | G | G | G |
| | 45 | G | G | G | G | G | G | G | G | G | G | G | G | G | G | G | G |
| | 46 | G | G | G | G | G | G | G | G | G | G | G | G | G | G | G | G |
| | 47 | G | G | G | G | G | G | G | G | G | G | G | G | G | G | G | G |
| | 48 | G | G | G | G | G | G | G | G | G | G | P | G | G | G | G | G |
| | 49 | G | P | G | G | G | G | G | G | G | G | G | G | G | G | G | G |
| | 50 | G | G | G | P | P | P | G | P | P | P | G | G | P | P | G | G |
| | 51 | G | G | G | G | G | G | G | G | G | G | G | G | G | G | G | G |
| | 52 | G | G | G | G | G | G | G | G | G | G | G | G | G | G | G | G |
| | 53 | G | G | G | G | G | G | G | G | G | G | G | G | G | G | G | G |
| | 54 | G | G | G | G | G | G | G | G | G | G | G | G | G | G | G | G |
| | 55 | G | G | G | G | G | G | G | G | G | G | G | G | G | G | G | G |
| | 56 | G | P | G | G | G | G | G | G | G | G | G | G | G | G | G | G |
| | 57 | G | P | G | G | G | G | G | G | G | G | G | G | G | G | G | G |
| | 58 | G | G | G | G | P | G | G | G | G | G | G | G | G | G | G | G |
| | 59 | G | G | G | G | G | G | G | G | G | G | G | G | G | G | G | G |
| | 60 | G | G | G | G | G | G | G | G | G | G | G | G | G | G | G | G |
| | 61 | G | G | G | G | G | G | G | G | G | G | G | G | G | G | G | G |
| | 62 | G | G | G | G | G | G | G | G | G | G | G | G | G | G | G | G |
| | 63 | G | P | G | G | G | G | G | G | G | G | G | G | G | G | G | G |
| | 64 | G | G | G | G | G | G | G | G | G | G | G | G | G | G | G | G |
| | 65 | G | G | G | G | G | G | G | G | G | G | G | G | G | G | G | G |
| | 66 | G | G | G | G | G | G | G | G | G | G | G | G | G | G | G | G |
| | 67 | G | G | G | G | G | G | G | G | G | G | G | G | G | G | G | G |
| | 68 | G | G | G | G | G | G | G | G | G | G | G | G | G | G | G | G |
| | 69 | E | E | E | E | E | E | E | E | E | E | E | E | E | E | E | E |
| | 70 | E | E | E | E | E | E | E | E | E | E | E | E | E | E | E | E |
| | 71 | E | E | E | E | E | E | E | E | E | E | E | E | E | E | E | E |
| | 72 | E | E | E | E | E | E | E | E | E | E | E | E | E | E | E | E |
| | 73 | G | G | G | G | G | G | G | G | G | G | G | G | G | G | G | G |
| | 74 | G | G | G | G | G | G | G | G | G | G | G | G | G | G | G | G |
| | 75 | G | G | P | G | G | G | G | P | G | G | G | G | G | G | G | P |

* E: Excellent, G: Good, P: Poor

Example 2

Wire rods were produced under the same conditions as in the foregoing Example 1, except that wiredrawing was performed after the hot rolling. The average cooling rate in a temperature range of 500° C. to 300° C. after the hot rolling and the area reduction rate in the wiredrawing in this production process are listed in Tables 11 and 12.

For each of the obtained wire rods (wiredrawn wires), the average hardness $H_{ave}$ and the hardness standard deviation $H_{\sigma}$ were evaluated by the foregoing measurement methods. The results are listed in Tables 11 and 12.

TABLE 11

| | | Production conditions | | Measurement results | | | |
|---|---|---|---|---|---|---|---|
| Test sample No. | Steel sample No. | Average cooling rate (° C./s) | Area reduction rate (%) | Average hardness $H_{ave}$ | Hardness standard deviation $H_{\sigma}$ | Aspect ratio | Remarks |
| 76 | 1 | 0.34 | 53 | 160 | 10 | 4.5 | Ex. |
| 77 | 2 | 0.48 | 49 | 288 | 15 | 4.7 | Ex. |

TABLE 11-continued

| Test sample No. | Steel sample No. | Production conditions: Average cooling rate (° C./s) | Production conditions: Area reduction rate (%) | Measurement results: Average hardness $H_{ave}$ | Measurement results: Hardness standard deviation $H_{\sigma}$ | Measurement results: Aspect ratio | Remarks |
|---|---|---|---|---|---|---|---|
| 78 | 3 | 0.31 | 53 | 288 | 28 | 3.1 | Ex. |
| 79 | 4 | 0.43 | 49 | 287 | 14 | 4.5 | Ex. |
| 80 | 5 | 0.38 | 36 | 209 | 15 | 3.9 | Ex. |
| 81 | 6 | 0.54 | 44 | 181 | 29 | 3.7 | Ex. |
| 82 | 7 | 0.44 | 58 | 283 | 22 | 5.6 | Ex. |
| 83 | 8 | 0.49 | 46 | 223 | 18 | 4.6 | Ex. |
| 84 | 9 | 0.40 | 37 | 218 | 20 | 4.3 | Ex. |
| 85 | 10 | 0.60 | 54 | 151 | 16 | 4.0 | Ex. |
| 86 | 11 | 0.36 | 45 | 195 | 11 | 2.9 | Ex. |
| 87 | 12 | 0.46 | 60 | 256 | 23 | 4.9 | Ex. |
| 88 | 13 | 0.48 | 43 | 225 | 28 | 2.9 | Ex. |
| 89 | 14 | 0.37 | 55 | 274 | 20 | 5.0 | Ex. |
| 90 | 15 | 0.57 | 45 | 232 | 24 | 4.3 | Ex. |
| 91 | 16 | 0.50 | 38 | 162 | 29 | 2.9 | Ex. |
| 92 | 17 | 0.40 | 38 | 288 | 28 | 3.6 | Ex. |
| 93 | 18 | 0.38 | 40 | 285 | 28 | 4.5 | Ex. |
| 94 | 19 | 0.36 | 52 | 172 | 23 | 2.9 | Ex. |
| 95 | 20 | 0.59 | 59 | 298 | 14 | 5.6 | Ex. |
| 96 | 21 | 0.43 | 58 | 151 | 20 | 4.7 | Ex. |
| 97 | 22 | 0.54 | 49 | 232 | 21 | 4.6 | Ex. |
| 98 | 23 | 0.33 | 47 | 229 | 17 | 4.1 | Ex. |
| 99 | 24 | 0.46 | 50 | 219 | 19 | 2.9 | Ex. |
| 100 | 25 | 0.45 | 40 | 182 | 24 | 2.9 | Ex. |
| 101 | 26 | 0.53 | 50 | 151 | 15 | 4.3 | Ex. |
| 102 | 27 | 0.47 | 37 | 230 | 16 | 2.3 | Ex. |
| 103 | 28 | 0.54 | 40 | 164 | 27 | 3.5 | Ex. |
| 104 | 29 | 0.56 | 44 | 188 | 11 | 4.5 | Ex. |
| 105 | 30 | 0.56 | 48 | 210 | 13 | 3.5 | Ex. |
| 106 | 31 | 0.31 | 41 | 243 | 13 | 4.7 | Ex. |
| 107 | 32 | 0.57 | 49 | 292 | 29 | 3.0 | Ex. |
| 108 | 33 | 0.54 | 51 | 294 | 28 | 4.5 | Ex. |
| 109 | 34 | 0.57 | 59 | 279 | 15 | 5.6 | Ex. |
| 110 | 35 | 0.37 | 53 | 288 | 27 | 4.0 | Ex. |
| 111 | 36 | 0.37 | 35 | 159 | 16 | 4.2 | Ex. |
| 112 | 37 | 0.40 | 45 | 191 | 21 | 3.2 | Ex. |
| 113 | 38 | 0.40 | 49 | 219 | 11 | 3.2 | Ex. |

TABLE 12

| Test sample No. | Steel sample No. | Production conditions: Average cooling rate (° C./s) | Production conditions: Area reduction rate (%) | Measurement results: Average hardness $H_{ave}$ | Measurement results: Hardness standard deviation $H_{\sigma}$ | Measurement results: Aspect ratio | Remarks |
|---|---|---|---|---|---|---|---|
| 114 | 39 | 0.36 | 56 | 272 | 29 | 3.1 | Ex. |
| 115 | 40 | 0.57 | 60 | 274 | 15 | 3.8 | Ex. |
| 116 | 41 | 0.47 | 52 | 219 | 18 | 3.0 | Ex. |
| 117 | 42 | 0.44 | 44 | 267 | 21 | 4.7 | Ex. |
| 118 | 43 | 0.56 | 45 | 150 | 24 | 4.4 | Ex. |
| 119 | 44 | 0.51 | 52 | 235 | 13 | 4.1 | Ex. |
| 120 | 45 | 0.48 | 44 | 169 | 21 | 2.9 | Ex. |
| 121 | 46 | 0.43 | 38 | 286 | 17 | 3.2 | Ex. |
| 122 | 47 | 0.42 | 42 | 378 | 29 | 3.1 | Comp. Ex. |
| 123 | 48 | 0.34 | 54 | 358 | 32 | 3.7 | Comp. Ex. |
| 124 | 49 | 0.38 | 36 | 203 | 17 | 3.3 | Comp. Ex. |
| 125 | 50 | 0.54 | 58 | 164 | 30 | 3.8 | Comp. Ex. |
| 126 | 51 | 0.38 | 46 | 366 | 36 | 3.0 | Comp. Ex. |
| 127 | 52 | 0.31 | 36 | 261 | 11 | 4.1 | Comp. Ex. |
| 128 | 1 | 1.15 | 52 | 201 | 39 | 4.2 | Comp. Ex. |
| 129 | 2 | 1.35 | 48 | 314 | 40 | 2.9 | Comp. Ex. |
| 130 | 3 | 0.84 | 41 | 182 | 33 | 4.3 | Comp. Ex. |
| 131 | 4 | 0.81 | 48 | 209 | 31 | 5.2 | Comp. Ex. |
| 132 | 5 | 0.88 | 57 | 206 | 31 | 4.7 | Comp. Ex. |
| 133 | 16 | 0.93 | 40 | 275 | 38 | 2.9 | Comp. Ex. |
| 134 | 17 | 0.79 | 46 | 184 | 31 | 3.2 | Comp. Ex. |
| 135 | 18 | 0.88 | 36 | 162 | 39 | 3.3 | Comp. Ex. |
| 136 | 19 | 0.86 | 44 | 219 | 35 | 4.7 | Comp. Ex. |

TABLE 12-continued

| Test sample No. | Steel sample No. | Production conditions: Average cooling rate (° C./s) | Production conditions: Area reduction rate (%) | Measurement results: Average hardness $H_{ave}$ | Measurement results: Hardness standard deviation $H_{\sigma}$ | Measurement results: Aspect ratio | Remarks |
|---|---|---|---|---|---|---|---|
| 137 | 20 | 0.89 | 56 | 152 | 36 | 4.7 | Comp. Ex. |
| 138 | 21 | 0.82 | 58 | 233 | 32 | 3.5 | Comp. Ex. |
| 139 | 22 | 0.76 | 39 | 151 | 37 | 2.9 | Comp. Ex. |
| 140 | 5 | 0.38 | 70 | 361 | 33 | 8.3 | Comp. Ex. |
| 141 | 53 | 0.48 | 51 | 268 | 19 | 5.1 | Ex. |
| 142 | 54 | 0.41 | 38 | 219 | 16 | 3.9 | Ex. |
| 143 | 55 | 0.59 | 42 | 180 | 25 | 4.2 | Ex. |
| 144 | 56 | 0.36 | 55 | 180 | 20 | 5.9 | Ex. |
| 145 | 57 | 0.44 | 41 | 222 | 19 | 4.3 | Ex. |
| 146 | 58 | 0.44 | 39 | 218 | 25 | 4.5 | Ex. |
| 147 | 59 | 0.37 | 54 | 211 | 26 | 4.0 | Ex. |
| 148 | 60 | 0.59 | 45 | 198 | 11 | 3.0 | Ex. |
| 149 | 61 | 0.51 | 65 | 245 | 26 | 4.8 | Ex. |
| 150 | 62 | 0.49 | 48 | 220 | 21 | 3.1 | Comp. Ex. |
| 151 | 63 | 0.54 | 50 | 216 | 33 | 4.4 | Comp. Ex. |

Next, for each of the obtained wire rods, the tool life, the surface roughness after cutting, and the chip treatability were evaluated by the same methods as in Example 1. The evaluation results are listed in Tables 13 to 18.

As can be understood from the results in Tables 13 to 18, Examples (Ex.) satisfying the conditions according to the present disclosure had superior machinability by cutting regardless of conditions such as the type of cutting tool and the type of lubricant used.

TABLE 13

| | | Tool life | | | | | | | | | | | | | | | | | | | | | | | |
|---|---|---|---|---|---|---|---|---|---|---|---|---|---|---|---|---|---|---|---|---|---|---|---|---|---|
| | | Insert material | | | | | | | | | | | | | | | | | | | | | | | |
| | | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 |
| | | Cutting speed | | | | | | | | | | | | | | | | | | | | | | | |
| | | 1 | 1 | 1 | 1 | 1 | 1 | 1 | 1 | 2 | 2 | 2 | 2 | 2 | 2 | 2 | 2 | 1 | 1 | 1 | 1 | 1 | 1 | 1 | 1 | 2 |
| | | Feed rate | | | | | | | | | | | | | | | | | | | | | | | |
| | | 1 | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 1 |
| | | Cutting depth | | | | | | | | | | | | | | | | | | | | | | | |
| | | 1 | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | 1 |
| | | Lubricant | | | | | | | | | | | | | | | | | | | | | | | |
| | | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 |
| Test sample No. | 76 | G | G | G | G | G | G | G | G | G | G | G | G | G | G | G | G | G | G | G | G | G | G | G | G | G |
| | 77 | G | G | G | G | G | G | G | G | G | G | G | G | G | G | G | G | G | G | G | G | G | G | G | G | G |
| | 78 | G | G | G | G | G | G | G | G | G | G | G | G | G | G | G | G | G | G | G | G | G | G | G | G | G |
| | 79 | G | G | G | G | G | G | G | G | G | G | G | G | G | G | G | G | G | G | G | G | G | G | G | G | G |
| | 80 | G | G | G | G | G | G | G | G | G | G | G | G | G | G | G | G | G | G | G | G | G | G | G | G | G |
| | 81 | G | G | G | G | G | G | G | G | G | G | G | G | G | G | G | G | G | G | G | G | G | G | G | G | G |
| | 82 | G | G | G | G | G | G | G | G | G | G | G | G | G | G | G | G | G | G | G | G | G | G | G | G | G |
| | 83 | G | G | G | G | G | G | G | G | G | G | G | G | G | G | G | G | G | G | G | G | G | G | G | G | G |
| | 84 | G | G | G | G | G | G | G | G | G | G | G | G | G | G | G | G | G | G | G | G | G | G | G | G | G |
| | 85 | G | G | G | G | G | G | G | G | G | G | G | G | G | G | G | G | G | G | G | G | G | G | G | G | G |
| | 86 | G | G | G | G | G | G | G | G | G | G | G | G | G | G | G | G | G | G | G | G | G | G | G | G | G |
| | 87 | G | G | G | G | G | G | G | G | G | G | G | G | G | G | G | G | G | G | G | G | G | G | G | G | G |
| | 88 | G | G | G | G | G | G | G | G | G | G | G | G | G | G | G | G | G | G | G | G | G | G | G | G | G |
| | 89 | G | G | G | G | G | G | G | G | G | G | G | G | G | G | G | G | G | G | G | G | G | G | G | G | G |
| | 90 | G | G | G | G | G | G | G | G | G | G | G | G | G | G | G | G | G | G | G | G | G | G | G | G | G |
| | 91 | G | G | G | G | G | G | G | G | G | G | G | G | G | G | G | G | G | G | G | G | G | G | G | G | G |
| | 92 | G | G | G | G | G | G | G | G | G | G | G | G | G | G | G | G | G | G | G | G | G | G | G | G | G |
| | 93 | G | G | G | G | G | G | G | G | G | G | G | G | G | G | G | G | G | G | G | G | G | G | G | G | G |
| | 94 | G | G | G | G | G | G | G | G | G | G | G | G | G | G | G | G | G | G | G | G | G | G | G | G | G |
| | 95 | G | G | G | G | G | G | G | G | G | G | G | G | G | G | G | G | G | G | G | G | G | G | G | G | G |
| | 96 | G | G | G | G | G | G | G | G | G | G | G | G | G | G | G | G | G | G | G | G | G | G | G | G | G |
| | 97 | G | G | G | G | G | G | G | G | G | G | G | G | G | G | G | G | G | G | G | G | G | G | G | G | G |

TABLE 13-continued

| | | Tool life | | | | | | | | | | | | | | | | | | | | | | | |
|---|---|---|---|---|---|---|---|---|---|---|---|---|---|---|---|---|---|---|---|---|---|---|---|---|---|
| | 98 | G | G | G | G | G | G | G | G | G | G | G | G | G | G | G | G | G | G | G | G | G | G | G | G |
| | 99 | G | G | G | G | G | G | G | G | G | G | G | G | G | G | G | G | G | G | G | G | G | G | G | G |
| | 100 | G | G | G | G | G | G | G | G | G | G | G | G | G | G | G | G | G | G | G | G | G | G | G | G |
| | 101 | G | G | G | G | G | G | G | G | G | G | G | G | G | G | G | G | G | G | G | G | G | G | G | G |
| | 102 | G | G | G | G | G | G | G | G | G | G | G | G | G | G | G | G | G | G | G | G | G | G | G | G |
| | 103 | G | G | G | G | G | G | G | G | G | G | G | G | G | G | G | G | G | G | G | G | G | G | G | G |
| | 104 | G | G | G | G | G | G | G | G | G | G | G | G | G | G | G | G | G | G | G | G | G | G | G | G |
| | 105 | G | G | G | G | G | G | G | G | G | G | G | G | G | G | G | G | G | G | G | G | G | G | G | G |
| | 106 | G | G | G | G | G | G | G | G | G | G | G | G | G | G | G | G | G | G | G | G | G | G | G | G |
| | 107 | G | G | G | G | G | G | G | G | G | G | G | G | G | G | G | G | G | G | G | G | G | G | G | G |
| | 108 | G | G | G | G | G | G | G | G | G | G | G | G | G | G | G | G | G | G | G | G | G | G | G | G |
| | 109 | G | G | G | G | G | G | G | G | G | G | G | G | G | G | G | G | G | G | G | G | G | G | G | G |
| | 110 | G | G | G | G | G | G | G | G | G | G | G | G | G | G | G | G | G | G | G | G | G | G | G | G |
| | 111 | G | G | G | G | G | G | G | G | G | G | G | G | G | G | G | G | G | G | G | G | G | G | G | G |
| | 112 | G | G | G | G | G | G | G | G | G | G | G | G | G | G | G | G | G | G | G | G | G | G | G | G |
| | 113 | G | G | G | G | G | G | G | G | G | G | G | G | G | G | G | G | G | G | G | G | G | G | G | G |
| | | Insert material | | | | | | | | | | | | | | | | | | | | | | | |
| | | 2 | 2 | 2 | 2 | 2 | 2 | 2 | 3 | 3 | 3 | 3 | 3 | 3 | 3 | 3 | 3 | 3 | 3 | 3 | 3 | 3 | 3 | 3 | 3 |
| | | Cutting speed | | | | | | | | | | | | | | | | | | | | | | | |
| | | 2 | 2 | 2 | 2 | 2 | 2 | 2 | 1 | 1 | 1 | 1 | 1 | 1 | 1 | 1 | 2 | 2 | 2 | 2 | 2 | 2 | 2 | 2 | 2 |
| | | Feed rate | | | | | | | | | | | | | | | | | | | | | | | |
| | | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 2 |
| | | Cutting depth | | | | | | | | | | | | | | | | | | | | | | | |
| | | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | 2 |
| | | Lubricant | | | | | | | | | | | | | | | | | | | | | | | |
| | | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 2 |
| Test sample No. | 76 | G | G | G | G | G | G | G | G | G | G | G | G | G | G | G | G | G | G | G | G | G | G | G | G |
| | 77 | G | G | G | G | G | G | G | G | G | G | G | G | G | G | G | G | G | G | G | G | G | G | G | G |
| | 78 | G | G | G | G | G | G | G | G | G | G | G | G | G | G | G | G | G | G | G | G | G | G | G | G |
| | 79 | G | G | G | G | G | G | G | G | G | G | G | G | G | G | G | G | G | G | G | G | G | G | G | G |
| | 80 | G | G | G | G | G | G | G | G | G | G | G | G | G | G | G | G | G | G | G | G | G | G | G | G |
| | 81 | G | G | G | G | G | G | G | G | G | G | G | G | G | G | G | G | G | G | G | G | G | G | G | G |
| | 82 | G | G | G | G | G | G | G | G | G | G | G | G | G | G | G | G | G | G | G | G | G | G | G | G |
| | 83 | G | G | G | G | G | G | G | G | G | G | G | G | G | G | G | G | G | G | G | G | G | G | G | G |
| | 84 | G | G | G | G | G | G | G | G | G | G | G | G | G | G | G | G | G | G | G | G | G | G | G | G |
| | 85 | G | G | G | G | G | G | G | G | G | G | G | G | G | G | G | G | G | G | G | G | G | G | G | G |
| | 86 | G | G | G | G | G | G | G | G | G | G | G | G | G | G | G | G | G | G | G | G | G | G | G | G |
| | 87 | G | G | G | G | G | G | G | G | G | G | G | G | G | G | G | G | G | G | G | G | G | G | G | G |
| | 88 | G | G | G | G | G | G | G | G | G | G | G | G | G | G | G | G | G | G | G | G | G | G | G | G |
| | 89 | G | G | G | G | G | G | G | G | G | G | G | G | G | G | G | G | G | G | G | G | G | G | G | G |
| | 90 | G | G | G | G | G | G | G | G | G | G | G | G | G | G | G | G | G | G | G | G | G | G | G | G |
| | 91 | G | G | G | G | G | G | G | G | G | G | G | G | G | G | G | G | G | G | G | G | G | G | G | G |
| | 92 | G | G | G | G | G | G | G | G | G | G | G | G | G | G | G | G | G | G | G | G | G | G | G | G |
| | 93 | G | G | G | G | G | G | G | G | G | G | G | G | G | G | G | G | G | G | G | G | G | G | G | G |
| | 94 | G | G | G | G | G | G | G | G | G | G | G | G | G | G | G | G | G | G | G | G | G | G | G | G |
| | 95 | G | G | G | G | G | G | G | G | G | G | G | G | G | G | G | G | G | G | G | G | G | G | G | G |
| | 96 | G | G | G | G | G | G | G | G | G | G | G | G | G | G | G | G | G | G | G | G | G | G | G | G |
| | 97 | G | G | G | G | G | G | G | G | G | G | G | G | G | G | G | G | G | G | G | G | G | G | G | G |
| | 98 | G | G | G | G | G | G | G | G | G | G | G | G | G | G | G | G | G | G | G | G | G | G | G | G |
| | 99 | G | G | G | G | G | G | G | G | G | G | G | G | G | G | G | G | G | G | G | G | G | G | G | G |
| | 100 | G | G | G | G | G | G | G | G | G | G | G | G | G | G | G | G | G | G | G | G | G | G | G | G |
| | 101 | G | G | G | G | G | G | G | G | G | G | G | G | G | G | G | G | G | G | G | G | G | G | G | G |
| | 102 | G | G | G | G | G | G | G | G | G | G | G | G | G | G | G | G | G | G | G | G | G | G | G | G |
| | 103 | G | G | G | G | G | G | G | G | G | G | G | G | G | G | G | G | G | G | G | G | G | G | G | G |
| | 104 | G | G | G | G | G | G | G | G | G | G | G | G | G | G | G | G | G | G | G | G | G | G | G | G |
| | 105 | G | G | G | G | G | G | G | G | G | G | G | G | G | G | G | G | G | G | G | G | G | G | G | G |
| | 106 | G | G | G | G | G | G | G | G | G | G | G | G | G | G | G | G | G | G | G | G | G | G | G | G |
| | 107 | G | G | G | G | G | G | G | G | G | G | G | G | G | G | G | G | G | G | G | G | G | G | G | G |
| | 108 | G | G | G | G | G | G | G | G | G | G | G | G | G | G | G | G | G | G | G | G | G | G | G | G |

TABLE 13-continued

| | | | | | | | | | | | | | | | | | | | | | | | |
|---|---|---|---|---|---|---|---|---|---|---|---|---|---|---|---|---|---|---|---|---|---|---|---|
| Tool life | | | | | | | | | | | | | | | | | | | | | | | |
| | 109 | G | G | G | G | G | G | G | G | G | G | G | G | G | G | G | G | G | G | G | G | G | G |
| | 110 | G | G | G | G | G | G | G | G | G | G | G | G | G | G | G | G | G | G | G | G | G | G |
| | 111 | G | G | G | G | G | G | G | G | G | G | G | G | G | G | G | G | G | G | G | G | G | G |
| | 112 | G | G | G | G | G | G | G | G | G | G | G | G | G | G | G | G | G | G | G | G | G | G |
| | 113 | G | G | G | G | G | G | G | G | G | G | G | G | G | G | G | G | G | G | G | G | G | G |
| Insert material | | 4 | 4 | 4 | 4 | 4 | 4 | 4 | 4 | 4 | 4 | 4 | 4 | 4 | 4 | 4 | 4 |
| Cutting speed | | 1 | 1 | 1 | 1 | 1 | 1 | 1 | 1 | 2 | 2 | 2 | 2 | 2 | 2 | 2 | 2 |
| Feed rate | | 1 | 1 | 1 | 1 | 2 | 2 | 2 | 2 | 1 | 1 | 1 | 1 | 2 | 2 | 2 | 2 |
| Cutting depth | | 1 | 1 | 2 | 2 | 1 | 1 | 2 | 2 | 1 | 1 | 2 | 2 | 1 | 1 | 2 | 2 |
| Lubricant | | 1 | 2 | 1 | 2 | 1 | 2 | 1 | 2 | 1 | 2 | 1 | 2 | 1 | 2 | 1 | 2 |
| Test sample No. | 76 | G | G | G | G | G | G | G | G | G | G | G | G | G | G | G | G |
| | 77 | G | G | G | G | G | G | G | G | G | G | G | G | G | G | G | G |
| | 78 | G | G | G | G | G | G | G | G | G | G | G | G | G | G | G | G |
| | 79 | G | G | G | G | G | G | G | G | G | G | G | G | G | G | G | G |
| | 80 | G | G | G | G | G | G | G | G | G | G | G | G | G | G | G | G |
| | 81 | G | G | G | G | G | G | G | G | G | G | G | G | G | G | G | G |
| | 82 | G | G | G | G | G | G | G | G | G | G | G | G | G | G | G | G |
| | 83 | G | G | G | G | G | G | G | G | G | G | G | G | G | G | G | G |
| | 84 | G | G | G | G | G | G | G | G | G | G | G | G | G | G | G | G |
| | 85 | G | G | G | G | G | G | G | G | G | G | G | G | G | G | G | G |
| | 86 | G | G | G | G | G | G | G | G | G | G | G | G | G | G | G | G |
| | 87 | G | G | G | G | G | G | G | G | G | G | G | G | G | G | G | G |
| | 88 | G | G | G | G | G | G | G | G | G | G | G | G | G | G | G | G |
| | 89 | G | G | G | G | G | G | G | G | G | G | G | G | G | G | G | G |
| | 90 | G | G | G | G | G | G | G | G | G | G | G | G | G | G | G | G |
| | 91 | G | G | G | G | G | G | G | G | G | G | G | G | G | G | G | G |
| | 92 | G | G | G | G | G | G | G | G | G | G | G | G | G | G | G | G |
| | 93 | G | G | G | G | G | G | G | G | G | G | G | G | G | G | G | G |
| | 94 | G | G | G | G | G | G | G | G | G | G | G | G | G | G | G | G |
| | 95 | G | G | G | G | G | G | G | G | G | G | G | G | G | G | G | G |
| | 96 | G | G | G | G | G | G | G | G | G | G | G | G | G | G | G | G |
| | 97 | G | G | G | G | G | G | G | G | G | G | G | G | G | G | G | G |
| | 98 | G | G | G | G | G | G | G | G | G | G | G | G | G | G | G | G |
| | 99 | G | G | G | G | G | G | G | G | G | G | G | G | G | G | G | G |
| | 100 | G | G | G | G | G | G | G | G | G | G | G | G | G | G | G | G |
| | 101 | G | G | G | G | G | G | G | G | G | G | G | G | G | G | G | G |
| | 102 | G | G | G | G | G | G | G | G | G | G | G | G | G | G | G | G |
| | 103 | G | G | G | G | G | G | G | G | G | G | G | G | G | G | G | G |
| | 104 | G | G | G | G | G | G | G | G | G | G | G | G | G | G | G | G |
| | 105 | G | G | G | G | G | G | G | G | G | G | G | G | G | G | G | G |
| | 106 | G | G | G | G | G | G | G | G | G | G | G | G | G | G | G | G |
| | 107 | G | G | G | G | G | G | G | G | G | G | G | G | G | G | G | G |
| | 108 | G | G | G | G | G | G | G | G | G | G | G | G | G | G | G | G |
| | 109 | G | G | G | G | G | G | G | G | G | G | G | G | G | G | G | G |
| | 110 | G | G | G | G | G | G | G | G | G | G | G | G | G | G | G | G |
| | 111 | G | G | G | G | G | G | G | G | G | G | G | G | G | G | G | G |
| | 112 | G | G | G | G | G | G | G | G | G | G | G | G | G | G | G | G |
| | 113 | G | G | G | G | G | G | G | G | G | G | G | G | G | G | G | G |

* G: Good, P: Poor

TABLE 14

| Tool life | | | | | | | | | | | | | | | | | | | | | | | | | |
|---|---|---|---|---|---|---|---|---|---|---|---|---|---|---|---|---|---|---|---|---|---|---|---|---|---|
| | | Insert material | | | | | | | | | | | | | | | | | | | | | | | |
| | | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 |
| | | Cutting speed | | | | | | | | | | | | | | | | | | | | | | | |
| | | 1 | 1 | 1 | 1 | 1 | 1 | 1 | 1 | 2 | 2 | 2 | 2 | 2 | 2 | 2 | 2 | 1 | 1 | 1 | 1 | 1 | 1 | 1 | 2 |
| | | Feed rate | | | | | | | | | | | | | | | | | | | | | | | |
| | | 1 | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 1 |
| | | Cutting depth | | | | | | | | | | | | | | | | | | | | | | | |
| | | 1 | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | 1 |
| | | Lubricant | | | | | | | | | | | | | | | | | | | | | | | |
| | | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 |
| Test sample No. | 114 | G | G | G | G | G | G | G | G | G | G | G | G | G | G | G | G | G | G | G | G | G | G | G | G |
| | 115 | G | G | G | G | G | G | G | G | G | G | G | G | G | G | G | G | G | G | G | G | G | G | G | G |
| | 116 | G | G | G | G | G | G | G | G | G | G | G | G | G | G | G | G | G | G | G | G | G | G | G | G |
| | 117 | G | G | G | G | G | G | G | G | G | G | G | G | G | G | G | G | G | G | G | G | G | G | G | G |
| | 118 | G | G | G | G | G | G | G | G | G | G | G | G | G | G | G | G | G | G | G | G | G | G | G | G |
| | 119 | G | G | G | G | G | G | G | G | G | G | G | G | G | G | G | G | G | G | G | G | G | G | G | G |
| | 120 | G | G | G | G | G | G | G | G | G | G | G | G | G | G | G | G | G | G | G | G | G | G | G | G |
| | 121 | G | G | G | G | G | G | G | G | G | G | G | G | G | G | G | G | G | G | G | G | G | G | G | G |
| | 122 | G | G | P | P | P | G | P | P | G | P | P | G | G | G | P | G | G | P | P | P | G | G | P | P | G |
| | 123 | P | P | P | P | G | G | P | G | G | G | P | P | G | G | P | G | G | G | P | G | P | P | P | P | G |
| | 124 | G | G | P | P | G | G | P | P | G | G | P | P | G | G | P | P | G | P | P | G | G | G | P | P | G |
| | 125 | P | P | P | P | P | P | P | P | P | P | P | P | P | P | P | P | P | P | P | P | P | P | P | P | P |
| | 126 | P | G | G | G | P | G | G | P | P | P | G | P | G | G | G | P | G | G | P | G | P | P | P | P | G |
| | 127 | P | P | P | P | P | P | P | P | G | P | P | P | P | P | P | P | P | P | G | P | G | P | P | P | P |
| | 128 | G | G | P | G | P | P | G | G | G | G | G | P | G | P | G | G | G | G | P | G | G | P | P | G | G |
| | 129 | G | G | P | P | G | P | G | G | G | G | P | G | G | G | G | P | G | G | P | G | G | G | G | G | G |
| | 130 | G | G | G | P | G | G | G | P | G | G | G | G | G | P | G | G | G | G | G | P | G | G | G | P | G |
| | 131 | G | G | G | G | G | G | P | G | G | P | P | P | P | P | G | G | G | P | P | G | P | P | G | G | G |
| | 132 | G | G | P | G | P | P | G | G | G | G | G | G | G | G | G | G | G | G | P | G | P | P | G | G | G |
| | 133 | P | G | G | G | G | G | P | G | G | G | G | P | G | P | G | P | G | G | G | G | G | P | G | G | G |
| | 134 | G | G | G | G | P | G | G | P | G | G | G | G | P | G | P | G | G | G | G | P | G | G | P | G | G |
| | 135 | G | G | G | P | G | G | G | P | G | G | G | G | P | G | G | G | G | G | G | P | G | G | G | G | G |
| | 136 | G | G | G | G | P | G | G | G | G | P | G | G | G | G | G | G | G | G | G | G | G | G | G | G | G |
| | 137 | G | G | G | G | G | G | G | G | P | P | G | G | G | P | G | G | G | G | G | G | G | G | P | G | G |
| | 138 | G | G | G | G | G | G | G | G | G | P | G | G | P | G | G | P | G | P | G | G | G | G | P | G | G |
| | 139 | G | G | G | P | G | G | P | G | G | G | P | G | P | G | G | P | G | P | G | G | G | G | P | G | G |
| | 140 | P | P | P | G | P | P | P | P | G | P | P | G | P | P | P | P | P | P | G | P | G | P | P | P | P |
| | 141 | G | G | G | G | G | G | G | G | G | G | G | G | G | G | G | G | G | G | G | G | G | G | G | G | G |
| | 142 | G | G | G | G | G | G | G | G | G | G | G | G | G | G | G | G | G | G | G | G | G | G | G | G | G |
| | 143 | G | G | G | G | G | G | G | G | G | G | G | G | G | G | G | G | G | G | G | G | G | G | G | G | G |
| | 144 | G | G | G | G | G | G | G | G | G | G | G | G | G | G | G | G | G | G | G | G | G | G | G | G | G |
| | 145 | G | G | G | G | G | G | G | G | G | G | G | G | G | G | G | G | G | G | G | G | G | G | G | G | G |
| | 146 | G | G | G | G | G | G | G | G | G | G | G | G | G | G | G | G | G | G | G | G | G | G | G | G | G |
| | 147 | G | G | G | G | G | G | G | G | G | G | G | G | G | G | G | G | G | G | G | G | G | G | G | G | G |
| | 148 | G | G | G | G | G | G | G | G | G | G | G | G | G | G | G | G | G | G | G | G | G | G | G | G | G |
| | 149 | G | G | G | G | G | G | G | G | G | G | G | G | G | G | G | G | G | G | G | G | G | G | G | G | G |
| | 150 | G | G | G | G | G | G | G | G | G | G | G | P | G | G | G | G | G | G | G | G | G | G | G | G | G |
| | 151 | G | G | G | P | G | G | G | P | G | G | G | G | G | G | G | G | G | G | G | P | G | G | G | G | G |

| | | | | | | | | | | | | | | | | | | | | | | | | | |
|---|---|---|---|---|---|---|---|---|---|---|---|---|---|---|---|---|---|---|---|---|---|---|---|---|---|
| | | Insert material | | | | | | | | | | | | | | | | | | | | | | | |
| | | 2 | 2 | 2 | 2 | 2 | 2 | 2 | 3 | 3 | 3 | 3 | 3 | 3 | 3 | 3 | 3 | 3 | 3 | 3 | 3 | 3 | 3 | 3 | 3 |
| | | Cutting speed | | | | | | | | | | | | | | | | | | | | | | | |
| | | 2 | 2 | 2 | 2 | 2 | 2 | 2 | 1 | 1 | 1 | 1 | 1 | 1 | 1 | 1 | 1 | 2 | 2 | 2 | 2 | 2 | 2 | 2 | 2 |
| | | Feed rate | | | | | | | | | | | | | | | | | | | | | | | |
| | | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | |
| | | Cutting depth | | | | | | | | | | | | | | | | | | | | | | | |
| | | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | |
| | | Lubricant | | | | | | | | | | | | | | | | | | | | | | | |
| | | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | |
| Test sample No. | 114 | G | G | G | G | G | G | G | G | G | G | G | G | G | G | G | G | G | G | G | G | G | G | G | |
| | 115 | G | G | G | G | G | G | G | G | G | G | G | G | G | G | G | G | G | G | G | G | G | G | G | |
| | 116 | G | G | G | G | G | G | G | G | G | G | G | G | G | G | G | G | G | G | G | G | G | G | G | |
| | 117 | G | G | G | G | G | G | G | G | G | G | G | G | G | G | G | G | G | G | G | G | G | G | G | |
| | 118 | G | G | G | G | G | G | G | G | G | G | G | G | G | G | G | G | G | G | G | G | G | G | G | |
| | 119 | G | G | G | G | G | G | G | G | G | G | G | G | G | G | G | G | G | G | G | G | G | G | G | |
| | 120 | G | G | G | G | G | G | G | G | G | G | G | G | G | G | G | G | G | G | G | G | G | G | G | |

TABLE 14-continued

| | | | | | | | | | | | | | | | | | | | | | | | |
|---|---|---|---|---|---|---|---|---|---|---|---|---|---|---|---|---|---|---|---|---|---|---|---|
| Tool life | | | | | | | | | | | | | | | | | | | | | | | |
| | 121 | G | G | G | G | G | G | G | G | G | G | G | G | G | G | G | G | G | G | G | G | G | G |
| | 122 | G | P | G | P | G | P | P | G | G | G | G | G | P | G | G | P | G | P | G | G | G | P | P |
| | 123 | G | P | G | G | G | G | P | G | G | P | P | G | G | G | P | P | G | G | G | G | P | P | P |
| | 124 | G | P | G | G | G | G | P | G | G | P | P | G | G | P | G | G | G | P | G | G | G | P | G |
| | 125 | P | P | P | P | P | P | P | P | P | P | P | P | P | P | P | P | P | P | P | P | P | P | P |
| | 126 | G | P | P | G | G | G | P | G | G | P | G | G | P | P | P | G | P | G | G | P | P | P | G |
| | 127 | P | P | P | P | P | P | P | P | P | P | P | P | P | P | P | P | P | P | P | P | P | P | P |
| | 128 | G | G | G | G | P | G | P | G | G | P | G | P | G | G | P | P | G | G | P | P | G | G | P |
| | 129 | G | G | G | P | P | P | P | G | P | P | G | G | G | G | P | P | G | G | G | G | G | G | P |
| | 130 | G | G | G | G | G | G | G | G | G | G | P | G | G | G | P | G | G | P | G | G | G | G | G |
| | 131 | G | P | G | P | P | G | P | G | G | P | G | G | P | G | G | G | G | P | G | G | P | G | G |
| | 132 | G | P | G | G | G | P | P | G | G | P | G | G | G | G | G | P | G | G | G | G | G | G | P |
| | 133 | G | P | G | P | G | G | P | G | G | P | G | G | P | G | P | G | G | P | G | G | G | P | G |
| | 134 | G | P | G | G | G | P | G | G | G | G | P | G | G | G | P | G | G | G | G | P | G | G | G |
| | 135 | P | G | G | G | P | G | P | G | G | P | G | G | G | G | P | G | G | G | G | P | G | G | P |
| | 136 | G | G | G | G | G | G | G | G | G | G | G | G | G | G | G | G | G | G | G | G | G | G | G |
| | 137 | P | G | G | G | P | G | P | G | G | G | G | G | P | G | P | G | G | G | G | P | G | P | G |
| | 138 | G | G | G | P | G | G | G | G | G | P | G | G | G | G | G | G | G | G | G | G | P | G | G |
| | 139 | G | G | P | G | G | G | P | P | G | G | G | G | G | G | G | G | G | G | G | G | P | G | G |
| | 140 | P | P | G | P | P | G | P | P | G | P | P | P | P | P | G | G | G | G | P | P | P | G | P |
| | 141 | G | G | G | G | G | G | G | G | G | G | G | G | G | G | G | G | G | G | G | G | G | G | G |
| | 142 | G | G | G | G | G | G | G | G | G | G | G | G | G | G | G | G | G | G | G | G | G | G | G |
| | 143 | G | G | G | G | G | G | G | G | G | G | G | G | G | G | G | G | G | G | G | G | G | G | G |
| | 144 | G | G | G | G | G | G | G | G | G | G | G | G | G | G | G | G | G | G | G | G | G | G | G |
| | 145 | G | G | G | G | G | G | G | G | G | G | G | G | G | G | G | G | G | G | G | G | G | G | G |
| | 146 | G | G | G | G | G | G | G | G | G | G | G | G | G | G | G | G | G | G | G | G | G | G | G |
| | 147 | G | G | G | G | G | G | G | G | G | G | G | G | G | G | G | G | G | G | G | G | G | G | G |
| | 148 | G | G | G | G | G | G | G | G | G | G | G | G | G | G | G | G | G | G | G | G | G | G | G |
| | 149 | G | G | G | G | G | G | G | G | G | G | G | G | G | G | G | G | G | G | G | G | G | G | G |
| | 150 | G | G | G | G | G | P | G | G | G | P | G | G | G | G | G | G | G | G | G | G | G | G | G |
| | 151 | P | G | G | G | G | G | P | G | G | P | G | G | G | G | G | G | G | G | G | G | G | G | P |
| Insert material | | 4 | 4 | 4 | 4 | 4 | 4 | 4 | 4 | 4 | 4 | 4 | 4 | 4 | 4 | 4 | 4 | | | | | | |
| Cutting speed | | 1 | 1 | 1 | 1 | 1 | 1 | 1 | 1 | 2 | 2 | 2 | 2 | 2 | 2 | 2 | 2 | | | | | | |
| Feed rate | | 1 | 1 | 1 | 1 | 2 | 2 | 2 | 2 | 1 | 1 | 1 | 1 | 2 | 2 | 2 | 2 | | | | | | |
| Cutting depth | | 1 | 1 | 2 | 2 | 1 | 1 | 2 | 2 | 1 | 1 | 2 | 2 | 1 | 1 | 2 | 2 | | | | | | |
| Lubricant | | 1 | 2 | 1 | 2 | 1 | 2 | 1 | 2 | 1 | 2 | 1 | 2 | 1 | 2 | 1 | 2 | | | | | | |
| Test sample No. | 114 | G | G | G | G | G | G | G | G | G | G | G | G | G | G | G | G | | | | | | |
| | 115 | G | G | G | G | G | G | G | G | G | G | G | G | G | G | G | G | | | | | | |
| | 116 | G | G | G | G | G | G | G | G | G | G | G | G | G | G | G | G | | | | | | |
| | 117 | G | G | G | G | G | G | G | G | G | G | G | G | G | G | G | G | | | | | | |
| | 118 | G | G | G | G | G | G | G | G | G | G | G | G | G | G | G | G | | | | | | |
| | 119 | G | G | G | G | G | G | G | G | G | G | G | G | G | G | G | G | | | | | | |
| | 120 | G | G | G | G | G | G | G | G | G | G | G | G | G | G | G | G | | | | | | |
| | 121 | G | G | G | G | G | G | G | G | G | G | G | G | G | G | G | G | | | | | | |
| | 122 | G | P | G | G | P | G | G | G | G | G | P | G | G | P | P | P | | | | | | |
| | 123 | G | G | P | P | G | G | P | P | P | G | G | G | G | G | P | P | | | | | | |
| | 124 | G | G | G | P | G | P | G | P | G | G | G | G | G | G | P | P | | | | | | |
| | 125 | P | P | P | P | P | P | P | P | P | P | P | P | P | P | P | P | | | | | | |
| | 126 | G | G | G | P | G | G | P | P | P | P | P | P | P | P | P | G | | | | | | |
| | 127 | P | P | P | P | P | P | P | P | P | P | P | P | P | P | P | P | | | | | | |
| | 128 | G | G | G | G | G | P | P | P | G | G | G | G | P | P | G | G | | | | | | |
| | 129 | G | G | G | G | P | G | P | G | G | P | P | P | P | P | P | G | | | | | | |
| | 130 | G | P | G | G | G | G | P | G | G | G | P | G | P | G | G | G | | | | | | |
| | 131 | G | G | P | G | G | P | G | P | P | P | P | G | P | G | G | P | | | | | | |
| | 132 | G | G | G | G | G | P | G | G | G | G | P | G | P | G | G | G | | | | | | |
| | 133 | P | G | P | G | G | G | G | G | G | G | G | G | P | P | P | P | | | | | | |
| | 134 | G | G | G | P | G | G | G | P | G | G | G | P | G | G | G | G | | | | | | |
| | 135 | G | G | G | G | G | G | G | G | G | P | G | G | G | G | P | G | | | | | | |
| | 136 | G | G | G | G | G | G | P | G | G | P | P | P | G | G | G | G | | | | | | |
| | 137 | G | G | G | P | G | G | G | P | G | G | G | P | P | P | P | G | | | | | | |
| | 138 | G | G | G | G | G | G | G | P | P | G | G | G | G | P | G | P | | | | | | |
| | 139 | P | G | G | P | G | G | G | G | G | G | G | G | G | P | G | G | | | | | | |
| | 140 | P | P | P | G | G | P | P | P | P | P | P | P | G | P | P | P | | | | | | |
| | 141 | G | G | G | G | G | G | G | G | G | G | G | G | G | G | G | G | | | | | | |
| | 142 | G | G | G | G | G | G | G | G | G | G | G | G | G | G | G | G | | | | | | |
| | 143 | G | G | G | G | G | G | G | G | G | G | G | G | G | G | G | G | | | | | | |

TABLE 14-continued

| | Tool life |
|---|---|
| 144 | G G G G G G G G G G G G G G G G |
| 145 | G G G G G G G G G G G G G G G G |
| 146 | G G G G G G G G G G G G G G G G |
| 147 | G G G G G G G G G G G G G G G G |
| 148 | G G G G G G G G G G G G G G G G |
| 149 | G G G G G G G G G G G G G G G G |
| 150 | G G P G G G G G G G G G G G G G |
| 151 | G G G G G G G G G P G G G G G G |

* G: Good, P: Poor

TABLE 15

| | | Surface roughness after cutting | | | | | | | | | | | | | | | | | | | | | | | | |
|---|---|---|---|---|---|---|---|---|---|---|---|---|---|---|---|---|---|---|---|---|---|---|---|---|---|---|
| | | Insert material | | | | | | | | | | | | | | | | | | | | | | | | |
| | | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 |
| | | Cutting speed | | | | | | | | | | | | | | | | | | | | | | | | |
| | | 1 | 1 | 1 | 1 | 1 | 1 | 1 | 1 | 2 | 2 | 2 | 2 | 2 | 2 | 2 | 2 | 1 | 1 | 1 | 1 | 1 | 1 | 1 | 1 | 2 |
| | | Feed rate | | | | | | | | | | | | | | | | | | | | | | | | |
| | | 1 | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 1 |
| | | Cutting depth | | | | | | | | | | | | | | | | | | | | | | | | |
| | | 1 | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | 1 |
| | | Lubricant | | | | | | | | | | | | | | | | | | | | | | | | |
| | | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 |
| Test sample No. | 76 | G | G | G | G | G | G | G | G | G | G | G | G | G | G | G | G | G | G | G | G | G | G | G | G | G |
| | 77 | G | G | G | G | G | G | G | G | G | G | G | G | G | G | G | G | G | G | G | G | G | G | G | G | G |
| | 78 | G | G | G | G | G | G | G | G | G | G | G | G | G | G | G | G | G | G | G | G | G | G | G | G | G |
| | 79 | G | G | G | G | G | G | G | G | G | G | G | G | G | G | G | G | G | G | G | G | G | G | G | G | G |
| | 80 | G | G | G | G | G | G | G | G | G | G | G | G | G | G | G | G | G | G | G | G | G | G | G | G | G |
| | 81 | G | G | G | G | G | G | G | G | G | G | G | G | G | G | G | G | G | G | G | G | G | G | G | G | G |
| | 82 | G | G | G | G | G | G | G | G | G | G | G | G | G | G | G | G | G | G | G | G | G | G | G | G | G |
| | 83 | G | G | G | G | G | G | G | G | G | G | G | G | G | G | G | G | G | G | G | G | G | G | G | G | G |
| | 84 | G | G | G | G | G | G | G | G | G | G | G | G | G | G | G | G | G | G | G | G | G | G | G | G | G |
| | 85 | G | G | G | G | G | G | G | G | G | G | G | G | G | G | G | G | G | G | G | G | G | G | G | G | G |
| | 86 | G | G | G | G | G | G | G | G | G | G | G | G | G | G | G | G | G | G | G | G | G | G | G | G | G |
| | 87 | G | G | G | G | G | G | G | G | G | G | G | G | G | G | G | G | G | G | G | G | G | G | G | G | G |
| | 88 | G | G | G | G | G | G | G | G | G | G | G | G | G | G | G | G | G | G | G | G | G | G | G | G | G |
| | 89 | G | G | G | G | G | G | G | G | G | G | G | G | G | G | G | G | G | G | G | G | G | G | G | G | G |
| | 90 | G | G | G | G | G | G | G | G | G | G | G | G | G | G | G | G | G | G | G | G | G | G | G | G | G |
| | 91 | G | G | G | G | G | G | G | G | G | G | G | G | G | G | G | G | G | G | G | G | G | G | G | G | G |
| | 92 | G | G | G | G | G | G | G | G | G | G | G | G | G | G | G | G | G | G | G | G | G | G | G | G | G |
| | 93 | G | G | G | G | G | G | G | G | G | G | G | G | G | G | G | G | G | G | G | G | G | G | G | G | G |
| | 94 | G | G | G | G | G | G | G | G | G | G | G | G | G | G | G | G | G | G | G | G | G | G | G | G | G |
| | 95 | G | G | G | G | G | G | G | G | G | G | G | G | G | G | G | G | G | G | G | G | G | G | G | G | G |
| | 96 | G | G | G | G | G | G | G | G | G | G | G | G | G | G | G | G | G | G | G | G | G | G | G | G | G |
| | 97 | G | G | G | G | G | G | G | G | G | G | G | G | G | G | G | G | G | G | G | G | G | G | G | G | G |
| | 98 | G | G | G | G | G | G | G | G | G | G | G | G | G | G | G | G | G | G | G | G | G | G | G | G | G |
| | 99 | G | G | G | G | G | G | G | G | G | G | G | G | G | G | G | G | G | G | G | G | G | G | G | G | G |
| | 100 | G | G | G | G | G | G | G | G | G | G | G | G | G | G | G | G | G | G | G | G | G | G | G | G | G |
| | 101 | G | G | G | G | G | G | G | G | G | G | G | G | G | G | G | G | G | G | G | G | G | G | G | G | G |
| | 102 | G | G | G | G | G | G | G | G | G | G | G | G | G | G | G | G | G | G | G | G | G | G | G | G | G |
| | 103 | G | G | G | G | G | G | G | G | G | G | G | G | G | G | G | G | G | G | G | G | G | G | G | G | G |
| | 104 | G | G | G | G | G | G | G | G | G | G | G | G | G | G | G | G | G | G | G | G | G | G | G | G | G |
| | 105 | G | G | G | G | G | G | G | G | G | G | G | G | G | G | G | G | G | G | G | G | G | G | G | G | G |
| | 106 | G | G | G | G | G | G | G | G | G | G | G | G | G | G | G | G | G | G | G | G | G | G | G | G | G |
| | 107 | G | G | G | G | G | G | G | G | G | G | G | G | G | G | G | G | G | G | G | G | G | G | G | G | G |
| | 108 | G | G | G | G | G | G | G | G | G | G | G | G | G | G | G | G | G | G | G | G | G | G | G | G | G |
| | 109 | G | G | G | G | G | G | G | G | G | G | G | G | G | G | G | G | G | G | G | G | G | G | G | G | G |
| | 110 | G | G | G | G | G | G | G | G | G | G | G | G | G | G | G | G | G | G | G | G | G | G | G | G | G |
| | 111 | G | G | G | G | G | G | G | G | G | G | G | G | G | G | G | G | G | G | G | G | G | G | G | G | G |
| | 112 | G | G | G | G | G | G | G | G | G | G | G | G | G | G | G | G | G | G | G | G | G | G | G | G | G |
| | 113 | G | G | G | G | G | G | G | G | G | G | G | G | G | G | G | G | G | G | G | G | G | G | G | G | G |

TABLE 15-continued

| Surface roughness after cutting | | | | | | | | | | | | | | | | | | | | | | | | |
|---|---|---|---|---|---|---|---|---|---|---|---|---|---|---|---|---|---|---|---|---|---|---|---|---|
| Insert material | | 2 | 2 | 2 | 2 | 2 | 2 | 2 | 3 | 3 | 3 | 3 | 3 | 3 | 3 | 3 | 3 | 3 | 3 | 3 | 3 | 3 | 3 | 3 |
| Cutting speed | | 2 | 2 | 2 | 2 | 2 | 2 | 2 | 1 | 1 | 1 | 1 | 1 | 1 | 1 | 1 | 2 | 2 | 2 | 2 | 2 | 2 | 2 | 2 |
| Feed rate | | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 |
| Cutting depth | | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 |
| Lubricant | | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| Test sample No. | 76 | G | G | G | G | G | G | G | G | G | G | G | G | G | G | G | G | G | G | G | G | G | G | G |
| | 77 | G | G | G | G | G | G | G | G | G | G | G | G | G | G | G | G | G | G | G | G | G | G | G |
| | 78 | G | G | G | G | G | G | G | G | G | G | G | G | G | G | G | G | G | G | G | G | G | G | G |
| | 79 | G | G | G | G | G | G | G | G | G | G | G | G | G | G | G | G | G | G | G | G | G | G | G |
| | 80 | G | G | G | G | G | G | G | G | G | G | G | G | G | G | G | G | G | G | G | G | G | G | G |
| | 81 | G | G | G | G | G | G | G | G | G | G | G | G | G | G | G | G | G | G | G | G | G | G | G |
| | 82 | G | G | G | G | G | G | G | G | G | G | G | G | G | G | G | G | G | G | G | G | G | G | G |
| | 83 | G | G | G | G | G | G | G | G | G | G | G | G | G | G | G | G | G | G | G | G | G | G | G |
| | 84 | G | G | G | G | G | G | G | G | G | G | G | G | G | G | G | G | G | G | G | G | G | G | G |
| | 85 | G | G | G | G | G | G | G | G | G | G | G | G | G | G | G | G | G | G | G | G | G | G | G |
| | 86 | G | G | G | G | G | G | G | G | G | G | G | G | G | G | G | G | G | G | G | G | G | G | G |
| | 87 | G | G | G | G | G | G | G | G | G | G | G | G | G | G | G | G | G | G | G | G | G | G | G |
| | 88 | G | G | G | G | G | G | G | G | G | G | G | G | G | G | G | G | G | G | G | G | G | G | G |
| | 89 | G | G | G | G | G | G | G | G | G | G | G | G | G | G | G | G | G | G | G | G | G | G | G |
| | 90 | G | G | G | G | G | G | G | G | G | G | G | G | G | G | G | G | G | G | G | G | G | G | G |
| | 91 | G | G | G | G | G | G | G | G | G | G | G | G | G | G | G | G | G | G | G | G | G | G | G |
| | 92 | G | G | G | G | G | G | G | G | G | G | G | G | G | G | G | G | G | G | G | G | G | G | G |
| | 93 | G | G | G | G | G | G | G | G | G | G | G | G | G | G | G | G | G | G | G | G | G | G | G |
| | 94 | G | G | G | G | G | G | G | G | G | G | G | G | G | G | G | G | G | G | G | G | G | G | G |
| | 95 | G | G | G | G | G | G | G | G | G | G | G | G | G | G | G | G | G | G | G | G | G | G | G |
| | 96 | G | G | G | G | G | G | G | G | G | G | G | G | G | G | G | G | G | G | G | G | G | G | G |
| | 97 | G | G | G | G | G | G | G | G | G | G | G | G | G | G | G | G | G | G | G | G | G | G | G |
| | 98 | G | G | G | G | G | G | G | G | G | G | G | G | G | G | G | G | G | G | G | G | G | G | G |
| | 99 | G | G | G | G | G | G | G | G | G | G | G | G | G | G | G | G | G | G | G | G | G | G | G |
| | 100 | G | G | G | G | G | G | G | G | G | G | G | G | G | G | G | G | G | G | G | G | G | G | G |
| | 101 | G | G | G | G | G | G | G | G | G | G | G | G | G | G | G | G | G | G | G | G | G | G | G |
| | 102 | G | G | G | G | G | G | G | G | G | G | G | G | G | G | G | G | G | G | G | G | G | G | G |
| | 103 | G | G | G | G | G | G | G | G | G | G | G | G | G | G | G | G | G | G | G | G | G | G | G |
| | 104 | G | G | G | G | G | G | G | G | G | G | G | G | G | G | G | G | G | G | G | G | G | G | G |
| | 105 | G | G | G | G | G | G | G | G | G | G | G | G | G | G | G | G | G | G | G | G | G | G | G |
| | 106 | G | G | G | G | G | G | G | G | G | G | G | G | G | G | G | G | G | G | G | G | G | G | G |
| | 107 | G | G | G | G | G | G | G | G | G | G | G | G | G | G | G | G | G | G | G | G | G | G | G |
| | 108 | G | G | G | G | G | G | G | G | G | G | G | G | G | G | G | G | G | G | G | G | G | G | G |
| | 109 | G | G | G | G | G | G | G | G | G | G | G | G | G | G | G | G | G | G | G | G | G | G | G |
| | 110 | G | G | G | G | G | G | G | G | G | G | G | G | G | G | G | G | G | G | G | G | G | G | G |
| | 111 | G | G | G | G | G | G | G | G | G | G | G | G | G | G | G | G | G | G | G | G | G | G | G |
| | 112 | G | G | G | G | G | G | G | G | G | G | G | G | G | G | G | G | G | G | G | G | G | G | G |
| | 113 | G | G | G | G | G | G | G | G | G | G | G | G | G | G | G | G | G | G | G | G | G | G | G |

| | | | | | | | | | | | | | | | | | |
|---|---|---|---|---|---|---|---|---|---|---|---|---|---|---|---|---|---|
| Insert material | | 4 | 4 | 4 | 4 | 4 | 4 | 4 | 4 | 4 | 4 | 4 | 4 | 4 | 4 | 4 | 4 |
| Cutting speed | | 1 | 1 | 1 | 1 | 1 | 1 | 1 | 1 | 2 | 2 | 2 | 2 | 2 | 2 | 2 | 2 |
| Feed rate | | 1 | 1 | 1 | 1 | 2 | 2 | 2 | 2 | 1 | 1 | 1 | 1 | 2 | 2 | 2 | 2 |
| Cutting depth | | 1 | 1 | 2 | 2 | 1 | 1 | 2 | 2 | 1 | 1 | 2 | 2 | 1 | 1 | 2 | 2 |
| Lubricant | | 1 | 2 | 1 | 2 | 1 | 2 | 1 | 2 | 1 | 2 | 1 | 2 | 1 | 2 | 1 | 2 |
| Test sample No. | 76 | G | G | G | G | G | G | G | G | G | G | G | G | G | G | G | G |
| | 77 | G | G | G | G | G | G | G | G | G | G | G | G | G | G | G | G |
| | 78 | G | G | G | G | G | G | G | G | G | G | G | G | G | G | G | G |
| | 79 | G | G | G | G | G | G | G | G | G | G | G | G | G | G | G | G |
| | 80 | G | G | G | G | G | G | G | G | G | G | G | G | G | G | G | G |
| | 81 | G | G | G | G | G | G | G | G | G | G | G | G | G | G | G | G |
| | 82 | G | G | G | G | G | G | G | G | G | G | G | G | G | G | G | G |

TABLE 15-continued

| | Surface roughness after cutting | | | | | | | | | | | | | | | |
|---|---|---|---|---|---|---|---|---|---|---|---|---|---|---|---|---|
| 83 | G | G | G | G | G | G | G | G | G | G | G | G | G | G | G | G |
| 84 | G | G | G | G | G | G | G | G | G | G | G | G | G | G | G | G |
| 85 | G | G | G | G | G | G | G | G | G | G | G | G | G | G | G | G |
| 86 | G | G | G | G | G | G | G | G | G | G | G | G | G | G | G | G |
| 87 | G | G | G | G | G | G | G | G | G | G | G | G | G | G | G | G |
| 88 | G | G | G | G | G | G | G | G | G | G | G | G | G | G | G | G |
| 89 | G | G | G | G | G | G | G | G | G | G | G | G | G | G | G | G |
| 90 | G | G | G | G | G | G | G | G | G | G | G | G | G | G | G | G |
| 91 | G | G | G | G | G | G | G | G | G | G | G | G | G | G | G | G |
| 92 | G | G | G | G | G | G | G | G | G | G | G | G | G | G | G | G |
| 93 | G | G | G | G | G | G | G | G | G | G | G | G | G | G | G | G |
| 94 | G | G | G | G | G | G | G | G | G | G | G | G | G | G | G | G |
| 95 | G | G | G | G | G | G | G | G | G | G | G | G | G | G | G | G |
| 96 | G | G | G | G | G | G | G | G | G | G | G | G | G | G | G | G |
| 97 | G | G | G | G | G | G | G | G | G | G | G | G | G | G | G | G |
| 98 | G | G | G | G | G | G | G | G | G | G | G | G | G | G | G | G |
| 99 | G | G | G | G | G | G | G | G | G | G | G | G | G | G | G | G |
| 100 | G | G | G | G | G | G | G | G | G | G | G | G | G | G | G | G |
| 101 | G | G | G | G | G | G | G | G | G | G | G | G | G | G | G | G |
| 102 | G | G | G | G | G | G | G | G | G | G | G | G | G | G | G | G |
| 103 | G | G | G | G | G | G | G | G | G | G | G | G | G | G | G | G |
| 104 | G | G | G | G | G | G | G | G | G | G | G | G | G | G | G | G |
| 105 | G | G | G | G | G | G | G | G | G | G | G | G | G | G | G | G |
| 106 | G | G | G | G | G | G | G | G | G | G | G | G | G | G | G | G |
| 107 | G | G | G | G | G | G | G | G | G | G | G | G | G | G | G | G |
| 108 | G | G | G | G | G | G | G | G | G | G | G | G | G | G | G | G |
| 109 | G | G | G | G | G | G | G | G | G | G | G | G | G | G | G | G |
| 110 | G | G | G | G | G | G | G | G | G | G | G | G | G | G | G | G |
| 111 | G | G | G | G | G | G | G | G | G | G | G | G | G | G | G | G |
| 112 | G | G | G | G | G | G | G | G | G | G | G | G | G | G | G | G |
| 113 | G | G | G | G | G | G | G | G | G | G | G | G | G | G | G | G |

* G: Good, P: Poor

TABLE 16

| | | Surface roughness after cutting | | | | | | | | | | | | | | | | | | | | | | | | |
|---|---|---|---|---|---|---|---|---|---|---|---|---|---|---|---|---|---|---|---|---|---|---|---|---|---|---|
| | | Insert material | | | | | | | | | | | | | | | | | | | | | | | | |
| | | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 |
| | | Cutting speed | | | | | | | | | | | | | | | | | | | | | | | | |
| | | 1 | 1 | 1 | 1 | 1 | 1 | 1 | 1 | 2 | 2 | 2 | 2 | 2 | 2 | 2 | 2 | 1 | 1 | 1 | 1 | 1 | 1 | 1 | 1 | 2 |
| | | Feed rate | | | | | | | | | | | | | | | | | | | | | | | | |
| | | 1 | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 1 |
| | | Cutting depth | | | | | | | | | | | | | | | | | | | | | | | | |
| | | 1 | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | 1 |
| | | Lubricant | | | | | | | | | | | | | | | | | | | | | | | | |
| | | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 |
| Test sample No. | 114 | G | G | G | G | G | G | G | G | G | G | G | G | G | G | G | G | G | G | G | G | G | G | G | G | G |
| | 115 | G | G | G | G | G | G | G | G | G | G | G | G | G | G | G | G | G | G | G | G | G | G | G | G | G |
| | 116 | G | G | G | G | G | G | G | G | G | G | G | G | G | G | G | G | G | G | G | G | G | G | G | G | G |
| | 117 | G | G | G | G | G | G | G | G | G | G | G | G | G | G | G | G | G | G | G | G | G | G | G | G | G |
| | 118 | G | G | G | G | G | G | G | G | G | G | G | G | G | G | G | G | G | G | G | G | G | G | G | G | G |
| | 119 | G | G | G | G | G | G | G | G | G | G | G | G | G | G | G | G | G | G | G | G | G | G | G | G | G |
| | 120 | G | G | G | G | G | G | G | G | G | G | G | G | G | G | G | G | G | G | G | G | G | G | G | G | G |
| | 121 | G | G | G | G | G | G | G | G | G | G | G | G | G | G | G | G | G | G | G | G | G | G | G | G | G |
| | 122 | G | G | G | P | P | G | P | P | G | G | P | G | G | G | P | G | G | P | G | P | G | G | P | G | G |
| | 123 | G | G | G | P | G | G | P | G | G | G | P | P | G | G | P | G | G | G | G | G | G | P | P | P | G |
| | 124 | G | G | G | P | G | G | P | G | G | G | P | G | G | G | P | P | G | P | P | G | G | G | P | G | G |
| | 125 | P | P | P | P | P | P | P | P | P | P | P | P | P | P | P | P | P | P | P | P | P | P | P | P | P |
| | 126 | G | G | G | G | G | G | G | P | P | P | G | G | G | G | G | P | G | G | P | G | P | G | G | G | G |
| | 127 | P | P | P | P | P | G | G | G | G | P | P | P | P | P | P | P | P | P | G | G | G | P | P | P | P |
| | 128 | G | G | G | G | P | P | G | G | G | G | G | P | G | P | G | G | G | G | P | G | G | P | P | G | G |
| | 129 | G | G | P | G | G | P | G | G | G | G | P | G | G | G | G | G | G | G | G | G | G | G | G | G | G |
| | 130 | G | G | G | P | G | G | G | P | G | G | G | G | G | P | G | G | G | G | G | P | G | G | G | P | G |
| | 131 | G | G | G | G | G | G | P | G | G | P | G | P | P | G | G | G | G | P | G | G | P | G | G | G | G |

TABLE 16-continued

| | | Surface roughness after cutting | | | | | | | | | | | | | | | | | | | | | | |
|---|---|---|---|---|---|---|---|---|---|---|---|---|---|---|---|---|---|---|---|---|---|---|---|---|
| | 132 | G | G | G | G | P | P | G | G | G | G | G | G | G | G | G | G | G | P | G | G | P | G | G | G |
| | 133 | P | G | G | G | G | G | G | G | G | G | G | G | G | P | G | G | G | G | G | G | G | P | G | G |
| | 134 | G | G | G | G | G | G | G | P | G | G | G | G | P | G | P | G | G | G | G | P | G | G | P | G | G |
| | 135 | G | G | G | P | G | G | G | P | G | G | G | G | G | G | G | G | G | G | G | P | G | G | G | G | G |
| | 136 | G | G | G | G | P | G | G | G | G | G | G | G | G | G | G | G | G | G | G | G | G | G | G | G | G |
| | 137 | G | G | G | G | G | G | G | G | P | G | G | G | G | G | G | G | G | G | G | G | G | G | P | G | G |
| | 138 | G | G | G | G | G | G | G | G | G | G | G | G | P | G | G | P | G | P | G | G | G | G | P | G | G |
| | 139 | G | G | G | P | G | G | P | G | G | G | P | G | G | G | G | P | G | P | G | G | G | G | G | G | G |
| | 140 | P | G | G | G | P | P | P | G | G | P | G | G | P | G | G | P | P | G | G | P | G | P | G | P | G |
| | 141 | G | G | G | G | G | G | G | G | G | G | G | G | G | G | G | G | G | G | G | G | G | G | G | G | G |
| | 142 | G | G | G | G | G | G | G | G | G | G | G | G | G | G | G | G | G | G | G | G | G | G | G | G | G |
| | 143 | G | G | G | G | G | G | G | G | G | G | G | G | G | G | G | G | G | G | G | G | G | G | G | G | G |
| | 144 | G | G | G | G | G | G | G | G | G | G | G | G | G | G | G | G | G | G | G | G | G | G | G | G | G |
| | 145 | G | G | G | G | G | G | G | G | G | G | G | G | G | G | G | G | G | G | G | G | G | G | G | G | G |
| | 146 | G | G | G | G | G | G | G | G | G | G | G | G | G | G | G | G | G | G | G | G | G | G | G | G | G |
| | 147 | G | G | G | G | G | G | G | G | G | G | G | G | G | G | G | G | G | G | G | G | G | G | G | G | G |
| | 148 | G | G | G | G | G | G | G | G | G | G | G | G | G | G | G | G | G | G | G | G | G | G | G | G | G |
| | 149 | G | G | G | G | G | G | G | G | G | G | G | G | G | G | G | G | G | G | G | G | G | G | G | G | G |
| | 150 | G | G | G | G | G | G | G | G | G | G | G | G | G | G | G | G | G | G | G | G | G | G | G | G | G |
| | 151 | G | G | G | G | G | G | G | G | G | G | G | G | G | G | P | G | G | G | G | G | G | G | G | G | G |
| | | Insert material | | | | | | | | | | | | | | | | | | | | | | | |
| | | 2 | 2 | 2 | 2 | 2 | 2 | 2 | 3 | 3 | 3 | 3 | 3 | 3 | 3 | 3 | 3 | 3 | 3 | 3 | 3 | 3 | 3 | 3 | 3 |
| | | Cutting speed | | | | | | | | | | | | | | | | | | | | | | | |
| | | 2 | 2 | 2 | 2 | 2 | 2 | 2 | 1 | 1 | 1 | 1 | 1 | 1 | 1 | 1 | 2 | 2 | 2 | 2 | 2 | 2 | 2 | 2 | 2 |
| | | Feed rate | | | | | | | | | | | | | | | | | | | | | | | |
| | | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 2 |
| | | Cutting depth | | | | | | | | | | | | | | | | | | | | | | | |
| | | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | 2 |
| | | Lubricant | | | | | | | | | | | | | | | | | | | | | | | |
| | | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 2 |
| Test sample No. | 114 | G | G | G | G | G | G | G | G | G | G | G | G | G | G | G | G | G | G | G | G | G | G | G | G |
| | 115 | G | G | G | G | G | G | G | G | G | G | G | G | G | G | G | G | G | G | G | G | G | G | G | G |
| | 116 | G | G | G | G | G | G | G | G | G | G | G | G | G | G | G | G | G | G | G | G | G | G | G | G |
| | 117 | G | G | G | G | G | G | G | G | G | G | G | G | G | G | G | G | G | G | G | G | G | G | G | G |
| | 118 | G | G | G | G | G | G | G | G | G | G | G | G | G | G | G | G | G | G | G | G | G | G | G | G |
| | 119 | G | G | G | G | G | G | G | G | G | G | G | G | G | G | G | G | G | G | G | G | G | G | G | G |
| | 120 | G | G | G | G | G | G | G | G | G | G | G | G | G | G | G | G | G | G | G | G | G | G | G | G |
| | 121 | G | G | G | G | G | G | G | G | G | G | G | G | G | G | G | G | G | G | G | G | G | G | G | G |
| | 122 | G | G | G | P | G | P | P | G | G | G | G | G | G | G | G | P | G | P | G | G | G | P | P | |
| | 123 | G | G | G | G | G | G | P | G | G | P | P | G | G | G | P | G | G | G | G | G | P | G | P | |
| | 124 | G | P | G | G | G | G | P | G | G | P | P | G | G | G | G | G | G | P | G | G | G | P | G | |
| | 125 | P | P | P | P | P | P | P | P | P | P | P | P | P | P | P | P | P | P | P | P | P | P | P | P |
| | 126 | G | P | P | G | G | G | P | G | G | P | G | G | G | G | G | G | P | G | G | P | G | P | G | |
| | 127 | P | P | P | P | P | P | P | P | P | P | P | P | P | P | P | P | P | P | P | P | P | P | P | P |
| | 128 | G | G | G | G | P | G | P | G | G | P | G | P | G | G | P | G | G | G | P | G | G | G | P | |
| | 129 | G | G | G | P | G | G | P | G | P | G | G | G | G | G | G | P | G | G | G | G | G | G | G | |
| | 130 | G | G | G | G | G | G | G | G | G | G | P | G | G | G | P | G | G | G | G | G | G | G | G | |
| | 131 | G | P | G | P | G | G | P | G | G | P | G | G | P | G | G | G | G | P | G | G | G | G | G | |
| | 132 | G | G | G | G | G | P | G | G | G | G | G | G | G | G | G | P | G | G | G | G | G | G | G | |
| | 133 | G | P | G | G | G | G | P | G | G | P | G | G | P | G | G | G | G | P | G | G | G | P | G | |
| | 134 | G | G | G | G | G | P | G | G | G | G | P | G | G | G | G | G | G | G | G | P | G | G | G | |
| | 135 | P | G | G | G | G | G | P | G | G | P | G | G | G | G | G | G | G | G | G | G | G | G | P | |
| | 136 | G | G | G | G | G | G | G | G | G | G | G | G | G | G | G | G | G | G | G | G | G | G | G | |
| | 137 | G | G | G | G | P | G | P | G | G | G | G | G | G | G | P | G | G | G | G | P | G | G | G | |
| | 138 | G | G | G | P | G | G | G | G | G | P | G | G | G | G | G | G | G | G | G | G | G | G | G | |
| | 139 | G | G | P | G | G | G | G | P | G | G | G | G | G | G | G | G | G | G | G | P | G | G | | |
| | 140 | G | G | G | P | P | G | P | P | G | P | P | G | P | G | G | G | G | G | P | P | P | G | P | |
| | 141 | G | G | G | G | G | G | G | G | G | G | G | G | G | G | G | G | G | G | G | G | G | G | G | |
| | 142 | G | G | G | G | G | G | G | G | G | G | G | G | G | G | G | G | G | G | G | G | G | G | G | |
| | 143 | G | G | G | G | G | G | G | G | G | G | G | G | G | G | G | G | G | G | G | G | G | G | G | |
| | 144 | G | G | G | G | G | G | G | G | G | G | G | G | G | G | G | G | G | G | G | G | G | G | G | |
| | 145 | G | G | G | G | G | G | G | G | G | G | G | G | G | G | G | G | G | G | G | G | G | G | G | |

TABLE 16-continued

| | | | | | | | | | | | | | | | | | | | | | | | |
|---|---|---|---|---|---|---|---|---|---|---|---|---|---|---|---|---|---|---|---|---|---|---|---|
| Surface roughness after cutting | | | | | | | | | | | | | | | | | | | | | | | |
| | 146 | G | G | G | G | G | G | G | G | G | G | G | G | G | G | G | G | G | G | G | G | G | G |
| | 147 | G | G | G | G | G | G | G | G | G | G | G | G | G | G | G | G | G | G | G | G | G | G |
| | 148 | G | G | G | G | G | G | G | G | G | G | G | G | G | G | G | G | G | G | G | G | G | G |
| | 149 | G | G | G | G | G | G | G | G | G | G | G | G | G | G | G | G | G | G | G | G | G | G |
| | 150 | G | G | G | G | G | P | G | G | G | G | G | G | G | G | G | G | G | G | G | G | G | G |
| | 151 | G | G | G | G | G | G | G | G | P | G | G | G | G | G | G | P | G | G | G | G | G | G |
| Insert material | | 4 | 4 | 4 | 4 | 4 | 4 | 4 | 4 | 4 | 4 | 4 | 4 | 4 | 4 | 4 | 4 | | | | | | |
| Cutting speed | | 1 | 1 | 1 | 1 | 1 | 1 | 1 | 1 | 2 | 2 | 2 | 2 | 2 | 2 | 2 | 2 | | | | | | |
| Feed rate | | 1 | 1 | 1 | 1 | 2 | 2 | 2 | 2 | 1 | 1 | 1 | 1 | 2 | 2 | 2 | 2 | | | | | | |
| Cutting depth | | 1 | 1 | 2 | 2 | 1 | 1 | 2 | 2 | 1 | 1 | 2 | 2 | 1 | 1 | 2 | 2 | | | | | | |
| Lubricant | | 1 | 2 | 1 | 2 | 1 | 2 | 1 | 2 | 1 | 2 | 1 | 2 | 1 | 2 | 1 | 2 | | | | | | |
| Test sample No. | 114 | G | G | G | G | G | G | G | G | G | G | G | G | G | G | G | G | | | | | | |
| | 115 | G | G | G | G | G | G | G | G | G | G | G | G | G | G | G | G | | | | | | |
| | 116 | G | G | G | G | G | G | G | G | G | G | G | G | G | G | G | G | | | | | | |
| | 117 | G | G | G | G | G | G | G | G | G | G | G | G | G | G | G | G | | | | | | |
| | 118 | G | G | G | G | G | G | G | G | G | G | G | G | G | G | G | G | | | | | | |
| | 119 | G | G | G | G | G | G | G | G | G | G | G | G | G | G | G | G | | | | | | |
| | 120 | G | G | G | G | G | G | G | G | G | G | G | G | G | G | G | G | | | | | | |
| | 121 | G | G | G | G | G | G | G | G | G | G | G | G | G | G | G | G | | | | | | |
| | 122 | G | P | G | G | G | G | G | G | G | G | P | G | G | P | G | P | | | | | | |
| | 123 | G | G | G | P | G | G | G | P | P | G | G | G | G | G | P | P | | | | | | |
| | 124 | G | G | G | P | G | P | G | G | G | G | G | G | G | G | P | P | | | | | | |
| | 125 | P | P | P | P | P | P | P | P | P | P | P | P | P | P | P | P | | | | | | |
| | 126 | G | G | G | P | G | G | P | P | G | P | P | G | P | P | G | G | | | | | | |
| | 127 | P | P | P | P | P | P | P | P | P | P | P | P | P | P | P | P | | | | | | |
| | 128 | G | G | G | G | G | P | G | P | G | G | G | G | G | G | G | G | | | | | | |
| | 129 | G | G | G | G | P | G | G | G | G | P | G | P | G | G | P | G | | | | | | |
| | 130 | G | P | G | G | G | G | G | G | G | G | P | G | P | G | G | G | | | | | | |
| | 131 | G | G | G | G | G | P | G | P | P | G | G | G | G | G | G | P | | | | | | |
| | 132 | G | G | G | G | G | G | G | G | G | G | P | G | G | G | G | G | | | | | | |
| | 133 | P | G | G | G | G | G | G | G | G | G | G | G | P | G | G | P | | | | | | |
| | 134 | G | G | G | G | G | G | G | P | G | G | G | G | G | G | G | G | | | | | | |
| | 135 | G | G | G | G | G | G | G | G | G | P | G | G | G | G | G | G | | | | | | |
| | 136 | G | G | G | G | G | G | P | G | G | P | G | P | G | G | G | G | | | | | | |
| | 137 | G | G | G | P | G | G | G | G | G | G | G | G | P | G | P | G | | | | | | |
| | 138 | G | G | G | G | G | G | G | G | P | G | G | G | G | G | G | G | | | | | | |
| | 139 | G | G | G | G | G | G | G | G | G | G | G | G | G | P | G | G | | | | | | |
| | 140 | P | G | G | G | G | P | G | G | P | G | G | P | G | G | G | P | | | | | | |
| | 141 | G | G | G | G | G | G | G | G | G | G | G | G | G | G | G | G | | | | | | |
| | 142 | G | G | G | G | G | G | G | G | G | G | G | G | G | G | G | G | | | | | | |
| | 143 | G | G | G | G | G | G | G | G | G | G | G | G | G | G | G | G | | | | | | |
| | 144 | G | G | G | G | G | G | G | G | G | G | G | G | G | G | G | G | | | | | | |
| | 145 | G | G | G | G | G | G | G | G | G | G | G | G | G | G | G | G | | | | | | |
| | 146 | G | G | G | G | G | G | G | G | G | G | G | G | G | G | G | G | | | | | | |
| | 147 | G | G | G | G | G | G | G | G | G | G | G | G | G | G | G | G | | | | | | |
| | 148 | G | G | G | G | G | G | G | G | G | G | G | G | G | G | G | G | | | | | | |
| | 149 | G | G | G | G | G | G | G | G | G | G | G | G | G | G | G | G | | | | | | |
| | 150 | G | G | P | G | G | G | G | G | G | G | G | G | G | G | G | G | | | | | | |
| | 151 | G | G | G | G | G | G | G | G | G | G | G | G | G | G | G | G | | | | | | |

* G: Good, P: Poor

TABLE 17

| Surface roughness after cutting | | | | | | | | | | | | | | | | | | | | | | | | | |
|---|---|---|---|---|---|---|---|---|---|---|---|---|---|---|---|---|---|---|---|---|---|---|---|---|---|
| | Insert material | | | | | | | | | | | | | | | | | | | | | | | | |
| | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 |
| | Cutting speed | | | | | | | | | | | | | | | | | | | | | | | | |
| | 1 | 1 | 1 | 1 | 1 | 1 | 1 | 1 | 2 | 2 | 2 | 2 | 2 | 2 | 2 | 2 | 1 | 1 | 1 | 1 | 1 | 1 | 1 | 1 | 2 |
| | Feed rate | | | | | | | | | | | | | | | | | | | | | | | | |
| | 1 | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 1 |
| | Cutting depth | | | | | | | | | | | | | | | | | | | | | | | | |
| | 1 | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | 1 |
| | Lubricant | | | | | | | | | | | | | | | | | | | | | | | | |
| | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 |
| Test sample No. 76 | G | G | G | G | G | G | G | G | G | G | G | G | G | G | G | G | G | G | G | G | G | G | G | G | G |
| 77 | G | G | G | G | G | G | G | G | G | G | G | G | G | G | G | G | G | G | G | G | G | G | G | G | G |
| 78 | G | G | G | G | G | G | G | G | G | G | G | G | G | G | G | G | G | G | G | G | G | G | G | G | G |
| 79 | G | G | G | G | G | G | G | G | G | G | G | G | G | G | G | G | G | G | G | G | G | G | G | G | G |
| 80 | G | G | G | G | G | G | G | G | G | G | G | G | G | G | G | G | G | G | G | G | G | G | G | G | G |
| 81 | G | G | G | G | G | G | G | G | G | G | G | G | G | G | G | G | G | G | G | G | G | G | G | G | G |
| 82 | G | G | G | G | G | G | G | G | G | G | G | G | G | G | G | G | G | G | G | G | G | G | G | G | G |
| 83 | G | G | G | G | G | G | G | G | G | G | G | G | G | G | G | G | G | G | G | G | G | G | G | G | G |
| 84 | G | G | G | G | G | G | G | G | G | G | G | G | G | G | G | G | G | G | G | G | G | G | G | G | G |
| 85 | G | G | G | G | G | G | G | G | G | G | G | G | G | G | G | G | G | G | G | G | G | G | G | G | G |
| 86 | G | G | G | G | G | G | G | G | G | G | G | G | G | G | G | G | G | G | G | G | G | G | G | G | G |
| 87 | G | G | G | G | G | G | G | G | G | G | G | G | G | G | G | G | G | G | G | G | G | G | G | G | G |
| 88 | G | G | G | G | G | G | G | G | G | G | G | G | G | G | G | G | G | G | G | G | G | G | G | G | G |
| 89 | G | G | G | G | G | G | G | G | G | G | G | G | G | G | G | G | G | G | G | G | G | G | G | G | G |
| 90 | G | G | G | G | G | G | G | G | G | G | G | G | G | G | G | G | G | G | G | G | G | G | G | G | G |
| 91 | E | E | E | E | E | E | E | E | E | E | E | E | E | E | E | E | E | E | E | E | E | E | E | E | E |
| 92 | E | E | E | E | E | E | E | E | E | E | E | E | E | E | E | E | E | E | E | E | E | E | E | E | E |
| 93 | E | E | E | E | E | E | E | E | E | E | E | E | E | E | E | E | E | E | E | E | E | E | E | E | E |
| 94 | E | E | E | E | E | E | E | E | E | E | E | E | E | E | E | E | E | E | E | E | E | E | E | E | E |
| 95 | G | G | G | G | G | G | G | G | G | G | G | G | G | G | G | G | G | G | G | G | G | G | G | G | G |
| 96 | G | G | G | G | G | G | G | G | G | G | G | G | G | G | G | G | G | G | G | G | G | G | G | G | G |
| 97 | G | G | G | G | G | G | G | G | G | G | G | G | G | G | G | G | G | G | G | G | G | G | G | G | G |
| 98 | G | G | G | G | G | G | G | G | G | G | G | G | G | G | G | G | G | G | G | G | G | G | G | G | G |
| 99 | G | G | G | G | G | G | G | G | G | G | G | G | G | G | G | G | G | G | G | G | G | G | G | G | G |
| 100 | G | G | G | G | G | G | G | G | G | G | G | G | G | G | G | G | G | G | G | G | G | G | G | G | G |
| 101 | G | G | G | G | G | G | G | G | G | G | G | G | G | G | G | G | G | G | G | G | G | G | G | G | G |
| 102 | G | G | G | G | G | G | G | G | G | G | G | G | G | G | G | G | G | G | G | G | G | G | G | G | G |
| 103 | G | G | G | G | G | G | G | G | G | G | G | G | G | G | G | G | G | G | G | G | G | G | G | G | G |
| 104 | G | G | G | G | G | G | G | G | G | G | G | G | G | G | G | G | G | G | G | G | G | G | G | G | G |
| 105 | G | G | G | G | G | G | G | G | G | G | G | G | G | G | G | G | G | G | G | G | G | G | G | G | G |
| 106 | G | G | G | G | G | G | G | G | G | G | G | G | G | G | G | G | G | G | G | G | G | G | G | G | G |
| 107 | G | G | G | G | G | G | G | G | G | G | G | G | G | G | G | G | G | G | G | G | G | G | G | G | G |
| 108 | G | G | G | G | G | G | G | G | G | G | G | G | G | G | G | G | G | G | G | G | G | G | G | G | G |
| 109 | G | G | G | G | G | G | G | G | G | G | G | G | G | G | G | G | G | G | G | G | G | G | G | G | G |
| 110 | G | G | G | G | G | G | G | G | G | G | G | G | G | G | G | G | G | G | G | G | G | G | G | G | G |
| 111 | G | G | G | G | G | G | G | G | G | G | G | G | G | G | G | G | G | G | G | G | G | G | G | G | G |
| 112 | G | G | G | G | G | G | G | G | G | G | G | G | G | G | G | G | G | G | G | G | G | G | G | G | G |
| 113 | G | G | G | G | G | G | G | G | G | G | G | G | G | G | G | G | G | G | G | G | G | G | G | G | G |

| | Insert material | | | | | | | | | | | | | | | | | | | | | | | | |
|---|---|---|---|---|---|---|---|---|---|---|---|---|---|---|---|---|---|---|---|---|---|---|---|---|---|
| | 2 | 2 | 2 | 2 | 2 | 2 | 2 | 3 | 3 | 3 | 3 | 3 | 3 | 3 | 3 | 3 | 3 | 3 | 3 | 3 | 3 | 3 | 3 | 3 | 3 |
| | Cutting speed | | | | | | | | | | | | | | | | | | | | | | | | |
| | 2 | 2 | 2 | 2 | 2 | 2 | 2 | 1 | 1 | 1 | 1 | 1 | 1 | 1 | 1 | 1 | 2 | 2 | 2 | 2 | 2 | 2 | 2 | 2 | 2 |
| | Feed rate | | | | | | | | | | | | | | | | | | | | | | | | |
| | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | | |
| | Cutting depth | | | | | | | | | | | | | | | | | | | | | | | | |
| | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | | |
| | Lubricant | | | | | | | | | | | | | | | | | | | | | | | | |
| | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | | |
| Test sample No. 76 | G | G | G | G | G | G | G | G | G | G | G | G | G | G | G | G | G | G | G | G | G | G | G | | |
| 77 | G | G | G | G | G | G | G | G | G | G | G | G | G | G | G | G | G | G | G | G | G | G | G | | |
| 78 | G | G | G | G | G | G | G | G | G | G | G | G | G | G | G | G | G | G | G | G | G | G | G | | |
| 79 | G | G | G | G | G | G | G | G | G | G | G | G | G | G | G | G | G | G | G | G | G | G | G | | |
| 80 | G | G | G | G | G | G | G | G | G | G | G | G | G | G | G | G | G | G | G | G | G | G | G | | |
| 81 | G | G | G | G | G | G | G | G | G | G | G | G | G | G | G | G | G | G | G | G | G | G | G | | |
| 82 | G | G | G | G | G | G | G | G | G | G | G | G | G | G | G | G | G | G | G | G | G | G | G | | |

TABLE 17-continued

| | | | | | | | | | | | | | | | | | | | | | | | |
|---|---|---|---|---|---|---|---|---|---|---|---|---|---|---|---|---|---|---|---|---|---|---|---|
| Surface roughness after cutting | | | | | | | | | | | | | | | | | | | | | | | |
| 83 | G | G | G | G | G | G | G | G | G | G | G | G | G | G | G | G | G | G | G | G | G | G | G |
| 84 | G | G | G | G | G | G | G | G | G | G | G | G | G | G | G | G | G | G | G | G | G | G | G |
| 85 | G | G | G | G | G | G | G | G | G | G | G | G | G | G | G | G | G | G | G | G | G | G | G |
| 86 | G | G | G | G | G | G | G | G | G | G | G | G | G | G | G | G | G | G | G | G | G | G | G |
| 87 | G | G | G | G | G | G | G | G | G | G | G | G | G | G | G | G | G | G | G | G | G | G | G |
| 88 | G | G | G | G | G | G | G | G | G | G | G | G | G | G | G | G | G | G | G | G | G | G | G |
| 89 | G | G | G | G | G | G | G | G | G | G | G | G | G | G | G | G | G | G | G | G | G | G | G |
| 90 | G | G | G | G | G | G | G | G | G | G | G | G | G | G | G | G | G | G | G | G | G | G | G |
| 91 | E | E | E | E | E | E | E | E | E | E | E | E | E | E | E | E | E | E | E | E | E | E | E |
| 92 | E | E | E | E | E | E | E | E | E | E | E | E | E | E | E | E | E | E | E | E | E | E | E |
| 93 | E | E | E | E | E | E | E | E | E | E | E | E | E | E | E | E | E | E | E | E | E | E | E |
| 94 | E | E | E | E | E | E | E | E | E | E | E | E | E | E | E | E | E | E | E | E | E | E | E |
| 95 | G | G | G | G | G | G | G | G | G | G | G | G | G | G | G | G | G | G | G | G | G | G | G |
| 96 | G | G | G | G | G | G | G | G | G | G | G | G | G | G | G | G | G | G | G | G | G | G | G |
| 97 | G | G | G | G | G | G | G | G | G | G | G | G | G | G | G | G | G | G | G | G | G | G | G |
| 98 | G | G | G | G | G | G | G | G | G | G | G | G | G | G | G | G | G | G | G | G | G | G | G |
| 99 | G | G | G | G | G | G | G | G | G | G | G | G | G | G | G | G | G | G | G | G | G | G | G |
| 100 | G | G | G | G | G | G | G | G | G | G | G | G | G | G | G | G | G | G | G | G | G | G | G |
| 101 | G | G | G | G | G | G | G | G | G | G | G | G | G | G | G | G | G | G | G | G | G | G | G |
| 102 | G | G | G | G | G | G | G | G | G | G | G | G | G | G | G | G | G | G | G | G | G | G | G |
| 103 | G | G | G | G | G | G | G | G | G | G | G | G | G | G | G | G | G | G | G | G | G | G | G |
| 104 | G | G | G | G | G | G | G | G | G | G | G | G | G | G | G | G | G | G | G | G | G | G | G |
| 105 | G | G | G | G | G | G | G | G | G | G | G | G | G | G | G | G | G | G | G | G | G | G | G |
| 106 | G | G | G | G | G | G | G | G | G | G | G | G | G | G | G | G | G | G | G | G | G | G | G |
| 107 | G | G | G | G | G | G | G | G | G | G | G | G | G | G | G | G | G | G | G | G | G | G | G |
| 108 | G | G | G | G | G | G | G | G | G | G | G | G | G | G | G | G | G | G | G | G | G | G | G |
| 109 | G | G | G | G | G | G | G | G | G | G | G | G | G | G | G | G | G | G | G | G | G | G | G |
| 110 | G | G | G | G | G | G | G | G | G | G | G | G | G | G | G | G | G | G | G | G | G | G | G |
| 111 | G | G | G | G | G | G | G | G | G | G | G | G | G | G | G | G | G | G | G | G | G | G | G |
| 112 | G | G | G | G | G | G | G | G | G | G | G | G | G | G | G | G | G | G | G | G | G | G | G |
| 113 | G | G | G | G | G | G | G | G | G | G | G | G | G | G | G | G | G | G | G | G | G | G | G |

| | | | | | | | | | | | | | | | | | |
|---|---|---|---|---|---|---|---|---|---|---|---|---|---|---|---|---|---|
| Insert material | | | | | | | | | | | | | | | | | |
| | 4 | 4 | 4 | 4 | 4 | 4 | 4 | 4 | 4 | 4 | 4 | 4 | 4 | 4 | 4 | 4 | 4 |
| Cutting speed | | | | | | | | | | | | | | | | | |
| | 1 | 1 | 1 | 1 | 1 | 1 | 1 | 1 | 2 | 2 | 2 | 2 | 2 | 2 | 2 | 2 | 2 |
| Feed rate | | | | | | | | | | | | | | | | | |
| | 1 | 1 | 1 | 1 | 2 | 2 | 2 | 2 | 1 | 1 | 1 | 1 | 2 | 2 | 2 | 2 | 2 |
| Cutting depth | | | | | | | | | | | | | | | | | |
| | 1 | 1 | 2 | 2 | 1 | 1 | 2 | 2 | 1 | 1 | 2 | 2 | 1 | 1 | 2 | 2 | 2 |
| Lubricant | | | | | | | | | | | | | | | | | |
| | 1 | 2 | 1 | 2 | 1 | 2 | 1 | 2 | 1 | 2 | 1 | 2 | 1 | 2 | 1 | 2 | 2 |
| Test sample No. 76 | G | G | G | G | G | G | G | G | G | G | G | G | G | G | G | G | G |
| 77 | G | G | G | G | G | G | G | G | G | G | G | G | G | G | G | G | G |
| 78 | G | G | G | G | G | G | G | G | G | G | G | G | G | G | G | G | G |
| 79 | G | G | G | G | G | G | G | G | G | G | G | G | G | G | G | G | G |
| 80 | G | G | G | G | G | G | G | G | G | G | G | G | G | G | G | G | G |
| 81 | G | G | G | G | G | G | G | G | G | G | G | G | G | G | G | G | G |
| 82 | G | G | G | G | G | G | G | G | G | G | G | G | G | G | G | G | G |
| 83 | G | G | G | G | G | G | G | G | G | G | G | G | G | G | G | G | G |
| 84 | G | G | G | G | G | G | G | G | G | G | G | G | G | G | G | G | G |
| 85 | G | G | G | G | G | G | G | G | G | G | G | G | G | G | G | G | G |
| 86 | G | G | G | G | G | G | G | G | G | G | G | G | G | G | G | G | G |
| 87 | G | G | G | G | G | G | G | G | G | G | G | G | G | G | G | G | G |
| 88 | G | G | G | G | G | G | G | G | G | G | G | G | G | G | G | G | G |
| 89 | G | G | G | G | G | G | G | G | G | G | G | G | G | G | G | G | G |
| 90 | G | G | G | G | G | G | G | G | G | G | G | G | G | G | G | G | G |
| 91 | E | E | E | E | E | E | E | E | E | E | E | E | E | E | E | E | E |
| 92 | E | E | E | E | E | E | E | E | E | E | E | E | E | E | E | E | E |
| 93 | E | E | E | E | E | E | E | E | E | E | E | E | E | E | E | E | E |
| 94 | E | E | E | E | E | E | E | E | E | E | E | E | E | E | E | E | E |
| 95 | G | G | G | G | G | G | G | G | G | G | G | G | G | G | G | G | G |
| 96 | G | G | G | G | G | G | G | G | G | G | G | G | G | G | G | G | G |
| 97 | G | G | G | G | G | G | G | G | G | G | G | G | G | G | G | G | G |
| 98 | G | G | G | G | G | G | G | G | G | G | G | G | G | G | G | G | G |
| 99 | G | G | G | G | G | G | G | G | G | G | G | G | G | G | G | G | G |
| 100 | G | G | G | G | G | G | G | G | G | G | G | G | G | G | G | G | G |
| 101 | G | G | G | G | G | G | G | G | G | G | G | G | G | G | G | G | G |
| 102 | G | G | G | G | G | G | G | G | G | G | G | G | G | G | G | G | G |
| 103 | G | G | G | G | G | G | G | G | G | G | G | G | G | G | G | G | G |
| 104 | G | G | G | G | G | G | G | G | G | G | G | G | G | G | G | G | G |
| 105 | G | G | G | G | G | G | G | G | G | G | G | G | G | G | G | G | G |

TABLE 17-continued

| | Surface roughness after cutting | | | | | | | | | | | | | | | |
|---|---|---|---|---|---|---|---|---|---|---|---|---|---|---|---|---|
| 106 | G | G | G | G | G | G | G | G | G | G | G | G | G | G | G | G |
| 107 | G | G | G | G | G | G | G | G | G | G | G | G | G | G | G | G |
| 108 | G | G | G | G | G | G | G | G | G | G | G | G | G | G | G | G |
| 109 | G | G | G | G | G | G | G | G | G | G | G | G | G | G | G | G |
| 110 | G | G | G | G | G | G | G | G | G | G | G | G | G | G | G | G |
| 111 | G | G | G | G | G | G | G | G | G | G | G | G | G | G | G | G |
| 112 | G | G | G | G | G | G | G | G | G | G | G | G | G | G | G | G |
| 113 | G | G | G | G | G | G | G | G | G | G | G | G | G | G | G | G |

* E: Excellent, G: Good, P: Poor

TABLE 18

| | | Surface roughness after cutting | | | | | | | | | | | | | | | | | | | | | | | | |
|---|---|---|---|---|---|---|---|---|---|---|---|---|---|---|---|---|---|---|---|---|---|---|---|---|---|---|
| | | Insert material | | | | | | | | | | | | | | | | | | | | | | | | |
| | | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 |
| | | Cutting speed | | | | | | | | | | | | | | | | | | | | | | | | |
| | | 1 | 1 | 1 | 1 | 1 | 1 | 1 | 1 | 2 | 2 | 2 | 2 | 2 | 2 | 2 | 2 | 1 | 1 | 1 | 1 | 1 | 1 | 1 | 1 | 2 |
| | | Feed rate | | | | | | | | | | | | | | | | | | | | | | | | |
| | | 1 | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 | 1 |
| | | Cutting depth | | | | | | | | | | | | | | | | | | | | | | | | |
| | | 1 | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 | 1 |
| | | Lubricant | | | | | | | | | | | | | | | | | | | | | | | | |
| | | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 |
| Test sample No. | 114 | G | G | G | G | G | G | G | G | G | G | G | G | G | G | G | G | G | G | G | G | G | G | G | G | G |
| | 115 | G | G | G | G | G | G | G | G | G | G | G | G | G | G | G | G | G | G | G | G | G | G | G | G | G |
| | 116 | G | G | G | G | G | G | G | G | G | G | G | G | G | G | G | G | G | G | G | G | G | G | G | G | G |
| | 117 | G | G | G | G | G | G | G | G | G | G | G | G | G | G | G | G | G | G | G | G | G | G | G | G | G |
| | 118 | G | G | G | G | G | G | G | G | G | G | G | G | G | G | G | G | G | G | G | G | G | G | G | G | G |
| | 119 | G | G | G | G | G | G | G | G | G | G | G | G | G | G | G | G | G | G | G | G | G | G | G | G | G |
| | 120 | G | G | G | G | G | G | G | G | G | G | G | G | G | G | G | G | G | G | G | G | G | G | G | G | G |
| | 121 | G | G | G | G | G | G | G | G | G | G | G | G | G | G | G | G | G | G | G | G | G | G | G | G | G |
| | 122 | G | G | G | P | G | G | P | G | G | G | G | G | G | G | P | G | P | G | G | G | G | G | G | G | P |
| | 123 | G | G | P | G | G | G | G | G | G | G | G | G | G | P | G | G | G | G | G | G | G | G | G | G | P |
| | 124 | G | G | G | P | G | G | G | G | G | G | G | G | G | G | G | P | G | G | G | G | G | G | G | G | G |
| | 125 | P | P | P | P | P | P | P | P | P | P | P | P | P | P | P | P | P | P | P | P | P | P | P | P | P |
| | 126 | G | G | G | G | G | G | G | P | G | G | G | G | G | G | P | G | G | G | G | P | G | G | G | G | P |
| | 127 | P | P | P | P | G | P | P | P | G | P | P | P | P | P | P | P | P | P | P | P | G | P | P | P | P |
| | 128 | G | G | G | G | G | G | G | G | G | P | G | G | G | G | P | G | G | G | G | G | G | G | G | G | G |
| | 129 | G | G | G | P | G | G | G | G | G | G | G | G | G | G | G | G | G | G | G | G | G | G | G | G | G |
| | 130 | G | G | G | G | G | G | G | G | G | G | G | G | G | G | P | G | G | G | G | G | G | G | G | G | G |
| | 131 | G | G | G | G | G | G | G | G | G | G | G | G | G | G | G | G | G | G | G | G | G | G | G | G | G |
| | 132 | G | G | G | G | G | G | G | G | G | G | G | G | G | G | G | G | G | G | G | G | G | G | G | G | G |
| | 133 | G | G | G | G | G | G | G | G | G | G | G | G | G | G | G | G | G | G | G | G | G | G | G | G | G |
| | 134 | G | G | G | G | G | G | G | G | G | G | G | G | G | G | G | G | G | G | G | G | G | G | G | G | G |
| | 135 | G | G | G | G | G | G | G | G | G | P | P | G | G | G | G | G | G | G | G | G | G | G | G | G | G |
| | 136 | G | G | G | G | G | G | G | G | G | G | G | G | G | G | G | P | G | G | G | G | G | G | G | G | G |
| | 137 | G | G | G | G | G | G | G | G | G | G | G | G | G | G | G | G | G | G | G | G | G | G | G | G | G |
| | 138 | G | G | G | G | G | G | G | G | G | G | G | G | G | G | G | G | G | G | G | G | G | G | G | G | G |
| | 139 | G | G | G | G | G | G | G | G | G | G | G | G | G | G | G | G | G | G | G | G | G | G | G | G | G |
| | 140 | G | G | G | P | G | G | G | G | P | G | G | G | G | G | P | G | G | G | G | G | G | P | G | G | G |
| | 141 | G | G | G | G | G | G | G | G | G | G | G | G | G | G | G | G | G | G | G | G | G | G | G | G | G |
| | 142 | G | G | G | G | G | G | G | G | G | G | G | G | G | G | G | G | G | G | G | G | G | G | G | G | G |
| | 143 | G | G | G | G | G | G | G | G | G | G | G | G | G | G | G | G | G | G | G | G | G | G | G | G | G |
| | 144 | G | G | G | G | G | G | G | G | G | G | G | G | G | G | G | G | G | G | G | G | G | G | G | G | G |
| | 145 | E | E | E | E | E | E | E | E | E | E | E | E | E | E | E | E | E | E | E | E | E | E | E | E | E |
| | 146 | E | E | E | E | E | E | E | E | E | E | E | E | E | E | E | E | E | E | E | E | E | E | E | E | E |
| | 147 | E | E | E | E | E | E | E | E | E | E | E | E | E | E | E | E | E | E | E | E | E | E | E | E | E |
| | 148 | E | E | E | E | E | E | E | E | E | E | E | E | E | E | E | E | E | E | E | E | E | E | E | E | E |
| | 149 | G | G | G | G | G | G | G | G | G | G | G | G | G | G | G | G | G | G | G | G | G | G | G | G | G |
| | 150 | G | G | G | G | G | G | G | G | G | G | G | G | G | G | G | G | G | G | P | G | G | G | G | G | G |
| | 151 | G | G | G | G | G | G | P | G | G | P | P | P | P | P | G | G | G | P | P | G | P | P | G | G | G |

TABLE 18-continued

| | | Surface roughness after cutting | | | | | | | | | | | | | | | | | | | | | | |
|---|---|---|---|---|---|---|---|---|---|---|---|---|---|---|---|---|---|---|---|---|---|---|---|---|
| | | Insert material | | | | | | | | | | | | | | | | | | | | | | |
| | | 2 | 2 | 2 | 2 | 2 | 2 | 2 | 3 | 3 | 3 | 3 | 3 | 3 | 3 | 3 | 3 | 3 | 3 | 3 | 3 | 3 | 3 | 3 |
| | | Cutting speed | | | | | | | | | | | | | | | | | | | | | | |
| | | 2 | 2 | 2 | 2 | 2 | 2 | 2 | 1 | 1 | 1 | 1 | 1 | 1 | 1 | 1 | 2 | 2 | 2 | 2 | 2 | 2 | 2 | 2 |
| | | Feed rate | | | | | | | | | | | | | | | | | | | | | | |
| | | 1 | 1 | 1 | 2 | 2 | 2 | 2 | 1 | 1 | 1 | 1 | 2 | 2 | 2 | 2 | 1 | 1 | 1 | 1 | 2 | 2 | 2 | 2 |
| | | Cutting depth | | | | | | | | | | | | | | | | | | | | | | |
| | | 1 | 2 | 2 | 1 | 1 | 2 | 2 | 1 | 1 | 2 | 2 | 1 | 1 | 2 | 2 | 1 | 1 | 2 | 2 | 1 | 1 | 2 | 2 |
| | | Lubricant | | | | | | | | | | | | | | | | | | | | | | |
| | | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| Test sample No. | 114 | G | G | G | G | G | G | G | G | G | G | G | G | G | G | G | G | G | G | G | G | G | G | G |
| | 115 | G | G | G | G | G | G | G | G | G | G | G | G | G | G | G | G | G | G | G | G | G | G | G |
| | 116 | G | G | G | G | G | G | G | G | G | G | G | G | G | G | G | G | G | G | G | G | G | G | G |
| | 117 | G | G | G | G | G | G | G | G | G | G | G | G | G | G | G | G | G | G | G | G | G | G | G |
| | 118 | G | G | G | G | G | G | G | G | G | G | G | G | G | G | G | G | G | G | G | G | G | G | G |
| | 119 | G | G | G | G | G | G | G | G | G | G | G | G | G | G | G | G | G | G | G | G | G | G | G |
| | 120 | G | G | G | G | G | G | G | G | G | G | G | G | G | G | G | G | G | G | G | G | G | G | G |
| | 121 | G | G | G | G | G | G | G | G | G | G | G | G | G | G | G | G | G | G | G | G | G | G | G |
| | 122 | G | G | G | G | P | G | G | G | G | G | G | G | P | G | G | P | G | G | G | G | G | G | P |
| | 123 | G | G | G | G | G | G | P | G | P | G | G | G | G | G | G | G | G | G | G | G | G | P | G |
| | 124 | G | G | G | G | G | G | P | G | P | G | G | G | G | G | P | G | G | G | G | G | G | G | G |
| | 125 | P | P | P | P | P | P | P | P | P | P | P | P | P | P | P | P | P | P | P | P | P | P | P |
| | 126 | G | G | G | G | G | G | G | G | G | G | G | G | G | G | P | G | G | G | G | G | G | G | P |
| | 127 | P | P | P | P | P | P | P | P | P | P | P | P | P | P | P | P | P | P | P | P | P | P | P |
| | 128 | G | G | G | G | G | G | G | G | G | G | G | G | G | G | G | G | G | G | G | G | G | G | G |
| | 129 | G | G | G | G | G | G | G | G | G | G | G | G | G | G | G | G | G | G | G | G | G | G | G |
| | 130 | G | G | G | G | G | G | G | G | P | G | G | G | G | G | G | P | G | G | G | G | G | G | G |
| | 131 | G | G | G | G | G | G | G | G | G | G | G | G | G | G | G | G | G | G | G | G | G | G | G |
| | 132 | G | G | G | G | G | G | G | G | G | G | G | G | G | P | G | G | G | G | G | G | G | G | G |
| | 133 | G | G | G | G | G | G | P | G | G | G | G | G | G | G | G | G | G | G | G | G | G | G | G |
| | 134 | G | G | G | G | G | G | G | G | G | G | G | G | G | G | G | P | G | G | G | G | G | G | G |
| | 135 | G | G | G | G | G | G | G | G | G | G | G | G | G | G | G | G | G | G | G | G | G | G | G |
| | 136 | G | G | G | G | G | G | G | G | G | G | G | G | G | G | P | G | G | G | G | G | G | G | G |
| | 137 | G | G | G | G | G | G | G | G | G | G | G | G | G | G | P | G | G | G | P | G | G | G | G |
| | 138 | G | G | G | G | G | G | P | G | G | G | G | G | G | G | P | G | G | G | G | G | G | G | G |
| | 139 | G | G | G | G | G | P | P | G | G | G | G | G | G | G | G | G | G | G | G | G | G | G | G |
| | 140 | G | G | G | P | G | P | G | G | G | G | G | G | G | G | G | G | G | G | G | G | P | G | G |
| | 141 | G | G | G | G | G | G | G | G | G | G | G | G | G | G | G | G | G | G | G | G | G | G | G |
| | 142 | G | G | G | G | G | G | G | G | G | G | G | G | G | G | G | G | G | G | G | G | G | G | G |
| | 143 | G | G | G | G | G | G | G | G | G | G | G | G | G | G | G | G | G | G | G | G | G | G | G |
| | 144 | G | G | G | G | G | G | G | G | G | G | G | G | G | G | G | G | G | G | G | G | G | G | G |
| | 145 | E | E | E | E | E | E | E | E | E | E | E | E | E | E | E | E | E | E | E | E | E | E | E |
| | 146 | E | E | E | E | E | E | E | E | E | E | E | E | E | E | E | E | E | E | E | E | E | E | E |
| | 147 | E | E | E | E | E | E | E | E | E | E | E | E | E | E | E | E | E | E | E | E | E | E | E |
| | 148 | E | E | E | E | E | E | E | E | E | E | E | E | E | E | E | E | E | E | E | E | E | E | E |
| | 149 | G | G | G | G | G | G | G | G | G | G | G | G | G | G | G | G | G | G | G | G | G | G | G |
| | 150 | G | G | G | G | G | G | G | G | G | G | G | G | G | G | G | G | G | G | G | G | G | G | G |
| | 151 | G | P | G | P | P | G | P | G | G | P | G | G | P | G | G | G | G | P | G | G | P | G | G |

| | | Insert material | | | | | | | | | | | | | | | |
|---|---|---|---|---|---|---|---|---|---|---|---|---|---|---|---|---|---|
| | | 4 | 4 | 4 | 4 | 4 | 4 | 4 | 4 | 4 | 4 | 4 | 4 | 4 | 4 | 4 | 4 |
| | | Cutting speed | | | | | | | | | | | | | | | |
| | | 1 | 1 | 1 | 1 | 1 | 1 | 1 | 1 | 2 | 2 | 2 | 2 | 2 | 2 | 2 | 2 |
| | | Feed rate | | | | | | | | | | | | | | | |
| | | 1 | 1 | 1 | 1 | 2 | 2 | 2 | 2 | 1 | 1 | 1 | 1 | 2 | 2 | 2 | 2 |
| | | Cutting depth | | | | | | | | | | | | | | | |
| | | 1 | 1 | 2 | 2 | 1 | 1 | 2 | 2 | 1 | 1 | 2 | 2 | 1 | 1 | 2 | 2 |
| | | Lubricant | | | | | | | | | | | | | | | |
| | | 1 | 2 | 1 | 2 | 1 | 2 | 1 | 2 | 1 | 2 | 1 | 2 | 1 | 2 | 1 | 2 |
| Test sample No. | 114 | G | G | G | G | G | G | G | G | G | G | G | G | G | G | G | G |
| | 115 | G | G | G | G | G | G | G | G | G | G | G | G | G | G | G | G |
| | 116 | G | G | G | G | G | G | G | G | G | G | G | G | G | G | G | G |
| | 117 | G | G | G | G | G | G | G | G | G | G | G | G | G | G | G | G |
| | 118 | G | G | G | G | G | G | G | G | G | G | G | G | G | G | G | G |
| | 119 | G | G | G | G | G | G | G | G | G | G | G | G | G | G | G | G |
| | 120 | G | G | G | G | G | G | G | G | G | G | G | G | G | G | G | G |

TABLE 18-continued

| | Surface roughness after cutting | | | | | | | | | | | | | | | |
|---|---|---|---|---|---|---|---|---|---|---|---|---|---|---|---|---|
| 121 | G | G | G | G | G | G | G | G | G | G | G | G | G | G | G | G |
| 122 | G | G | P | G | G | G | P | G | G | G | G | G | G | G | G | P |
| 123 | G | P | G | G | G | G | G | G | G | G | G | G | P | G | G | P |
| 124 | G | G | G | G | G | G | G | P | G | G | G | G | G | G | G | G |
| 125 | P | P | P | P | P | P | P | P | P | P | P | P | P | P | P | P |
| 126 | G | G | P | P | P | P | G | G | G | G | P | G | G | G | G | P |
| 127 | P | P | P | P | G | P | P | P | P | P | P | P | P | P | P | P |
| 128 | G | G | G | G | G | G | G | P | G | G | G | G | G | G | G | G |
| 129 | G | G | G | G | G | G | G | G | G | G | G | G | G | G | G | G |
| 130 | G | G | G | G | G | G | G | G | G | G | G | G | G | G | G | G |
| 131 | G | P | G | G | G | G | G | G | G | G | G | G | G | G | G | G |
| 132 | G | P | G | G | G | G | G | G | G | G | G | G | G | G | G | G |
| 133 | G | G | G | G | P | P | G | G | G | G | G | G | G | G | G | G |
| 134 | G | G | G | G | G | G | G | G | G | G | G | G | G | G | G | G |
| 135 | G | G | G | G | G | G | G | G | G | G | G | G | G | G | G | G |
| 136 | G | G | G | G | G | G | G | G | G | G | G | G | G | G | G | G |
| 137 | G | G | G | G | G | G | G | G | G | G | G | G | G | G | G | G |
| 138 | G | P | G | G | G | G | G | G | G | G | G | G | G | G | G | G |
| 139 | G | G | G | G | P | G | G | G | G | G | G | G | G | G | G | G |
| 140 | G | G | G | G | G | G | G | G | G | G | G | G | G | G | G | G |
| 141 | G | G | G | G | G | G | G | G | G | G | G | G | G | G | G | G |
| 142 | G | G | G | G | G | G | G | G | G | G | G | G | G | G | G | G |
| 143 | G | G | G | G | G | G | G | G | G | G | G | G | G | G | G | G |
| 144 | G | G | G | G | G | G | G | G | G | G | G | G | G | G | G | G |
| 145 | E | E | E | E | E | E | E | E | E | E | E | E | E | E | E | E |
| 146 | E | E | E | E | E | E | E | E | E | E | E | E | E | E | E | E |
| 147 | E | E | E | E | E | E | E | E | E | E | E | E | E | E | E | E |
| 148 | E | E | E | E | E | E | E | E | E | E | E | E | E | E | E | E |
| 149 | G | G | G | G | G | G | G | G | G | G | G | G | G | G | G | G |
| 150 | G | G | G | G | G | G | G | G | G | G | G | G | G | G | G | G |
| 151 | G | G | P | G | G | P | G | P | P | P | P | G | P | G | G | P |

* E: Excellent, G: Good, P: Poor

The invention claimed is:

1. A wire rod for cutting work, comprising:

a chemical composition containing

C: 0.001 mass % to 0.150 mass %,

Si: 0.010 mass % or less,

Mn: 0.20 mass % to 2.00 mass %,

P: 0.02 mass % to 0.15 mass %,

S: 0.20 mass % to 0.50 mass %,

N: 0.0300 mass % or less, and

O: 0.0050 mass % to 0.0300 mass %, with the balance consisting of Fe and inevitable impurities; and Vickers hardness that satisfies the following expressions (1) and (2) in the case where an average aspect ratio of ferrite grains at a position of ¼ of a diameter from a surface of the wire rod for cutting work is more than 2.8, and satisfies the following expressions (3) and (4) in the case where the average aspect ratio is 2.8 or less, $$H_{ave} \leq 350 \quad (1)$$

$$H\sigma \leq 30 \quad (2)$$

$$H_{ave} \leq 250 \quad (3)$$

$$H\sigma \leq 25 \quad (4)$$

where $H_{ave}$ is an average value in a circumferential direction of Vickers hardness at the position of ¼ of the diameter from the surface, and Hσ is a standard deviation of Vickers hardness for 100 points at the position of ¼ of the diameter from the surface.

2. The wire rod for cutting work according to claim 1, wherein the chemical composition further contains one or more selected from the group consisting of Pb: 0.01 mass % to 0.50 mass %, Bi: 0.01 mass % to 0.50 mass %, Ca: 0.01 mass % or less, Se: 0.1 mass % or less, and Te: 0.1 mass % or less.

3. The wire rod for cutting work according to claim 1, wherein the chemical composition further contains one or more selected from the group consisting of Cr: 3.0 mass % or less, Al: 0.010 mass % or less, Sb: 0.010 mass % or less, Sn: 0.010 mass % or less, Cu: 1.0 mass % or less, Ni: 1.0 mass % or less, and Mo: 1.0 mass % or less.

4. The wire rod for cutting work according to claim 1, wherein the chemical composition further contains one or more selected from the group consisting of Nb: 0.050 mass % or less, Ti: 0.050 mass % or less, V: 0.050 mass % or less, Zr: 0.050 mass % or less, W: 0.050 mass % or less, Ta: 0.050 mass % or less, Y: 0.050 mass % or less, Hf: 0.050 mass % or less, and B: 0.050 mass % or less.

5. The wire rod for cutting work according to claim 2, wherein the chemical composition further contains one or more selected from the group consisting of Cr: 3.0 mass % or less, Al: 0.010 mass % or less, Sb: 0.010 mass % or less, Sn: 0.010 mass % or less, Cu: 1.0 mass % or less, Ni: 1.0 mass % or less, and Mo: 1.0 mass % or less.

6. The wire rod for cutting work according to claim 2, wherein the chemical composition further contains one or more selected from the group consisting of Nb: 0.050 mass % or less,
Ti: 0.050 mass % or less,
V: 0.050 mass % or less,
Zr: 0.050 mass % or less,
W: 0.050 mass % or less,
Ta: 0.050 mass % or less,
Y: 0.050 mass % or less,
Hf: 0.050 mass % or less, and
B: 0.050 mass % or less.

7. The wire rod for cutting work according to claim 3, wherein the chemical composition further contains one or more selected from the group consisting of Nb: 0.050 mass % or less,
Ti: 0.050 mass % or less,
V: 0.050 mass % or less,
Zr: 0.050 mass % or less,
W: 0.050 mass % or less,
Ta: 0.050 mass % or less,
Y: 0.050 mass % or less,
Hf: 0.050 mass % or less, and
B: 0.050 mass % or less.

8. The wire rod for cutting work according to claim 5, wherein the chemical composition further contains one or more selected from the group consisting of Nb: 0.050 mass % or less,
Ti: 0.050 mass % or less,
V: 0.050 mass % or less,
Zr: 0.050 mass % or less,
W: 0.050 mass % or less,
Ta: 0.050 mass % or less,
Y: 0.050 mass % or less,
Hf: 0.050 mass % or less, and
B: 0.050 mass % or less.

9. The wire rod for cutting work according to claim 1, wherein a diameter of the wire rod is 20 mm or less.

* * * * *